US012723335B2

(12) United States Patent
Relland et al.

(10) Patent No.: US 12,723,335 B2
(45) Date of Patent: Sep. 1, 2026

(54) CIRCULAR SOCK MACHINE AND A METHOD FOR ITS USE

(71) Applicants: Denton Relland, Edmund, OK (US); Susan Relland, Edmund, OK (US); Steve Rewerts, Cedar Falls, IA (US); Mary Watson, Cedar Falls, IA (US)

(72) Inventors: Denton Relland, Edmund, OK (US); Susan Relland, Edmund, OK (US); Steve Rewerts, Cedar Falls, IA (US); Mary Watson, Cedar Falls, IA (US)

( * ) Notice: Subject to any disclaimer, the term of this patent is extended or adjusted under 35 U.S.C. 154(b) by 0 days.

(21) Appl. No.: 18/448,898

(22) Filed: Aug. 11, 2023

(65) Prior Publication Data

US 2024/0133088 A1 Apr. 25, 2024

Related U.S. Application Data

(60) Provisional application No. 63/397,370, filed on Aug. 11, 2022.

(51) Int. Cl.
*D04B 9/06* (2006.01)
*D04B 9/22* (2006.01)
(Continued)

(52) U.S. Cl.
CPC ..... *D04B 9/06* (2013.01); *D04B 9/22* (2013.01); *D04B 9/46* (2013.01); *D04B 15/322* (2013.01); *D04B 15/58* (2013.01)

(58) Field of Classification Search
USPC ..... 66/19, 27, 28, 31, 35, 57
See application file for complete search history.

(56) References Cited

U.S. PATENT DOCUMENTS 128,421 A * 6/1872 Pease ..... D04B 9/06 66/115
649,243 A * 5/1900 Henry ..... D04B 9/06 66/20

(Continued)

FOREIGN PATENT DOCUMENTS

GB 191423887 A * 11/1915 ..... D04B 9/06

OTHER PUBLICATIONS

Screen captures from YouTube video clip entitled "CSM: Legare—How to take apart (and put back together again) Plus", 8 pages, uploaded by user "CSM Love" on May 24, 2021. Retrieved from Internet: <https://www.youtube.com/watch?v=JiiYJanqjLA> (Year: 2021).*

(Continued)

*Primary Examiner* — Aiying Zhao
(74) *Attorney, Agent, or Firm* — MUSIKIN & FARMER, LLC; Shawn R. Farmer

(57) ABSTRACT

The present device is a circular knitting machine, also known as a circular sock machine, designed to mostly be manufactured from polymers, such as plastics, or other materials that are typically lighter and have other physical properties, such as low hardness and tensile strength, compared to steel, from which such machines have historically been manufactured. The present design allows for the use of modern manufacturing techniques, such as 3-D printing in which a filament is often used comprising various types of polymers. The present device can also comprise a ribber apparatus, which is also designed to allow for most of its parts to be manufactured from polymers. However, in certain embodiments, some of the parts, such as needles, springs, and bolts can still be made from steel.

18 Claims, 31 Drawing Sheets

(51) Int. Cl.

| | |
|---|---|
| ***D04B 9/46*** | (2006.01) |
| ***D04B 15/32*** | (2006.01) |
| ***D04B 15/58*** | (2006.01) |

(56) References Cited

U.S. PATENT DOCUMENTS 1,082,239 A * 12/1913 Rosenthal ..... D04B 9/06 66/57
1,094,482 A * 4/1914 Scott ..... D04B 9/06 66/27
1,200,451 A * 10/1916 Ballard ..... D04B 9/06 66/38
1,387,783 A * 8/1921 Oscar ..... D04B 9/06 66/19
3,832,867 A * 9/1974 Luchi ..... D04B 9/32 66/13
6,205,821 B1 * 3/2001 Sangiacomo ..... D04B 9/38 66/38

OTHER PUBLICATIONS

Dean and Bean's Sock Machines. "The Parts of the Machine" and "Setting Up the Ribber". URL: <https://web.archive.org/web/20211017180216/https://www.deanandbean.com/the-parts-of-the-machine> and <https://web.archive.org/web/20211017194740/ https://www.deanandbean.com/setting-up-the-ribber> (Year: 2021).*
Screen captures from YouTube video clip entitled "2.0 Model Sock Machine and Ribber Introduction", uploaded by user "Dean and Bean's Sock Machines" on Oct. 1, 2021. Retrieved from Internet: <https://www.youtube.com/watch?v=miURRTw0ibg> (Year: 2021).*
Screen captures from YouTube video clip entitled "2.0 Upgrade Installation", uploaded by user "Dean and Bean's Sock Machines" on Oct. 8, 2021. Retrieved from Internet: <https://www.youtube.com/watch?v=shJ-6fEGwk0> (Year: 2021).*

* cited by examiner

Prior Art

Prior Art

CIRCULAR SOCK MACHINE AND A METHOD FOR ITS USE

CROSS REFERENCE TO RELATED APPLICATIONS

This application claims the benefit of U.S. provisional application No. 63/397,370 filed Aug. 11, 2022, which is incorporated by reference herein in its entirety.

FIELD OF THE INVENTION

The present device is a Circular Sock Machine (CSM) comprising: (1) a camshell, comprising a cam system further comprising five moveable cams, a cylinder, and a means to rotate the cylinder; (2) a removable ribber assembly comprising a ribber frame, a tappet plate, an in/out cam, a ribber cam, a removable ribber stop, a ribber fin, and a ribber dial; and (3) an adjustable yarn carrier.

BACKGROUND

Knitting machines for home use first became available in the 19th century. One type of knitting machine is a Circular Sock Machine (CSM), comprising needles arranged around the outside of a cylinder, which can be used to knit yarn into tubular or cylindrical sections of knitted fabric which can be used to make items such as hats and socks.

Some antique CSMs have survived, but these are typically very expensive to purchase, are limited in supply, and the users of such machines often must restore and repair them in order to make them functional. In many cases, parts of these machines are broken or missing, requiring extensive research to identify what part is needed as well as a source capable of machining a suitable replacement part.

There are a few companies that still manufacture high quality new CSMs, most of which are manufactured from metal. However, such machines are typically very expensive and often in limited supply, with some customers having to wait several years before receiving a new CSM. Lastly, owners of such machines routinely have difficulty acquiring replacement parts and those that can be found are often expensive and can take a long time to receive.

While knitting as a craft has fallen in and out of fashion over the 20th century, the world's knitting community has grown significantly in the 21st century. The popularity of knitting is now widespread, and knitting is broadly recognized as a creative outlet with therapeutic benefits. There has been similar growth in the number of people who are interested in knitting on CSMs. Unfortunately, the cost and availability of metal machines make it prohibitive for most people to take up this craft.

One possible solution to these challenges would be to leverage the latest technological improvements in three-dimensional (3D) printing. A 3D-printed CSM, comprised of a light-weight polymer, could be manufactured more affordably and simply than a metal machine. Further, as all CSMs occasionally require replacement parts due to normal wear and tear, replacement parts could more easily be made using 3-D printing, Computer Numerical Control (CNC) Routing, or similar modern manufacturing techniques. Use of such techniques would also be cheaper and easier that those traditionally used to manufacture metal parts.

However, additive manufacturing and other modern manufacturing techniques often involve limitations due to the physical properties of such polymers, including hardness and tensile strength, making simple replication of existing metal machines unworkable. The problems that arise when converting applications from metal to polymers are those of design, strength, tolerance, and friction. In many cases, with metal components, the natural strength of the materials alone is all that is needed to ensure a structurally strong machine. However, a part manufactured from softer polymers often requires special engineering to achieve its strength. Further, tolerances are often not as precise with parts made from polymers, and therefore, design allowances must be made allowing for greater movement between the parts. Finally, metal needles, which are often still required in CSMs manufactured mostly from polymers, rub against plastic parts creating friction and heat that can alter the structural integrity of the polymers. These design considerations make it impractical to simply reproduce the designs of metal machines in 3D-printed plastic.

What is needed is a Circular Sock Machine that can be manufactured more quickly, less expensively, and more easily from polymers or similar materials, using 3D-printing, CNC Routing, or other modern manufacturing techniques, which can overcome problems arising from the use of such polymers, including those involving their strength, tolerance, and friction, to create a less expensive and more lightweight CSM.

SUMMARY OF THE INVENTION

It is an aspect of the present device to provide a CSM that can be quickly and easily manufactured from 3D-printed plastic, is affordable to purchase and maintain, remains compatible with widely available needles and any common table, and is lightweight for easy transportation.

The above aspect can be obtained by a CSM comprising a cylinder having an inner surface and an outer surface, wherein the outer surface comprises a plurality of longitudinal grooves arranged around a central axis of the cylinder, and wherein the cylinder is configured to be rotated on a vertical axis in either a clockwise direction or counterclockwise direction; a plurality of needles, wherein each needle is located within a respective longitudinal groove and each needle comprises a top end, comprising a curved hook and a latch, and a bottom end, comprising a butt which at least partially extends beyond the longitudinal groove and the outer surface of the cylinder wherein a shaft connects the top end to the bottom end and the butt comprises a surface at the second end of the needle which is in a plane perpendicular to the plane of the shaft; a camshell, comprising an outer surface and an inner surface, and having an inner opening configured to contain the cylinder, a flat bottom shelf upon which the cylinder rests, and a needle track, located above the flat bottom shelf, wherein the needle track is configured such that the butts of each needle rest on and slide over the needle track, the needle track also comprising a left needle track ramp and a right needle track ramp; and a cam system comprising a left flipper pivotably connected to the inner surface of the camshell and located above the left needle track ramp, a left bee cam located below the left flipper and above the left needle track ramp, a right flipper pivotably connected to the inner surface of the camshell and located above the right needle track ramp, a right bee cam located below the right flipper and above the right needle track ramp, and a middle flipper pivotably connected to the inner surface of the camshell and located between the left flipper and the right flipper and also between the left bee cam and the right bee cam.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION OF THE DRAWINGS

Figure 1:
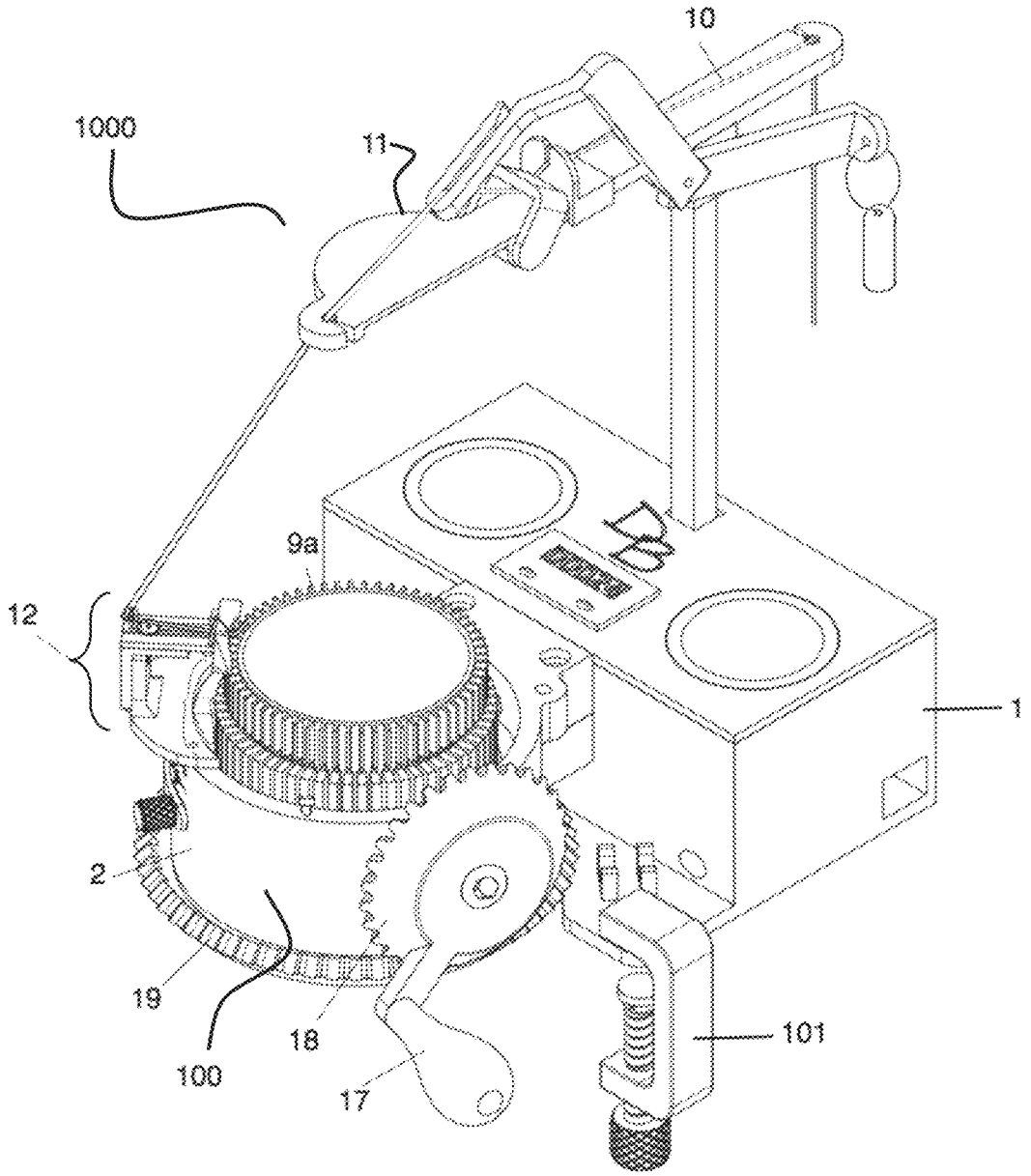
FIG. 1 is a top, front and side perspective view of the assembled CSM, comprising a CSM assembly, a yarn carrier and an accessory box, according to an embodiment.

This description of the exemplary embodiments is intended to be read in connection with the accompanying drawings, which are to be considered part of the entire written description. In the description, relative terms such as "lower," "upper," "horizontal," "vertical," "above," "below," "up," "down," "left," "right," "top," and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present device is a Circular Sock Machine ("CSM") specifically engineered to be manufactured using polymers or other materials with similar properties that can be 3-D printed or created with a CNC router or other similar manufacturing techniques. The present device can comprise two assemblies: (1) a CSM assembly comprising a camshell further comprising a cam system comprised of five moveable cams mounted to an inner surface of the camshell, a cylinder, and an adjustable yarn carrier, and (2) a ribber assembly comprised of a ribber frame, a tappet plate, an in/out cam, a ribber cam, a removable ribber stop and a ribber fin, and a ribber dial. In an embodiment, the present device can work with at least two different sizes of cylinders: a narrow-diameter cylinder can be used with long-butt CSM needles, and a wide-diameter cylinder can be used with short-butt CSM needles, each of which can have a variable number of needles. Note that these CSM needles will be referred to throughout as "CSM needles" when either short-butt CSM needles or long-butt CSM needles could be used in the embodiment being described. Similarly, both the narrow-diameter cylinder and the wide-diameter cylinder will be referred to as "cylinder" unless the embodiment being described relates specifically to either a narrow-diameter cylinder or a wide-diameter cylinder.

The present device can be described as a rotating cylinder CSM, meaning a central cylinder can house latch needles, such as the CSM needles described herein and a gear system, or similar means can be used to rotate the cylinder causing the CSM needle butts to be directed through a cam system connected to the inner surface of a camshell causing vertical movement of the CSM needles to create individual stitches and a knitted fabric. The present device can knit when the cylinder is rotated in either a clockwise direction or a counterclockwise direction.

When a ribber assembly is mounted on a CSM assembly, as described herein, a rotating cylinder of the CSM assembly can comprise a ribber stop mounted to an inner surface of the cylinder and a ribber fin can transfer the rotational movement of the cylinder to the ribber assembly. Specifically, the ribber fin can rotate a ribber dial, holding one or more ribber needles. The rotation of ribber dial can then cause ribber needle butts of each ribber needle to pass through a ribber track in a tappet plate to cause the ribber needles to move horizontally in a pattern to create a type of fabric called ribbing. The CSM assembly and the ribber assembly can be designed for use with various weights of sock yarn, including, but not limited to fingering weight, double knitting (DK), or lace weight yarn. An adjustable yarn carrier can position the working yarn where both the CSM needles and the ribber needles can grab working yarn at the correct time and position when the cylinder and ribber dial are both being rotated. While the concept of a rotating cylinder CSM comprising a ribber is not unique, the particular shapes of the components described below are a novel design, which was necessary for the machine to deliver the desired functionality when manufactured using a polymer or similar material, such as filament for 3-D printing, or any other material sharing the physical traits of such polymers.

According to an embodiment, the cam system can comprise five cams, including: a middle flipper cam, a left-side flipper cam, a right-side flipper cam, a left bee cam, and a right bee cam. In some embodiments, the shape of each cam can be unique from the other four, as can be their configuration and movement in relation to the inner surface of a camshell and to each other. The left and right bee cams can be adjustable up and down with knobs located on the outside of the camshell allowing the length of the knitted stitches to be controlled. In some embodiments, the side flipper cams can be held down with torsion springs, or similar means, to divert needle butts from going under one or the other flipper cam when entering the area of the cam system when the cylinder is rotated in one direction but allowing the butts of each CSM needle to pass under the opposite flipper cam when leaving the cam area. According to an embodiment, the middle flipper cam can direct needle butts under either the left bee cam or the right bee cam and can be rotated by the movement of the CSM needle butts into a proper position, regardless of which direction the cylinder is rotated.

In an embodiment, the yarn carrier can hold working yarn, yarn which is ready to be knitted into stitches and fabric, in a position wherein CSM needles (and ribber needles if the ribber assembly is in use) can grab working yarn in a position and at a time wherein missed stitches can be minimized. According to an embodiment, the yarn carrier can comprise a top section, a vertical adjuster middle section, and a base section and can be horizontally adjustable to work with both large diameter cylinders, as well as small diameter cylinders according to an embodiment. Additionally, the yarn carrier can be adjustable vertically to work with or without the ribber assembly. The unique shape of the yarn carrier's top section located at the front of the yarn carrier, nearest the cylinder, can allow the yarn to be held very close to the CSM needles and ribber needles, according to an embodiment. In a particular embodiment, a small vertical slit in the yarn carrier opening, which can also comprise a horizontal pin near its back, can securely hold the yarn directly above the middle flipper, and a sloping front of the top section can allow the edge of the yarn carrier to be very close to the CSM needles and ribber needles without allowing the hook sections of these needles hooks to contact or become connected to the yarn carrier, which could possibly prevent the cylinder from being able to turn. In certain embodiments, the curved edges and flat base of the yarn carrier's top section can prevent a needle latch from closing as the needle is pushed up and the latch springs free from the stitch. Finally, the thin design can allow the working yarn to be held very close to the cylinder allowing the needles to catch the yarn while also creating room for the ribber needles to pass below the yarn carrier and pick up yarn at the correct time.

According to an embodiment, the ribber assembly can allow the user to create ribbing, which is fabric made through alternating columns of stitches knit with both CSM needles and ribber needles. In an embodiment, the ribber assembly can work with both narrow-diameter cylinders used with long-butt needles and wide-diameter cylinders used with short-butt needles. Together, the shapes of a tappet plate, an in/out cam, and an adjustable ribber cam can create ribber track through which the butts of ribber needles can travel, causing the needles to move in and out in a horizontal plane to create ribbed fabric. In an embodiment, a ribber stop can be connected to the inside of the cylinder when knitting with the ribber assembly and can be removed from the cylinder when knitting without the ribber assembly. According to an embodiment, a ribber fin can be removable from the bottom of a ribber dial and allow the user to adjust how the ribber needles align with the cylinder needles, through adjustment of the ribber fin. According to an embodiment, a ribber frame can be used to secure the ribber assembly to the camshell and CSM assembly, securing and positioning of the tappet plate relative to the yarn carrier and CSM while allowing the ribber dial to spin freely.

Reference will now be made in detail to certain embodiments of the present device, examples of which are illustrated in the accompanying figures. The detailed descriptions below are grouped into the two distinct sections of the present CSM, specifically: Part 1 will focus on the CSM assembly comprising a camshell further comprising a cam system, a cylinder and a yarn carrier, and Part 2 will focus on the ribber assembly. Note that the CSM assembly can be used without the ribber assembly, but the ribber assembly cannot be used without the CSM assembly.

FIG. 1 is a top, front and side perspective view of a CSM 1000 comprising a CSM assembly 100, an accessory box 1, a camshell 2 comprising a cam system (not shown in FIG. 1), and a cylinder 9*a*, according to an embodiment. In an embodiment, the CSM 1000 can be secured to a table, countertop, or similar surface (not shown in FIG. 1) by clamping, or similar securing means, with one or more clamps 101 or similar retaining means. In an embodiment, working yarn 10 can be loaded through a yarn mast 11 and a yarn carrier 12 to deliver working yarn 10 to the cylinder 9*a* as shown in FIG. 1. According to an embodiment, a handle 17 can be used to turn a side gear 18, which can then turn a floor gear 19, which turns the cylinder 9*a* as the cylinder 9*a* can be connected to the floor gear 19 such that the cylinder 9*a* can be rotated when the floor gear 19 is rotated. In an embodiment, the cylinder 9*a* can secure either short-butt or long-butt CSM needles (not shown in FIG. 1) to its outer surface 9*s* while also allowing each CSM needle to move up or down along the outer surface 9*s* of the cylinder 9*a*. According to an embodiment, as the cylinder 9*a* is rotated, the butts of each CSM needle (not shown in FIG. 1) can be directed through a cam system (not shown in FIG. 1) mounted on an inner surface of the camshell 2 causing each CSM needle to move up and down in a predetermined pattern allowing each CSM needle (not shown in FIG. 1) to grab working yarn 10 held and fed by the yarn carrier 12. As described in detail below, it is this movement of the CSM needles (not shown in FIG. 1) as they are forced through the cam system (not shown in FIG. 1) that allows the present device to create knit stitches (not shown in FIG. 1.)

Figure 2:
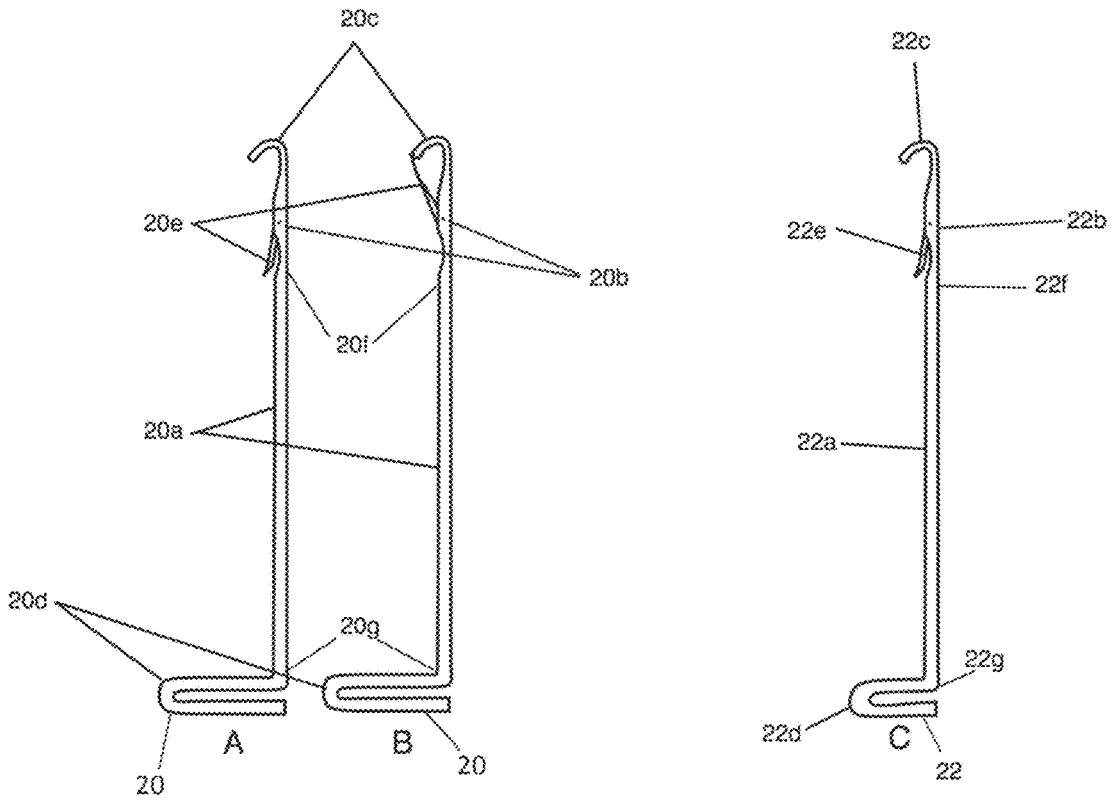
FIG. 2 is a side perspective of two prior art long-butt CSM needles and one prior-art short-butt CSM needle that can each be compatible with the current CSM, in some embodiments.

FIG. 2 is a side perspective view of two prior art long-butt CSM needles 20, one, in view "A" having its latch 20*e* open and in view "B" having its latch 20*e* closed, and one prior art short-butt CSM needle 22 in view "C" having its latch 22*e* closed; all of which can be compatible with the present CSM in some embodiments. Both types of CSM needles comprise a shaft, 20*a* and 22*a*, section having a first end, 20*f* and 22*f*, and a second end, 20*g* and 22*g*, respectively wherein a curved hook section, 20*c* and 22*c*, connects to the shaft, 20*a* and 22*a*, at the first end, 20*f* and 22*f*, and a butt section, 20*d* and 22*d*, connects to the shaft, 20*a* and 22*a*, at the second end, 20*g* and 22*g*. The shaft, 20*a* and 22*a*, and the butt section, 20*d* and 22*d*, typically connect at a ninety-degree angle, and the butt section, 20*d* and 22*d*, and the curved hook section, 20*c* and 22*c*, both extend outwardly from the shaft, 20*a* and 22*a*, in the same direction. Such CSM needles, 20 and 23, typically comprise a movable latch 22*e* hingedly attached at or near the second end, 20*f* and 22*f*, of the shaft, 20*a* and 22*a*, at a hinged connection, 20*b* and 22*b*. When the latch, 20*e* or 22*e*, is down and resting against the shaft, 20*a* or 22*a*, as shown in the views of long-butt CSM needle 20 and short-butt CSM needle 22, the latch, 20*e* or 22*e*, is considered open. When the latch 20*e* is rotated into contact with the needle hook 20*c*, as shown in view "A" of long-butt CSM needle 20, it is in a closed position.

Figure 3:
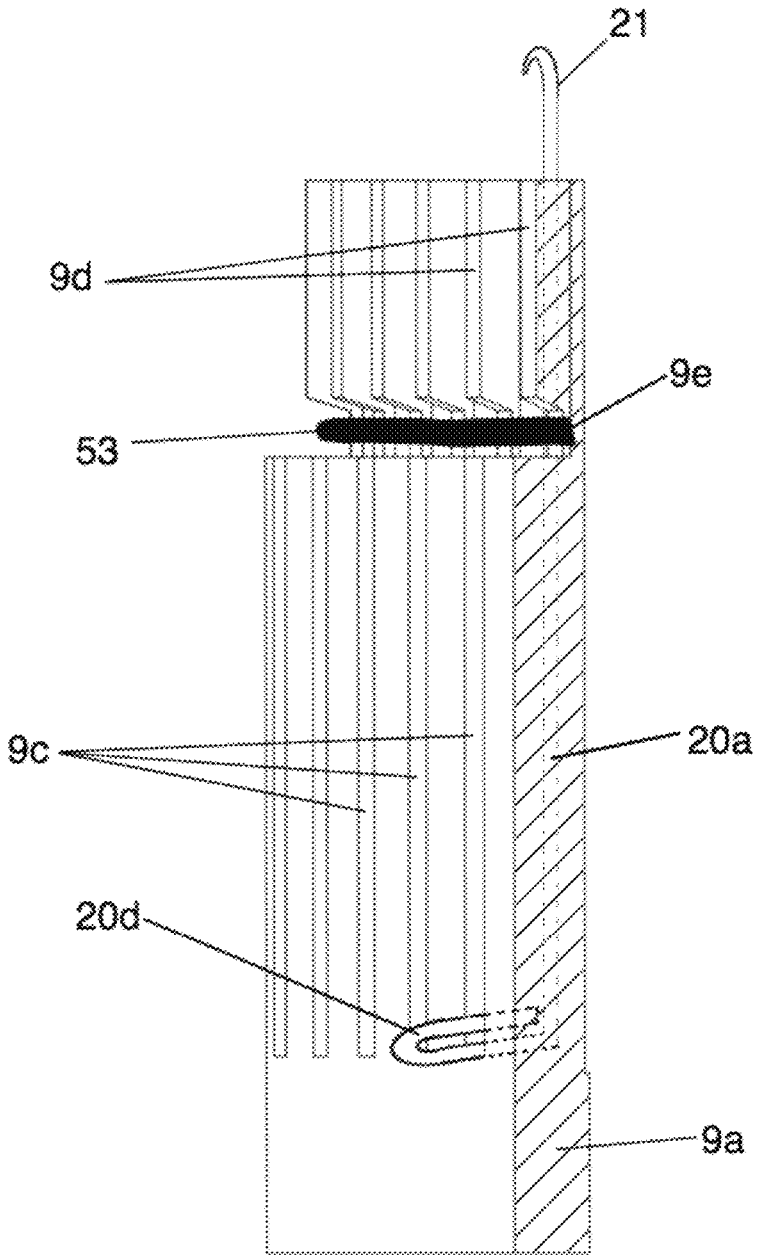
FIG. 3 is a partially transparent front and side view of a partial section of a cylinder comprising a CSM, showing how a long-butt CSM needle can be housed in needle slots between two fins, according to an embodiment.

FIG. 3 is a partial front and side view of a partial cross-section of the narrow-diameter cylinder 9*a* showing a long-butt CSM needle 20 in a partially transparent view, movably connected to a needle slot 9*c* between two fins 9*d*, according to an embodiment. In this embodiment, the needle shaft 20*a* can be held against an exterior surface 9*e* of the cylinder 9*a* with a cylinder spring 53 which can extend around the circumference of exterior surface 9*e* of the cylinder 9*a*. Note that this view is of a narrow-diameter cylinder 9*a* for use with long-butt needles 21, according to an embodiment, wherein the butt section 20*d* of each long-butt needle 21 can extend past the cylinder fins 9*d* as shown in FIG. 3.

Figure 4:
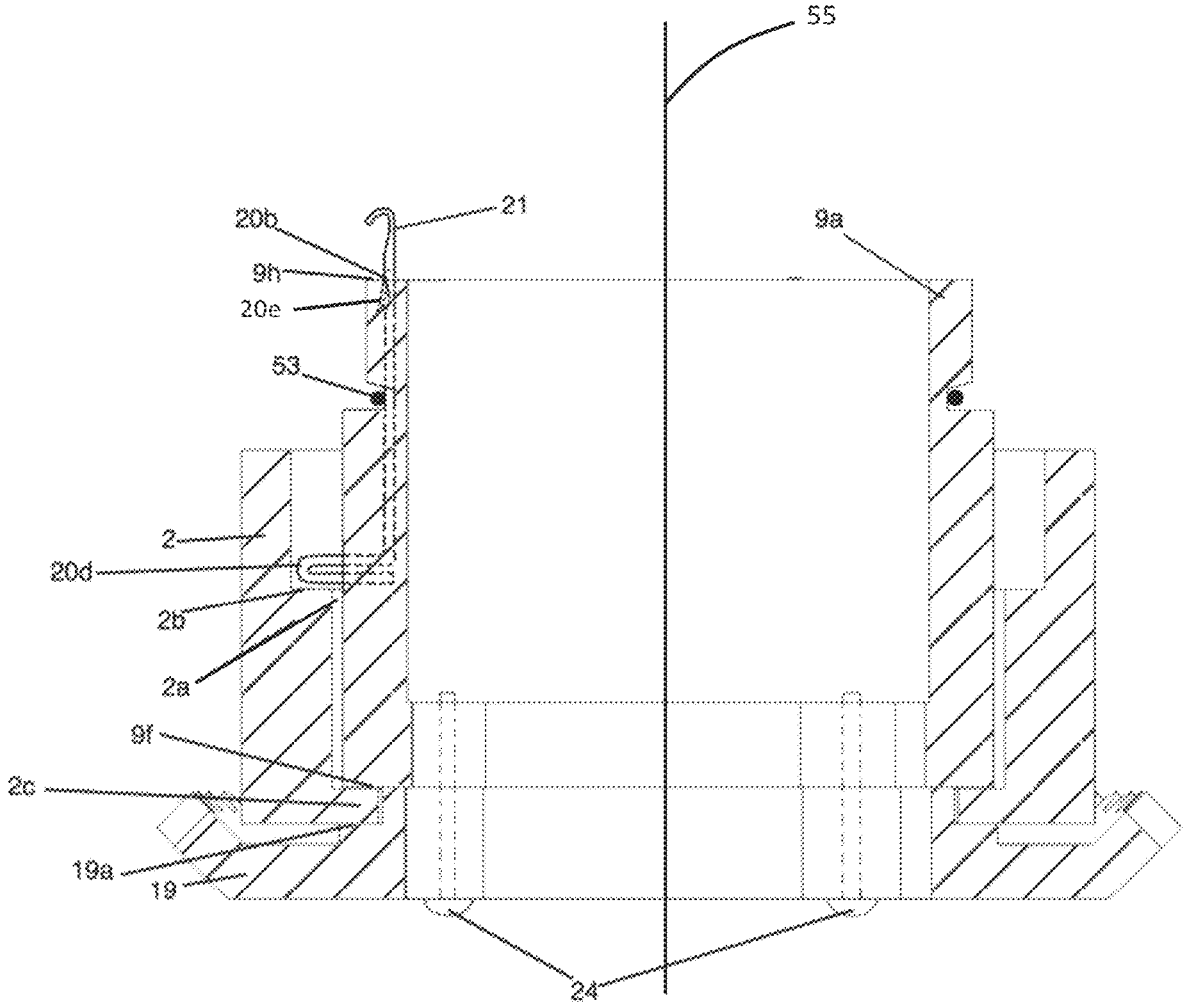
FIG. 4 is a front view of a cross-section of a cylinder, a camshell, and a floor gear comprising a CSM apparatus including a partially transparent view of a long-butt needle in the cylinder, according to an embodiment.

FIG. 4 is a front perspective view of a cross-section of a narrow-diameter cylinder 9*a*, a camshell 2, a floor gear 19, and a partially transparent view of a long-butt CSM needle 20, according to an embodiment. This view shows how the butt section 20*d* of each long-butt needle 21 mounted in the cylinder 9*a* can ride on a needle track 2*b* comprising the inner camshell wall 2*a* while being held against the cylinder 9*a* by the cylinder spring 53, in some embodiments. In the embodiment shown in FIG. 4 the floor gear 19 can be bolted to the cylinder 9*a*, removably connecting the top 19*a* of the floor gear 19 to the bottom 9*f* of the cylinder 9*a*, such that the bottom 9*f* of the cylinder 9*a* can rest on a flat bottom shelf 2*c*, comprising the inner wall of the camshell 2 and the butt section 20*d* of each CSM needle can rest on the needle track 2*b*. According to an embodiment, the floor gear 19 and cylinder 9*a* can rotate, either clockwise or counterclockwise around a central vertical axis 55 while the camshell 2 remains stationary, causing the butt section 20*d* of each CSM needle 20 to travel over the track 2*b* and the cylinder to travel over the flat bottom shelf 2*c*. In the embodiment shown in this figure, three connecting bolts 24 (two are shown in FIG. 4 in a partially transparent view), spaced equidistant from each other as represented by an equilateral triangle.

The view shown in FIG. 4 is a front, cross-sectional view which also shows the position of the CSM needle 20 relative to the rim of the cylinder 9*h* when the needle butt 20*d* is on the resting needle track 2*b* according to an embodiment. When the needle butt 20*d* is traveling over the resting needle track 2*b*, the hinged connection 20*b* of the needle latch 20*e* can be in an open position at the same height as the rim 9*h* of the cylinder 9*a* so the stitch (not shown in FIG. 4) can rest around the open needle latch 20*e* at the hinged connection 20*b*. It is important for the stitch to hold the latch open so the latch cannot inadvertently flip shut, which would cause dropped stitches.

Figure 5:
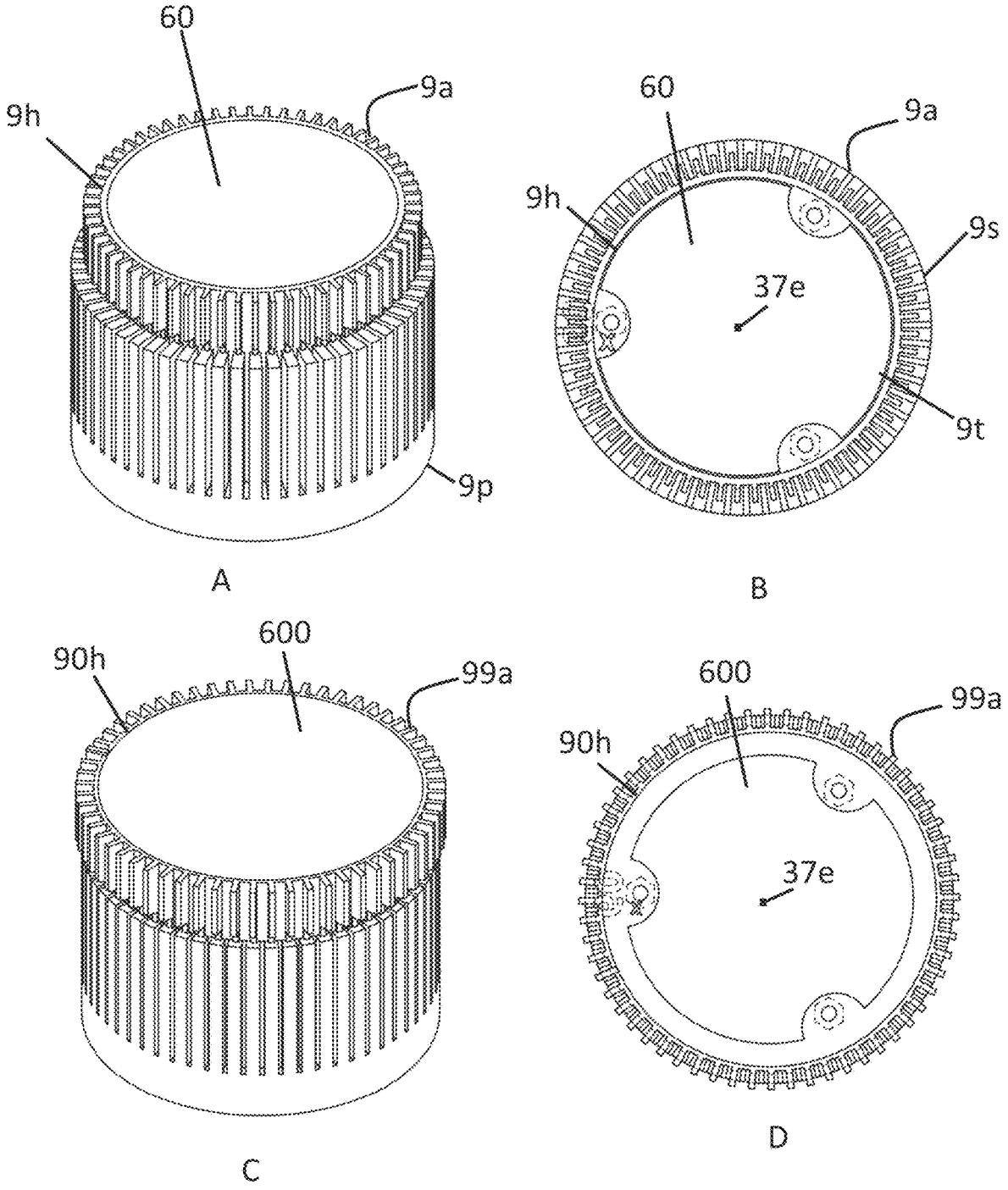
FIG. 5 contains four views, view "A" is a top and side perspective view of a narrow-diameter cylinder, view "B" is a top view of a narrow-diameter cylinder, view "C" is a top and side perspective view of a wide-diameter cylinder, and view "d is a top view of a wide-diameter cylinder, each according to an embodiment.

FIG. 5 contains four views, view "A" is a top and side perspective view of a narrow-diameter cylinder 9*a*, view "B" is a top view of a narrow-diameter cylinder 9*a*, view "C" is a top and side perspective view of a wide-diameter cylinder 99*a*, and view "D" is a top view of a wide-diameter cylinder 99*a*, each according to an embodiment. These views show nearly all of both the narrow-diameter cylinder 9*a* and the wide-diameter cylinder 99*a*. For the narrow-diameter cylinder 9*a*, view "A" shows the cylinder rim 9*h* of the narrow-diameter cylinder 9*a* and the cylindrical inner opening 60. view "B" of the top of the narrow-diameter cylinder 9*a* also shows the cylinder rim 9*h* and the cylindrical inner opening 60, as well as the center point 37*e* of the narrow-diameter cylinder 9*a*, which also the center point 37*e* of the wide-diameter cylinder 99*a*. In an embodiment the central vertical axis 55 (not shown in FIG. 5) passes through the center point 37*e* of each cylinder, 9*a* and 99*a*. Similar to the narrow-diameter cylinder 9*a*, the wide-diameter cylinder 99*a*, shown in views "c" and "d" comprises a cylinder rim 90*h*, and a cylindrical inner opening 600, according to an embodiment.

Figure 6:
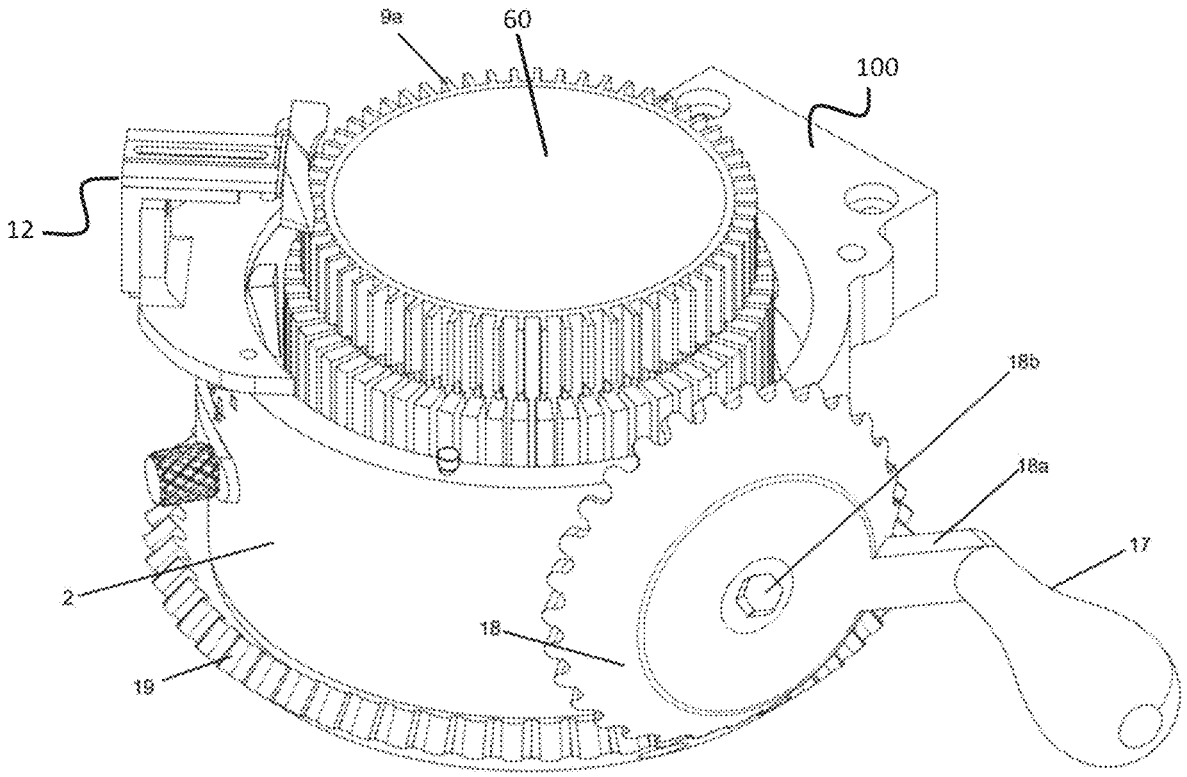
FIG. 6 is a top, front and side perspective view of a CSM apparatus comprising a camshell, a cylinder, a floor gear, a side gear, and a handle, according to an embodiment.

FIG. 6 is a top, front and side perspective view of a CSM assembly 100 comprising a camshell 2, a cylinder 9*a*, a floor gear 19, a side gear 18, and a handle 17, according to an embodiment. In embodiments such as those shown in FIG. 6, the camshell 2 can be a connection point for many pieces comprising the CSM assembly 100. Specifically, the side gear 18 can be bolted to the side of the camshell 2 and the handle 17 can be connected to a flat arm 18*a* extending outward from a center connection bolt 18*b* to a side gear 18 to provide mechanical advantage while turning the side gear 18 in order to rotate the floor gear 19, according to an embodiment. This view also shows the cylindrical inner opening 60 of the cylinder 9*a*, which can be where knitted fabric (not shown in FIG. 6) can travel after it is created by the CSM assembly 100.

With the floor gear 19 located under the camshell 2 and the side gear 18 positioned at the side, the floor gear 19 and side gear 18 fit together at perpendicular angles. As the user turns the handle 17, the handle 17 can rotate the side gear 18, which in turn rotates the floor gear 19. As the floor gear 19 and cylinder 9*a* are connected, as the floor gear 19 rotates, so does the cylinder 9*a*, thereby forcing the needles (not shown in FIG. 6) along the camshell track (not shown in FIG. 6). The CSM will successfully knit when the handle 17 is rotated in either direction: clockwise or counterclockwise. As the cylinder 9*a* is turned, it forces the needles (not shown in FIG. 6) through the cam system (not shown in FIG. 6,) as illustrated in FIGS. 7*a* through 7*f*.

Figure 7:
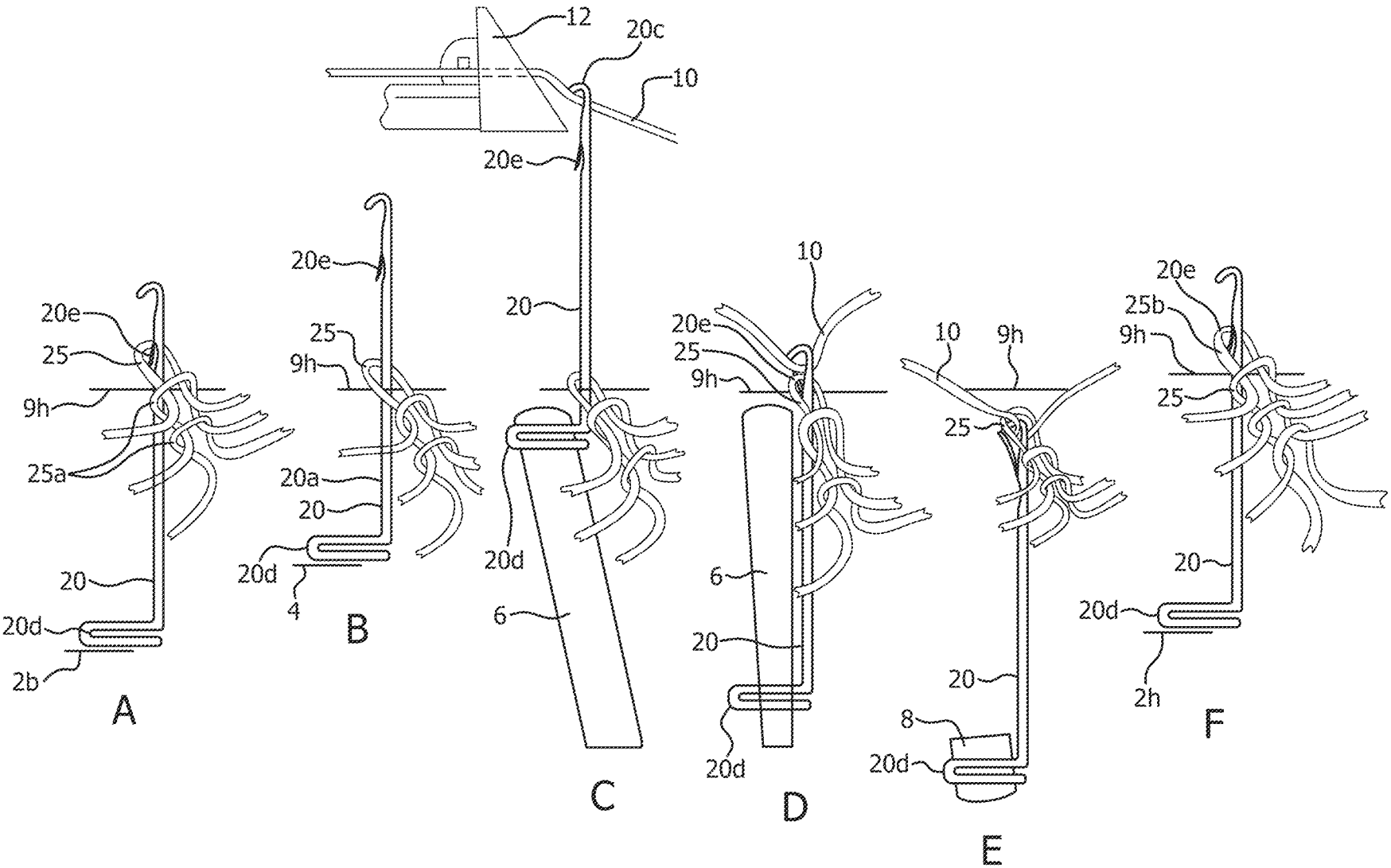
FIG. 7 comprises six views, A through F, which show a side view of a long-butt needle comprising a CSM creating a stitch in six steps, according to an embodiment.

FIG. 7 comprises six views, A through F, which show a side view of six separate steps wherein a CSM needle comprising a CSM assembly 100 (not shown in FIGS. 7*a* thru 7*f*) can be used to create a first stitch, according to an embodiment. view "A" is a side view of a CSM needle 20 and a first stitch 25 held around the CSM needle's 20's latch 20*e* in an open position. The butt section 20*d* of the CSM needle 20 can rest on the camshell resting track 2*b*, the position of which is shown by a line 2*b* in view "A" and will be described more fully in FIG. 10 below. According to an embodiment, the CSM needle 20 can be held in a needle slot 9*c* (not shown in view "A") located on the outer surface 9*s* of the cylinder 9*a* (not shown in View "a.") The first stitch 25 held around the CSM needle 20 can rest on the rim 9*h* of the cylinder 9*a* the position of which is shown by a line 9*h* in FIG. 7*a*, and the stitches 25*a* formed during previous rows of knitting can be folded over the rim 9*h* of the cylinder 9*a* and into the cylindrical inner opening 60 of the cylinder 9*a* (not shown in view "A").

view "B" is a side view of a CSM needle 20 as the needle butt 20*d* travels upward relative to the rim 9*h* (the height of which is marked by a line in view "B") of the cylinder 9*a*, forcing the needle latch 20*e* to rise above the first stitch 25 that is around the CSM needle 20 and the first stitch 25 to travel down the shaft 20*a* toward the butt section 20*d*. To reach its apex, the needle butt 20*d* can be forced by a flipper cam 4 (the height of which is marked by a line in view "B"), to travel upward not shown in FIG. 7*b* but will be described more fully in FIG. 10 below.

View "C" is a side view of a CSM needle 20 just after it has passed the midpoint of the yarn carrier 12 and working yarn 10 has been grabbed by the top hook 20*c* of the CSM needle 20, which can then be moved down relative to the rim 9*h* by a middle flipper cam 6, which is partially shown in view "C" and will be described more fully in FIG. 10 below, according to an embodiment.

View "D" is a side view of a CSM needle 20 as it continues to be moved downward relative to the rim 9*h* by the middle flipper cam 6, and through the first stitch 25 causing the needle latch 20*e* to close around the working yarn 10, according to an embodiment. In this view, the needle latch 20*e* has dropped just below the rim 9*h* of the cylinder 9*a* and the needle butt 20*d* is almost to the lowest point in its travel down the middle flipper cam 6, which is partially shown in FIG. 7*d*, and will be described more fully in FIG. 10 below.

View "E" is a side view of a CSM needle 20 as it reaches its lowest point wherein the CSM needle 20 has pulled the working yarn 10 completely through the first stitch 25 that was previously around the long-butt needle 20, according to an embodiment. In this view, the butt section 20*d* is at the lowest point of its travel as it passes below a bee cam 8, which is partially shown in FIG. 7*e*. In this step, the top of the CSM needle 20 can travel below the cylinder rim 9*h* (the height of which is shown by a line in view "E") and through the first stitch 25. Note that the distance downward that each CSM needle 20 travels determines how much working yarn 10 is pulled down and therefore how long the new stitch 25*b* can be.

View "F" is a side view of a CSM needle 20, which has returned to the position shown in view "A", wherein the hook section 20*c* has been pushed up above the cylinder rim 9*h* and the new stitch 25*b* has fallen down around the open needle latch 20*e*, according to an embodiment. In this view, the first stitch 25 has fallen to the back of the CSM needle 20 and over the cylinder rim 9*h* into the cylindrical inner opening 60 of the cylinder 9*a* and the butt section 20*d* has traveled up a right-side ramp 2*h* (not shown in FIG. 2*f*) to the resting track 2*b*.

Figure 8:
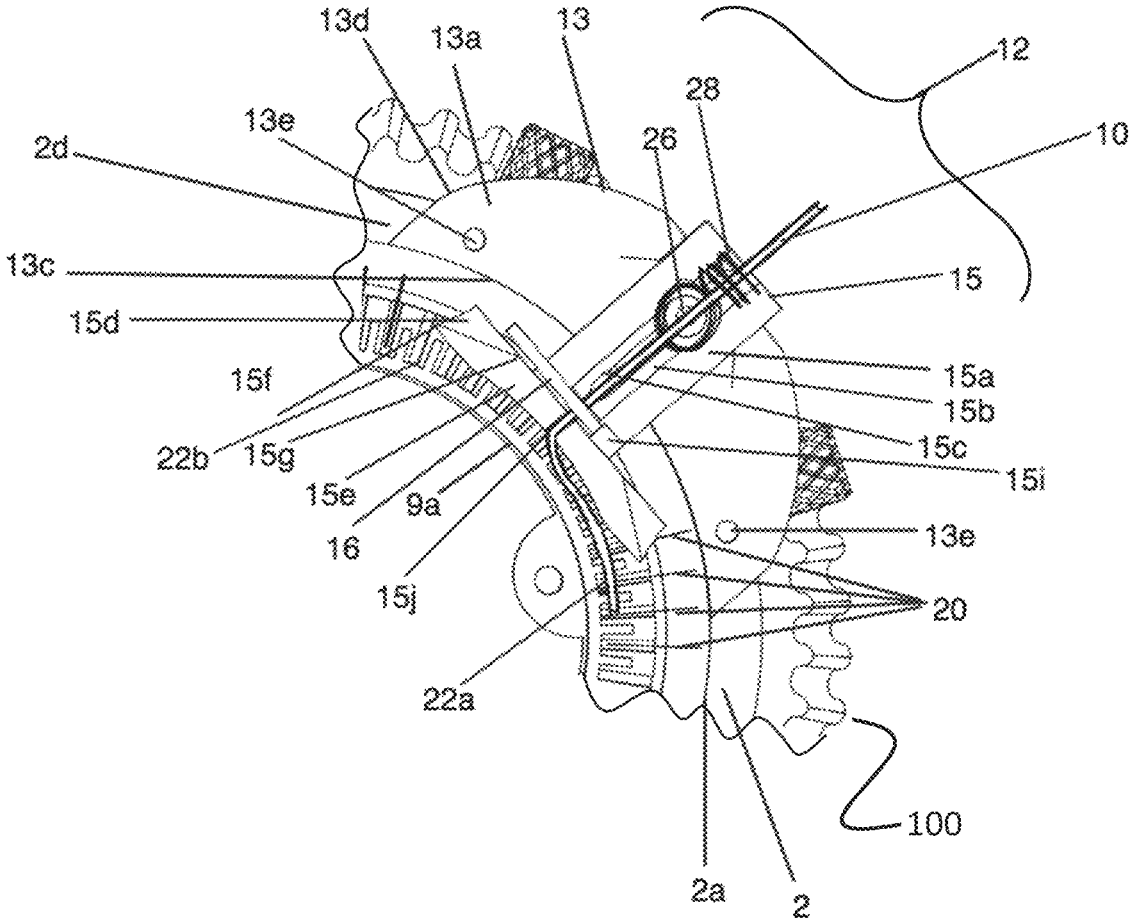
FIG. 8 is a top view of a partial section of a CSM apparatus comprising a camshell section, a cylinder section as well as a section of a yarn carrier, each part comprising a CSM apparatus, according to an embodiment.

FIG. 8 is a top perspective view of a partial section of a CSM apparatus 100 comprising a camshell 2*a* cylinder 9*a*, and a yarn carrier, 12, wherein the yarn carrier 12 is shown feeding working yarn 10 to CSM needles 20 in the cylinder 9*a*, according to an embodiment. In an embodiment, the yarn carrier 12 can be an apparatus comprised of three pieces: a yarn carrier base 13, a yarn carrier vertical adjuster 14 (not visible in FIG. 8), and a yarn carrier top 15. According to an embodiment, the yarn carrier base 13 can comprise a flat plate 13*a* which can be a thin semicircle matching the curve of the camshell inner wall 2 and the bottom of the yarn carrier base (not shown in FIG. 8) can be located slightly above the camshell rim 2*d*, and the front edge 13*c* of the yarn carrier base 13 can be positioned flush with the interior wall 2*a* of the camshell 2. In an embodiment, the flat plate 13*a* can be removably connected to the camshell 2.

According to an embodiment the yarn carrier top 15 can comprise a rectangular block 15*a* and a curved front 15*d* section located just above the CSM needles 20. In an embodiment, the yarn carrier top 15 can be adjustable so it can be moved closer to or more distant from the central axis 55 (not shown in FIG. 8) of the cylinder 9*a* in a horizontal plane above the cylinder 9*a*, allowing a user to place it in a chosen optimal position above and near the CSM needles 20 being fed working yarn 10. In an embodiment, this adjustment can be made by use of a screw 26, housed in a sunken recess 15*b* surrounding a slot 15*c* through which the yarn carrier top 15 can pass around the screw 26 when the screw 26 is loosened. This adjustment feature allows the CSM apparatus 100 to be used with both the long-butt needles 20 and a narrow-diameter cylinder 9*a* and short-butt needles 22 and a larger-diameter cylinder 99*a* (not shown in FIG. 8.)

In an embodiment, the top section of the yarn carrier top 15 nearest the CSM needles 20 is the curved front 15*d* of the yarn carrier top 15 can comprise two features, each of which can improve performance of the CSM assembly 100. First, the front 15*e* of the yarn carrier top 15 can comprise an angle from the front bottom 15*f* of the yarn carrier top to the top back of the yarn carrier top 15*g*, so the top back edge 15*g* can be centered and approximately two-thirds the width of the front 15*e* of the yarn carrier top 15, according to an embodiment. This can be a sufficient distance from the CSM needles 20 so that no needle hook (not visible in FIG. 8) can get caught on the front of the yarn carrier top 15 when each CSM needle 20 is moved vertically up and down in front of the yarn carrier 12. Second, the yarn carrier front 15*d* can comprise a front curved section 15*e*, so the part of the yarn carrier 15 nearest the cylinder 9*a*, has an arc-shape corresponding to the shape of the outer circumference of the narrow-diameter cylinder 9*a*. In an embodiment, the two tips of the curved front section extend above the center of the bee cams (not shown in FIG. 8.) In an embodiment, an outer semicircle of a flat plate 13*d* can be used to mount the yarn carrier 12 to the interior wall 2*a* of the camshell 2 using two screw holes 13*e*.

According to an embodiment, a curved spring 28 can be attached through the screw 26 in the top section 15 of the yarn carrier 12, so the spring 28 extends above the flat rectangle 15*a* at the yarn carrier's top 15 opposite the front curved section 15*d* so that the working yarn 10 can be directed from the yarn mast (not shown in FIG. 8), through the back of the curved spring 28, under a yarn carrier pin 16, which can be retained by a pin holder 15*i*, and out through a slit 15*j* in the front of the top section 16 of the yarn carrier 12, closest to the cylinder 9*a*. In an embodiment, when the cylinder 9*a* is rotated clockwise, as shown in this view, the working yarn 10 can be captured by a fifth needle 22*a* when counting clockwise from the needle nearest the slit 15*j*. Similarly, if the cylinder 9*a* is rotated counterclockwise (not shown in FIG. 8), the yarn 10 can be captured by a fifth needle 22*b* counterclockwise when counting counterclockwise from the needle nearest the slit 15*j*.

Figure 9:
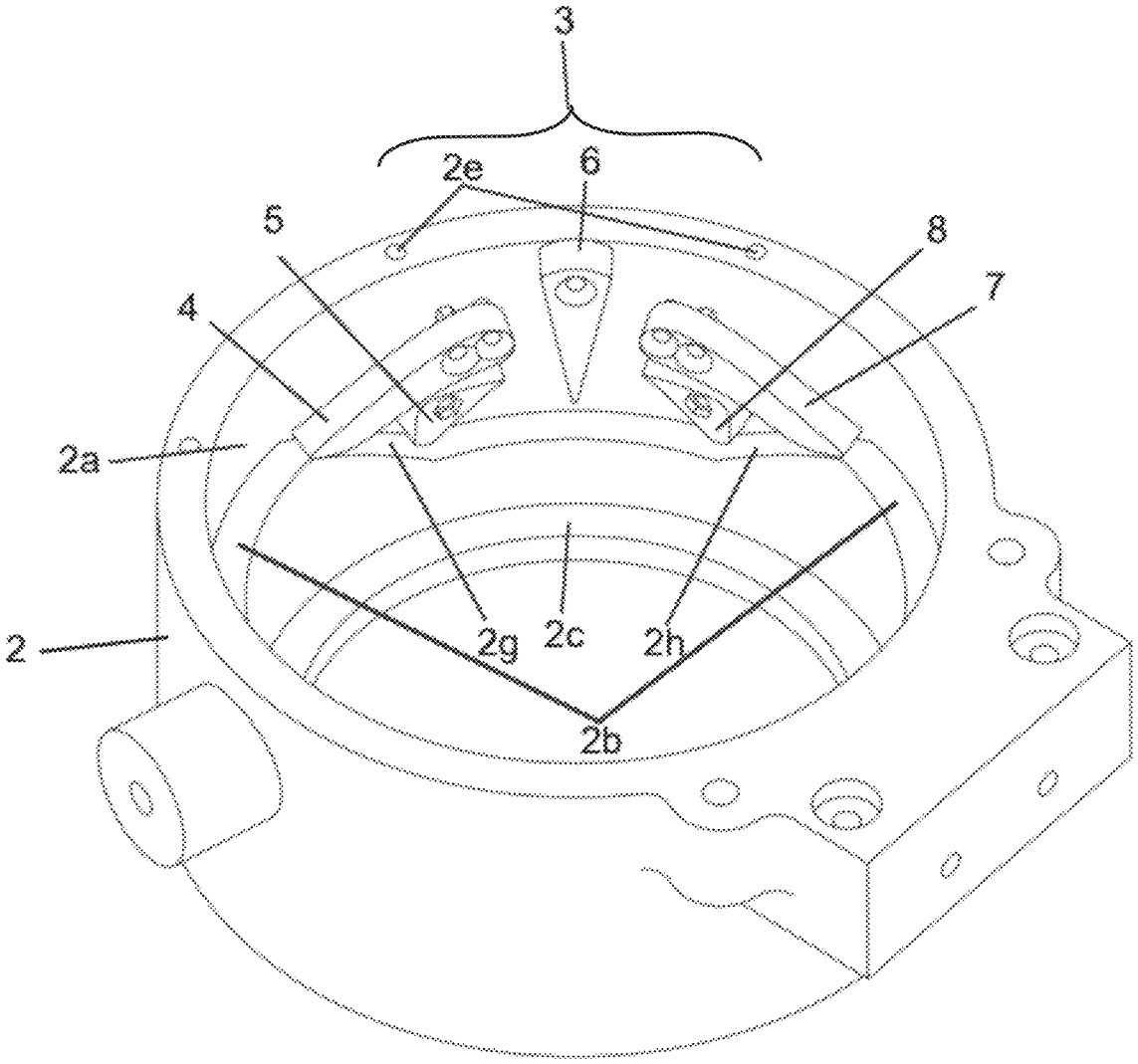
FIG. 9 is top and side perspective view of a camshell comprising a CSM apparatus, wherein an inner surface of the camshell comprises a cam system comprising five cams, a bottom shelf, and a needle track, according to an embodiment.

FIG. 9 is top, side, and rear perspective view of a cam system 3 connected to the inner surface, or inner wall 2*a* of a camshell 2, the cam system 3 comprising a middle flipper cam 6, a left bee cam 5, a right bee cam 8, a left-side flipper cam 4, and a right-side side flipper cam 7, according to an embodiment. This view shows the relative positions of each of the five cams (middle flipper cam 6, left 5 and right 8 bee cams, and left 4 and right 7 side flipper cams) in relation to each other as well as a left-side needle track ramp 2*g* and a right needle track ramp 2*h*.

In an embodiment, the camshell 2 can comprise a flat bottom shelf 2*c* that protrudes around the inner circumference of the camshell 2 toward central axis 55 of the CSM apparatus 100 and upon which the bottom 9*p* of the cylinder 9*a* (not shown in FIG. 9) can rest. In an embodiment, a short distance above the flat bottom shelf 2*c*, a needle track 2*b* can protrude from the inner wall 2*a* of the camshell 2 extending around the inner circumference of the camshell 2 and toward central axis 55 of the CSM assembly 100, but not as close to the central axis 55 of the CSM assembly 100 as the flat bottom shelf 2*c*. The depth of the needle track 2*b* can be a consistent width, being slightly wider than the length of the butt section (not shown in FIG. 9) of a long-butt needle 21 (not shown in FIG. 9). Further, the needle track 2*b* can extend toward the central vertical axis 55 sufficiently that short-butt needles 22 can be used with wide-diameter cylinders 99*a*, but not extend toward the central axis so far as to interfere with the rotation of the cylinder 9*a*, according to an embodiment. According to an embodiment, the needle track 2*b* can comprise a resting needle track section 2*b*, which can extend between 240 degrees and 300 degrees around the inner circumference of the camshell 2, a right needle track ramp 2*h* and a left needle track ramp 2*g*, wherein the ramps 2*h* and 2*g* can be connected by a connecting track section 2*j*. In an embodiment, the butt sections 20*d* of each CSM needle 20 (not shown in FIG. 9) can rest on the needle track 2*b* at a consistent height when in contact with the resting needle track section 2*b*, and the needles can be moved vertically, both above and below the height of the resting needle track section 2*b*, when the butt sections 20*d* of each CSM needle 20 (not shown in FIG. 9) is moved through the cam system 3. The resting needle track section can be located approximately two-thirds up the inner surface 2*a* of the camshell 2, according to an embodiment.

According to an embodiment, the five cams comprising the cam system 3, can each be rotatably connected to the inner surface 2*a* of the camshell 2 above the right needle track ramp 2*h* and a left needle track ramp 2*g* and the connecting track section 2*j* connecting the ramps 2*h* and 2*g*. The relative positions and functions of each of the five cams, as well as in relation to the needle track ramps, 2*g* and 2*h* in this embodiment, are described in more detail in FIG. 10 below.

In this view, the two vertical holes 2*e* are visible in the camshell wall 2*a* where bolts (not shown in FIG. 9) connect the yarn carrier (not shown in FIG. 9) to the camshell 2. When mounted in this way, the center of the yarn carrier (not shown in FIG. 9) is directly above the center of the middle flipper cam 6.

Figure 10:
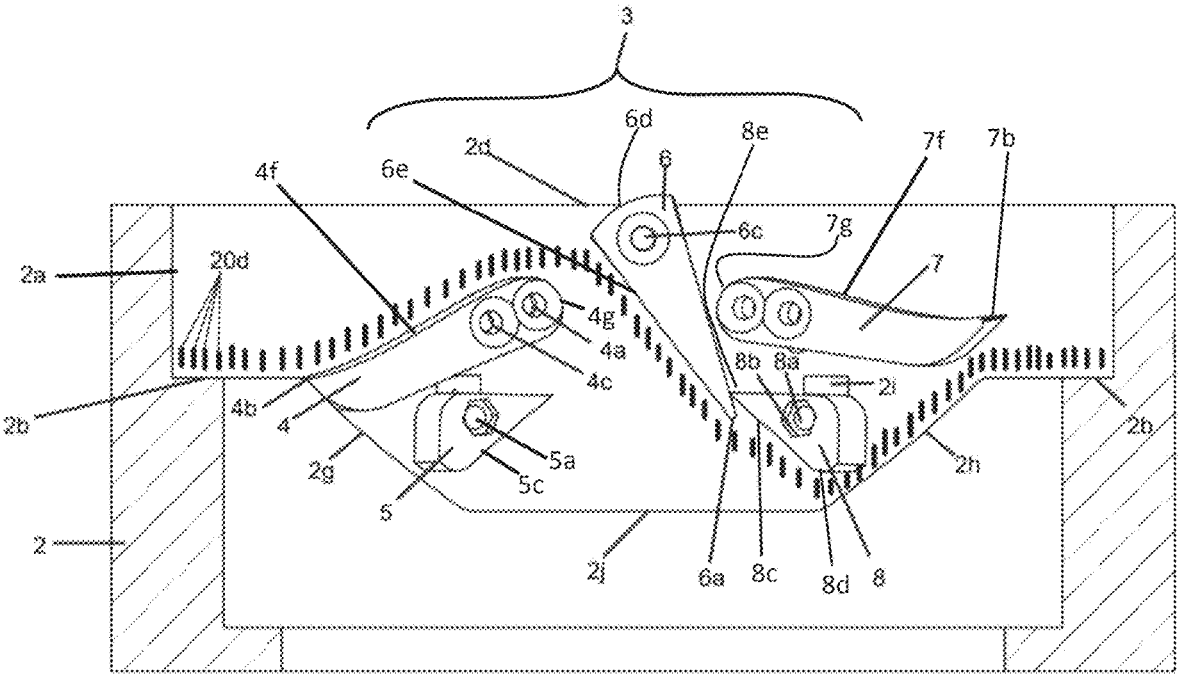
FIG. 10 is a front view of a cutaway of a camshell comprising a cam system connected to the inner surface of the camshell, wherein CSM needle butts are shown as small vertical lines traveling through the cam system when the cylinder (not shown in FIG. 10) rotates in a clockwise direction, according to an embodiment.

FIG. 10 is a side view of a cross-section of a camshell 2 showing the inner wall 2*a* of the camshell 2 and the travel path of the needle butts 20*d* of CSM needles 20 (shown as short vertical lines) through a cam system 3 when a cylinder 9*a* (not shown in FIG. 10) carrying the CSM needles 20 is rotated in a clockwise direction around a vertical axis 55, according to an embodiment and all of the following description relates to this particular embodiment. In the view provided in this figure, the movement of the CSM needles 20 through the cam system 3 are shown as they would move in a clockwise direction, which is from left to right in FIG. 10. The up and down movement of the butt sections 20*d*, and thus of their respective CSM needles 20 as each move through the cam system 3, result in an interplay between the CSM needles 20 and the working yarn 10 to create stitches as shown and described in FIG. 7 above.

In the embodiment shown in FIG. 10, each CSM needle 20 begins with its respective butt section 20*d* resting on the resting needle track 2*b* at the left of the cam system 3. In an embodiment, each needle butt 20*d* reaches the left-side flipper cam 4, and the needle butt 20*d* of each CSM needle 20 moves from the needle resting track 2*b* onto the left-side flipper cam 4. The left-side flipper cam 4 forces the butt section 20*d* of each needle 20 to travel up the left-side flipper top edge 4*f* and prevents the needle butt 20*d* from traveling down the left-side needle track ramp 2*g*. Each needle butt 20*d* then travels up the left-side flipper top edge 4*f* until it reaches the proximal end 6*d* of the middle flipper cam 6. When the needle butt 20*d* of each needle 20 contacts the middle flipper cam 6, the middle flipper cam 6 swings to the right, as shown in FIG. 10, forcing each needle butt 20*d* to travel downward toward the right bee cam 8. Once each needle butt 20*d* reaches the distal end 6*a* of the middle flipper 6, wherein the needle butt 20 comes into contact with the underside edge 8*c* of the right bee cam 8. As the needle butt 20 continues to travel downward along the underside edge 8*c* of the right bee cam 8, it travels below the lowest point 8*d* of the bee cam 8, which is the lowest position that each needle butt 20*d* of each CSM needle 20 travels through the cam system 3, when traveling in a clockwise direction. Once the needle butt 20*d* of each CSM needle 20 passes the lowest point 8*d* under the right bee cam 8, each then travels up the right needle track ramp 2*h*. As each needle butt 20*d* travels up the right-side ramp 2*h*, it can pass below the right-side flipper cam 7 pushing up the right side 7*b* of the right-side flipper cam 7 sufficient to allow each needle butt 20*d* to pass below the right side 7*b* of the right-side flipper cam 7. At the right-side of the right needle track ramp 2*h*, the needle butt 20*d* of each CSM needle 20 can be returned to the resting track 2*b* and remain at that height while it travels around the needle resting track 2*b* as the cylinder 9*a* (not shown in FIG. 10) rotates within the camshell 2 until it again arrives at the left needle track ramp 2*g* to repeat the process described above, wherein each CSM needle 20 creates a stitch with each rotation of the cylinder 9*a* (not shown in FIG. 10).

In this embodiment, when the cylinder (not shown in FIG. 10) is rotated clockwise and the needle butt 20*d* of each CSM needle 20 travels from left to right in the current perspective, the function of the left-side flipper cam 4 is twofold. First, it can divert each needle butt 20*d* so it does not travel under the left bee cam 5, and second, to cause each needle butt section 20*d*, and the CSM needle 20 itself, to travel upward sufficiently so the stitch 25 (not shown in FIG. 10) on each CSM needle 20 can fall below the needle latch 20*e* (not shown in FIG. 10), as shown and described in FIG. 7, view "B" above.

According to an embodiment, the left-side flipper cam 4 can comprise a right side 4*g* which is thick and rounded tapering down to a point on its left side 4*b*. In this embodiment, the right side 4*g* of the left-side flipper cam 4 can be movably connected to the inner surface 2*a* of the camshell 2 allowing the left side 4*b* of the left-side flipper cam 4 to be pivoted from an up position (shown in FIG. 11) to a down position as shown in FIG. 10. In this embodiment, the left-side flipper cam 4 can be pivoted approximately 20 degrees with a pivot point being at or near an anchor bolt hole 4*a*. According to an embodiment, the left-side flipper top edge 4*f* of the left-side flipper cam 4 can comprise an s-curve shape forming a smooth ramp-like surface for each needle butt 20*d* to travel up as the cylinder rotates clockwise and the needles move from left to right as shown in FIG. 10. According to an embodiment, the point comprising the left side 4*b* of the left-side flipper cam 4 can align with the top of the left-side needle track ramp 2*g* to create a smooth junction between the needle resting track 2*b* and the left-side flipper top edge 4*f* of the left-side flipper cam 4. Although not visible in in FIG. 10, the left-side flipper cam 4 can comprise a curve between its left side 4*b* and right side 4*g* matching the curved shape of the inner surface 2*a* of the camshell 2 such that when the left-side flipper cam 4 is pivoted, it can do so without contacting or interfering with or inhibiting the movement of exterior wall of the cylinder 9*a* (not shown in FIG. 10). In an embodiment, the left-side flipper cam 4, the right-side flipper cam 7, the middle flipper cam 6, the left bee cam 5, and the right bee cam 8 can all have a thickness that is slightly thinner than the width of the camshell needle track 2*b*.

The right edge of the left-side flipper cam 4 can be located at a sufficient distance from a left side of the middle flipper cam 6 to allow the needle butt 20*d* of each CSM needle 20 to travel between the right side 4*g* of the left-side flipper cam 4 and the middle flipper cam 6 when the cylinder is rotated in a clockwise direction. Also, the left-side flipper cam 4 can be located at a sufficient distance from a left side of the middle flipper cam 6 to allow the middle flipper cam 6 to swing to the left, allowing the middle flipper tip 6*a* to connect with the left bee cam 5 in either its highest or lowest position without the left-side flipper cam 4 interfering with the path of the middle flipper cam 6, according to an embodiment. According to an embodiment, the right side 4*g* of the left-side flipper cam 4 can allow the needle butt 20*d* of each CSM needle 20 to travel upward sufficiently that the stitch 25 on the CSM needle 20 can drop below the needle latch 20*e* (not shown in FIG. 10 but discussed above in FIG. 7 view "B".) However, the right side 4*g* of the left-side flipper cam 4 can also be located low enough, relative to a proximal edge 6*d* of the middle flipper cam 6 that the needle butt 20*d* of each CSM needle 20 can travel past the right side 4*g* of the left-side flipper cam 4 and be brought into contact with the left edge 6*e* of the middle flipper cam 6 and forced down the length of its left edge 6*e*.

As noted above, one function of the left-side flipper cam 4 can be to divert the butt section 20*d* of each CSM needle 20 so it does not travel under the left bee cam 5, according to an embodiment. A key part of the CSM 1000's functionality is derived from the design of the left-side flipper that diverts the CSM needles 20 to avoid them traveling under the left bee cam 5 when the cylinder 9*a* is rotated in a clockwise direction, according to an embodiment. In the embodiment shown in FIG. 10, the left-side flipper cam 4 can comprise a second hole 4*c*, located just to the left of the anchor bolt 4*a*, and can be used in conjunction with a torsion spring 32 (not shown in FIG. 10) the purpose of which can be to hold the left-side flipper cam 4 in the lowered position as shown in FIG. 10. Specifically, the tip 4*b* of the left-side flipper cam 4 can be held against the needle track 2*b* with a left-side flipper cam torsion spring 32 (not shown in FIG. 10) or similar means, which can create a slight downward pressure on the left-side flipper cam 4. This slight downward pressure can, depending on the direction the CSM needles 20 are traveling through the cam system 3, either cause the butt section 20*d* of each needle 20 to travel up the right-side needle track ramp 2*h*, as shown in FIG. 10 where movement is clockwise, or move under the left side 4*b* of the left-side flipper cam 4 when the CSM needles 20 are moving in a counterclockwise direction as will be explained in the detailed description of FIG. 11.

Figure 11:
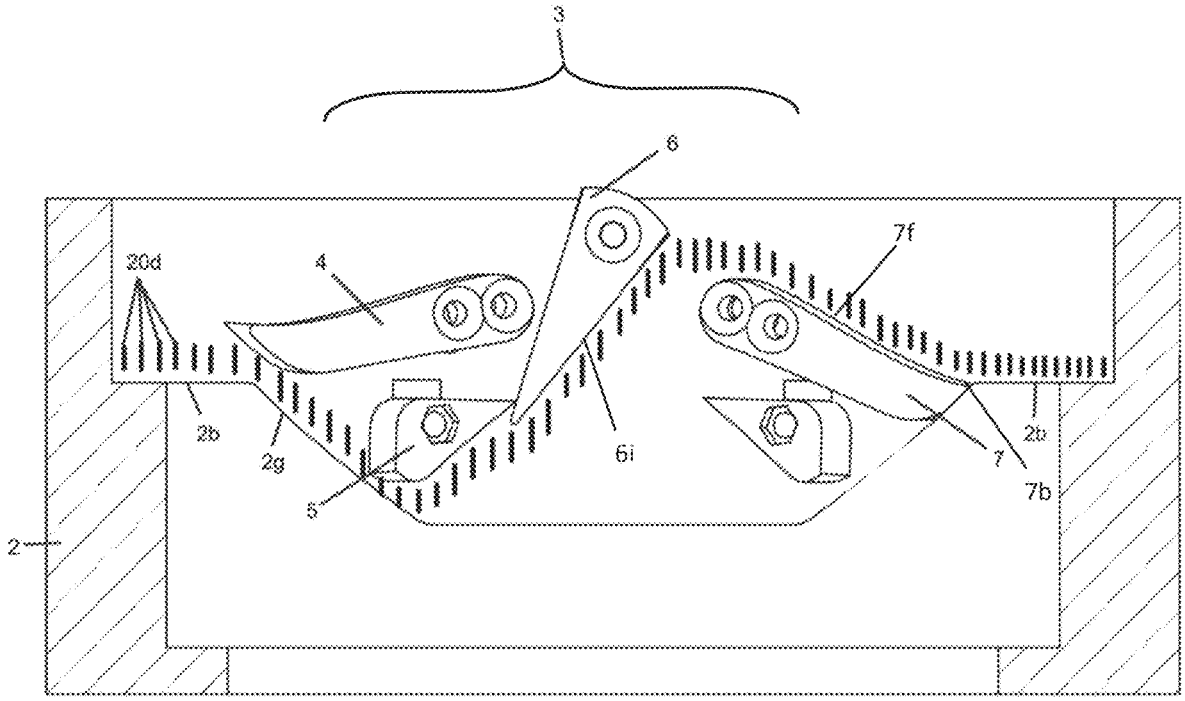
FIG. 11 is a front view of a cutaway of a camshell comprising a cam system connected to the inner surface of a camshell, wherein CSM needle butts are shown as small vertical lines traveling through the cam system when the cylinder (not shown in FIG. 11) rotates in a counterclockwise direction.

According to an embodiment, the right-side flipper cam 7 can be an exact mirror image of the left-side flipper cam 4, and the right-side flipper cam 7 and the right-side bee cam 8 can be an exact mirror image of the left-side flipper cam 4 and the left side bee cam 5 if the two sides are split by a vertical line bisecting the middle flipper cam 6 when placed in a neutral position, wherein the middle flipper cam 6 is perpendicular to the rim 2*d* of the camshell 2. In this embodiment, the purpose of the middle flipper cam 6 can be to direct the needle butt 20*d* of each CSM needle 20 as it exits the right side 4*g* of the left-side flipper cam 4 under the right-side bee cam 8. Alternatively, if the cylinder 9*a* is rotating the CSM needles 20 in a counterclockwise direction, the purpose of the middle flipper cam 6 can be to direct the needle butt 20*d* of each CSM needle 20 as it exits the left side 7*g* of the right-side flipper cam 7 under the left-side bee cam 5, as shown in FIG. 11. In this embodiment, the middle flipper cam 6 can be made to pivot so as to perform this function regardless of whether the needle butt 20*d* of each needle 20 is traveling clockwise or counterclockwise (not shown in FIG. 10) through the cam system 3, according to an embodiment.

In an embodiment, the middle flipper cam 6 can comprise a shape similar to an isosceles triangle with one short side at its proximal end 6*d* and two long sides meeting at a point at its distal end 6*a*. According to an embodiment, the left and right side surfaces of the middle flipper 6 having a slight curvature to accommodate the rounded ends of the needle butts 20*d* to encourage them to follow the path of the middle flipper 6 down to the bee cam, 5 and 8. In an embodiment, the back (not shown in FIG. 10) and front of the middle flipper cam 6 can be curved surfaces to allow for maximum rotation from left to right while avoiding interaction with either the outer cylinder wall 9*s* (not shown in FIG. 10) or the inner wall 2*a* of the camshell 2.

In an embodiment, the middle flipper cam 6 can be pivotably connected to the interior of the camshell wall 2*a*, by bolting or similar means, wherein the proximal end 6*d* can be at the top, and the tip can be located near distal end 6*a* in the orientation shown in FIG. 10. According to an embodiment, the middle flipper cam 6 should extend high enough along the inner wall of the camshell 2*a* such that it can direct the butt section 20*d* of each needle 20 as it exits the top edge of either the left-side flipper cam 4 or the right-side flipper cam 7, but the proximal end 6*d* of the middle flipper cam 6 should not be extend past the top of the camshell wall 2*d*.

In an embodiment, the length of the middle flipper cam 6 can be determined by the position of the bee cam 8 at its highest and lowest points. Specifically, the distal end 6*a* of the middle flipper cam 6, should extend past, and slightly overlap with the closest and highest part of the right bee cam 8 when the right bee cam 8 is in its lowest position relative to the rim 2*d* of the camshell 2. The tip 6*a* of the middle flipper does not extend past the lowest edge of the bee cam 8 when the bee cam 8 is in its highest position. The relative angles of the right bee cam 8 and middle flipper cam 6 can work together to effectively transfer CSM needles 20 between from the middle flipper cam 6 to the right bee cam 8 when the right bee cam 8 is at either its highest point relative to the rim 2*d* of the camshell 2, its lowest point relative to the rim 2*d* of the camshell 2, or at all points in between, all while minimizing friction between the cams and the needle buts 20*d*, and therefore, wear and tear on them as well. The total length of the middle flipper cam 6 can be approximately three fourths the length of the slide flipper cam 4.

According to an embodiment, the middle flipper cam 6 can be located near enough to the rim 2*d* of the camshell 2, as well as to be narrow enough in its design, and the bee cams 5/8 are spaced far enough apart to allow for a gentle angle of the middle flipper 6 such that the needle's tips (not shown in FIG. 10) are able to grab the yarn 10 from the yarn carrier 12 (not shown in FIG. 10) as the needle butts 20*d* begin their descent along the middle flipper 6.

In an embodiment, a middle flipper pivot point 6*c* can be located near the proximal end 6*d* of the middle flipper cam 6 on the line from the proximal end 6*d* to the distal end 6*a* bisecting the middle flipper cam 6. At this point, the middle flipper cam 6 can be pivotably connected to the inner wall 2*a* of the camshell 2*a*. According to an embodiment, the middle flipper cam 6 can be in a neutral position (not shown in FIG. 10), when it is perpendicular to the needle track 2*b*, and the middle flipper cam 6 can pivot about the pivot point 6*c* (not shown in FIG. 10), approximately −40 to +40 degrees to either the left or the right. In an embodiment, the middle flipper cam 6 can be pivoted to the right when knitting with the cylinder 9*a* rotating in a clockwise direction and to the left when knitting with the cylinder 9*a* rotating in a counterclockwise direction (the cylinder 9*a* is not shown in FIG. 10.)

In an embodiment, the function of the right bee cam 8 can be to control the length of each stitch 25 created by the CSM; as the butt section 20*d* of each CSM needle 20 can travel below the bottom of the right bee cam 8, as shown in FIG. 10, causing the hook 20*c* of the CSM needle 20 (not shown in FIG. 10) to pull the working yarn 10 (not shown in FIG. 10) down as shown above in FIG. 7 view "E". According to an embodiment, the lower the right bee cam 8 is positioned in relation to the rim 9*h* of the cylinder 9*a*, the longer the length of yarn (not shown in FIG. 10) pulled down for each stitch, and thus, the longer the stitch 25 (not shown in FIG. 10) will be. Conversely, the higher the right bee cam 8 is positioned in relation to the rim 9*h* of the cylinder 9*a*, the shorter the length of yarn (not shown in FIG. 10) pulled down, and the shorter the stitch 25 (not shown in FIG. 10) will be.

According to an embodiment, the vertical position of the right bee cam 8 can be adjustable so the user can control the length of the stitch (not shown in FIG. 10) as desired. To facilitate such adjustability, the right bee cam 8 has a hole 8*a* perpendicular to the face of the camshell through which a bolt or other connecting means can fit. The method for adjusting the bee cams 5 and 8 with the cam knobs (not shown in FIG. 10) is described in FIG. 13 below.

According to an embodiment, the right bee cam 8 can have a triangular shape wherein a top side 8*e* of the triangle can be parallel to the rim 2*d* of the camshell 2; the right-side of the right bee cam 8 can be perpendicular to the rim of the camshell 2*d* and the needle butts 20*d* of each CSM needle 20 can travel along an underside edge 8*c* of the right bee cam 8, which can form an angle of slightly less than 45 degrees with the rim 2*d* of the camshell 2. In an embodiment, when the needle butt 20*d* of each CSM needle 20 travels clockwise, from left to right in the current perspective, the needle butt 20*d* of each CSM needle 20 can transfer from the middle flipper cam 6, to underside edge 8*c* of the right bee cam 8, then travel below the right bee cam 8, and finally to the right-side needle ramp 2*h*. According to an embodiment, the right bee cam 8 can be a size and shape allowing it to be raised to its highest position, closest to the rim 2*d* of the camshell 2 without contacting or interfering with the movement of the right-side flipper cam 7 in a down position as shown in FIG. 11. In an embodiment, the face and back of the right bee cam 8 can be curved so as to avoid interaction with either the outer surface 9*s* of a cylinder 9*a* (not shown in FIG. 10) or the interior wall 2*a* of the camshell 2. Unlike the middle flipper cam 6 and left and right-side flipper cams 4 and 7, the bee cams 5 and 8 can be locked into a position, wherein they do not move while the device is being used for knitting.

According to an embodiment, the bottom side 8*d* of the right bee cam 8, near the lowest point 8*d* can be rounded and angled to minimize noise and friction, and to reduce twisting of each CSM needle 20 (not pictured in FIG. 10) as the needle butt 20*d* of each CSM needle 20 travels below the right bee cam 8, when tension in the needle is typically highest making the CSM needles 20 most prone to failure at this point.

According to an embodiment, the bee cams, 5 and 8, have sufficient space between them that the tip of the middle flipper cam 6 can movably connected to either the right bee cam 8 or the left bee cam 5 with the angle of the middle flipper cam 6 can be gentle enough that the CSM needles can travel down its edges, 6*e* and 6*i*, as the cylinder rotates, while close enough to each other that, in their lowest positions, the butt section 20*d* of each needle 20 can have room to pass between the underside edges, 5*c* and 8*c*, of the bee cams 5 and 8 respectively and connecting track section 2*j* In this view, a box-shaped opening 2*i* can be seen above and behind the right bee cam 8, wherein this box-shaped opening extends through the camshell wall 2*a* and allows for the up and down adjustment of the right bee cam 8 as discussed in more detail below.

According to an embodiment, the left bee cam 5 can be an exact mirror image of the right bee 8 cam across a vertical line bisecting the middle flipper cam 6 when placed in a neutral position (not shown in FIG. 10.) When the butt section 20*d* of each CSM needle 20 passes counterclockwise below the left bee cam 5 to make a stitch 25, the right bee cam 8 is not used and when the needle butt 20*d* of each CSM needle 20 passes clockwise below the right bee cam 5 to make a stitch 25, the right bee cam 8 is not used, according to an embodiment.

According to an embodiment, in the cam system area 3, a connecting track section 2*j* that is built into the interior camshell wall 2*a* is lower than it is for the resting needle track height 2*b*. In the current perspective, there is an angled ramp 2*g* coming down from the edge of the resting track at the left-side of the cam system area 3, a connecting track section 2*j* that is below the cams and a little wider than the middle flipper's range of motion, and then an angled ramp 2*h* going up to the edge of the resting track 2*b* at the right-side of the cam system area 3. The purpose of the ramps is to return the needle butts 20*d* to the height of the resting track after the needle butts 20*d* have passed under the bee cams, 5 and 8. When the cylinder 9*a* (not shown in FIG. 10) is turning clockwise and the CSM needles 20 are traveling from left to right, as shown in the current perspective, the CSM needles 20 travel up the left-side flipper cam 4, down under the middle flipper cam 6 and the right bee cam 8, then up the right-side needle ramp 2*h* before returning to the resting needle track 2*b*. In an embodiment, the needle butt 20*d* of each CSM needle 20 does not contact the connecting track section 2*j*.

According to an embodiment, each ramp 2*g* and 2*h* can comprise a straight ramp having less than 45-degree increase to minimize twisting of the needle butts 20*d* and reducing unnecessary friction caused by the interaction of the needle butts 20*d* and the ramps, 2*g* and 2*h*. In an embodiment, the tips, 4*b* and 7*b*, of the side flipper cams, 4 and 7, can rest where the ramps, 2*g* and 2*h*, each meet the resting track 2*b* such that a needle butt 20*d* traveling from the resting track 2*b* can travel straight across to intersect with the gentle s-shaped top edge, 4*f* and 7*f*, of each side flipper cam, 4 and 7, so each needle butt's 20*d* progress is not impeded by the tips, 4*b* and 5*b*, of the each side flipper cam, 4 and 7.

FIG. 11 is a front view of a cross-section of a camshell 2 showing the inner surface 2*a* of the camshell 2 wherein the travel path of needle butts 20*d* (represented by short vertical lines) through the cam system 3 are shown when a cylinder 9*a* (not shown in FIG. 11) is rotated in a counterclockwise direction moving the needle butts 20*d* of each CSM needle 20 through the cam system 3, according to an embodiment. The counterclockwise rotation moves the needles from right to left in the current perspective. In this direction, the needle butt 20*d* of each CSM needle 20 can enter the cam system 3 from the resting track 2*b* and travel over the right side 7*b* of the right-side flipper cam 7 up the right-side flipper top edge 7*f* until it reaches the proximal end 6*d* of the right side 6*i* of the middle flipper cam 6 and travels down the right side 6*i* of the middle flipper cam 6 until it reaches the distal end 6*a*, wherein each needle butt 20*d* passes to the bottom side 5*c* of the left bee cam 5, according to an embodiment. After passing below the bottom of the left bee cam 5, each needle butt 20*d* can travel up the left-side needle track ramp 2*g* and below the tip 4*b* of the left-side flipper cam 4 before returning to the resting track 2*b* on the left side of the cam system 3. In short, the path of each needle butt 20*d* described in FIG. 10 for clockwise rotation is exactly the same as that shown in FIG. 11 for counterclockwise rotation except the right-side flipper cam 7 is used rather than the left-side flipper cam 4 and the left bee cam 5 is used rather than the right bee cam 8, and the middle flipper pivots to the left rather than the right, according to an embodiment.

Figure 12:
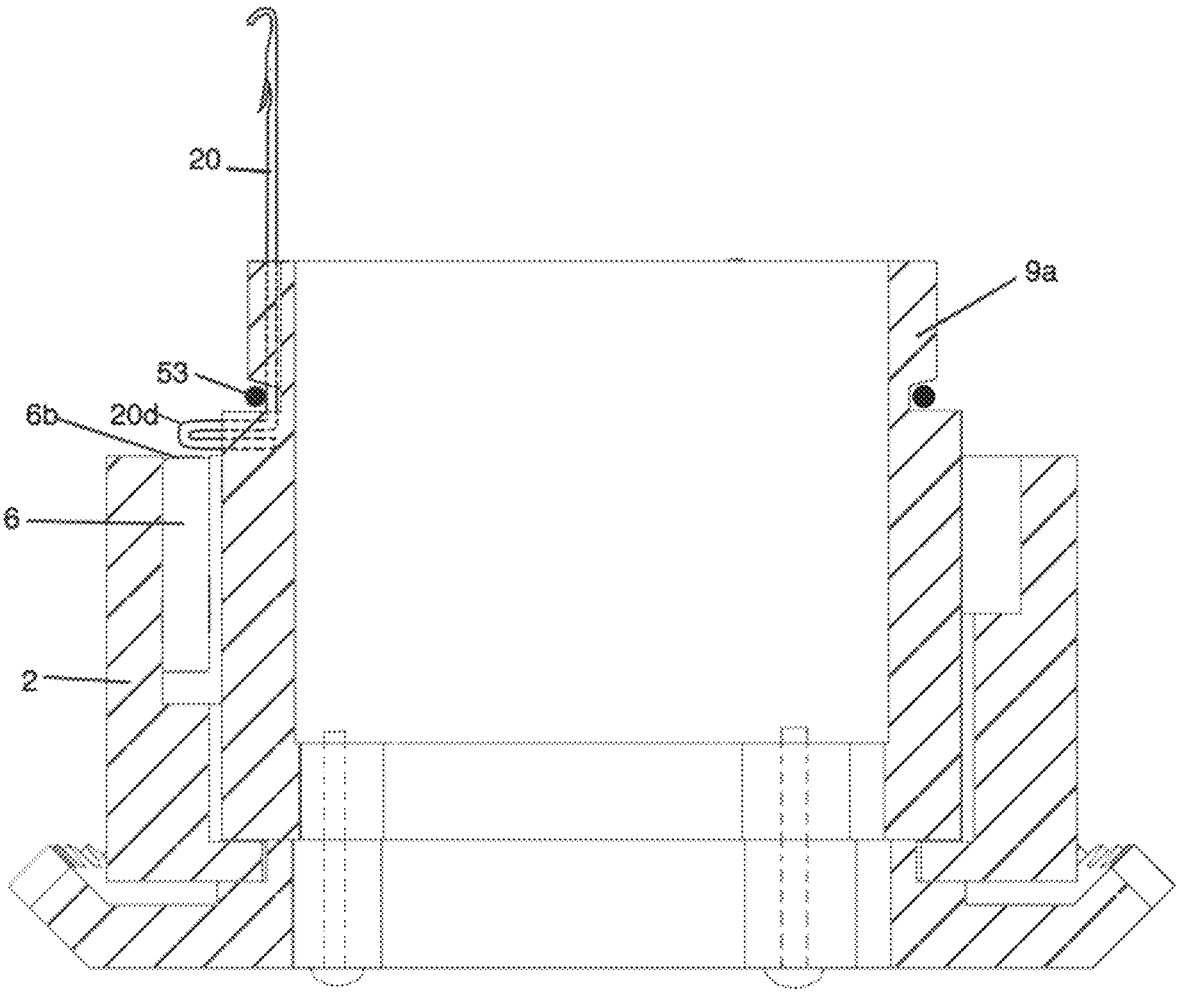
FIG. 12 is a perspective side view of a cutaway of a camshell and a cylinder, and a cylinder spring comprising a CSM apparatus wherein a needle, shown in a partially transparent view, is in an out-of-work position, according to an embodiment.

FIG. 12 is a perspective side view of a cutaway of a camshell 2*a* cylinder 9*a*, and a cylinder spring 53 comprising a CSM apparatus 100 wherein a CSM needle 20, shown in a partially transparent view, is in an out-of-work position, according to an embodiment. In an embodiment, a user of the CSM 1000 may lift one or more CSM needles 20 up and into an out-of-work position in order to transition between rotating the cylinder 9*a* in a clockwise direction to rotating it in a counterclockwise direction or vice versa. When one or more CSM needles 20 are raised to an up and out-of-work position, the top of each needle butt 20*d* can rests against the bottom of a cylinder spring 53. At that height, the needle butt 20*d* can be located above the proximal end 6*d* of the middle flipper cam 6, allowing the needle butt 20*d* to pass over the middle flipper cam 6 without interference as the cylinder 9*a* is rotated, according to an embodiment.

Figure 13:
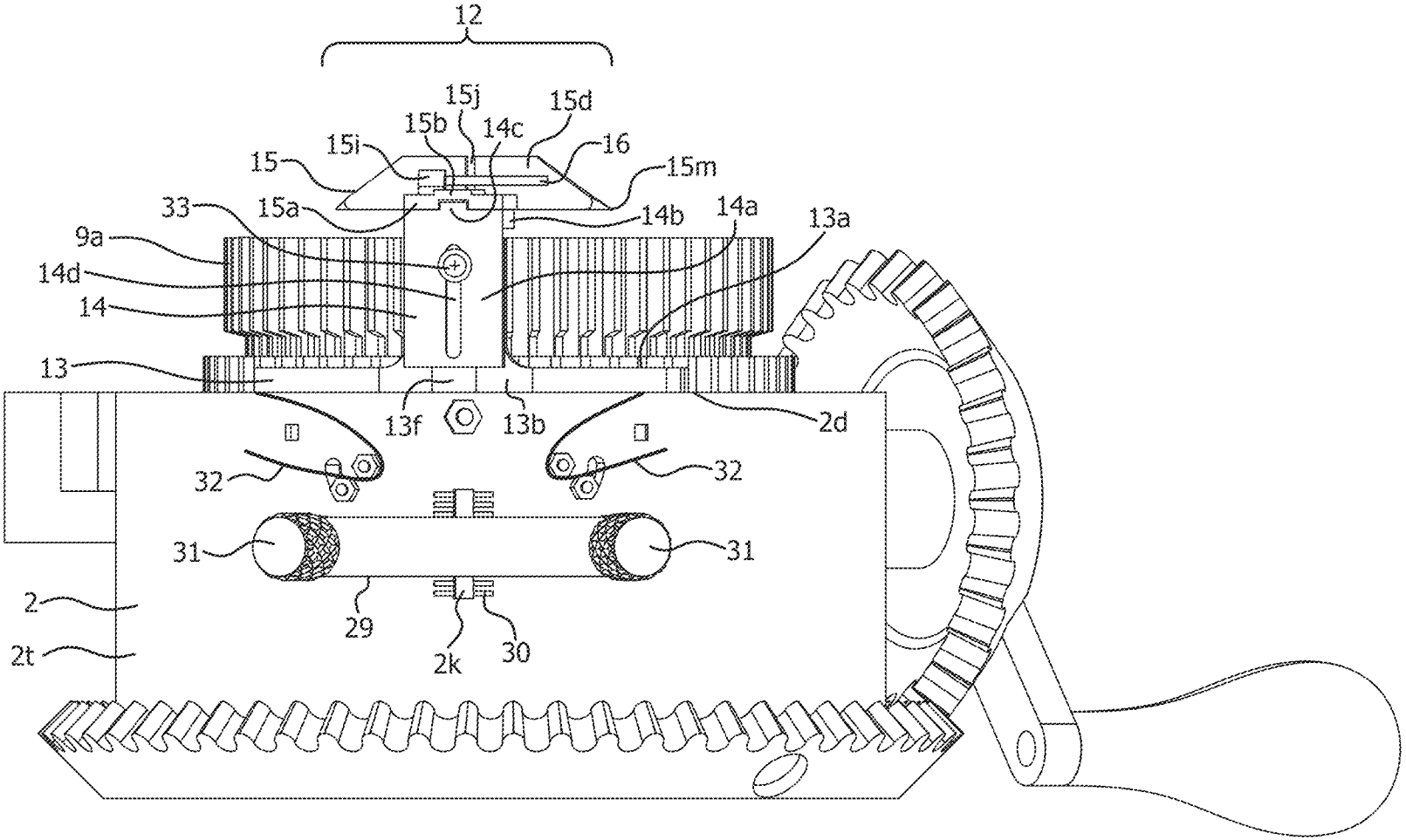
FIG. 13 is a front view of the outer surface of a CSM apparatus comprising a camshell and a cylinder, wherein a yarn carrier is connected to the camshell and a bee cam connector band, a bee cam gauge, and two bee cam knobs, according to an embodiment.

FIG. 13 is a frontside perspective view of the outside of a CSM assembly 100 comprising a camshell 2, a yarn carrier 12, a bee cam connector band 29, a bee cam gauge 30, two bee cam knobs 31, and torsion springs 32, according to an embodiment.

According to an embodiment, the bee cam connector band 29 can maintain both the left bee cam 5 and the right bee cam 8 (neither shown in FIG. 13) at the same height within the cam system 3, ensuring consistent stitch 25 length (not shown in FIG. 13) when using the device for knitting in either the clockwise direction or the counterclockwise direction within the same project (not shown in FIG. 13,) as it is necessary to do when knitting socks (not shown in FIG. 13.) In an embodiment, the bee cam connector band 29 can be moved vertically up and down and locked in place at various chosen heights relative to the rim 2*d* of the camshell 2 by tightening the bee cam knobs 31 that can attach to bolts, 8*a* and 5*a* (shown in FIG. 10) that extend through each bee cam, 5 and 8 (not shown in FIG. 13.)

In an embodiment, the bee cam connector band 29 can fit into a vertical slot 2*k* located on the outer surface 2*t* of the camshell 2 with the vertical slot 2*k* in a position perpendicular to the rim 2*d* of the camshell 2 and the bee cam connector band 29 mounted parallel to the rim 2*d* of the camshell 2. In an embodiment, a bee cam gauge 30 can be located on either side of the vertical slot 2*k* allowing use of the bee cam connector band 29 to measure the height as the right bee cam 8 and left bee cam 5 as the connector band 29, which is connected to the bee cams 5 and 8 (not shown in FIG. 13), to be moved vertically up and down in relation to the outer surface 2*t* of the camshell 2. In this way, the bee cam gauge 30 can be used to move the bee cams to a position previously determined or known to the user of the CSM apparatus 100 to be the proper position to create the proper length of stitch 25 (not shown in FIG. 13) required for the work being performed. In an embodiment, the bee cam gauge 30 can be used to ensure that the bee cam connector band 29, as well as the right bee cam 8 and left bee cam 5 connected to it, is level, by aligning the bee cam connector band 29 with horizontal rectangular indentations, visible in FIG. 13, comprising the bee cam gauge 30 and spanning either side of a vertical slot 2*k* in which the bee cam connector band 29 fits.

An advantage of the embodiment shown in FIG. 13 *s* that the height of the bee cams (not shown in FIG. 13) can be adjusted even when a cylinder 9*a* is installed within the camshell 2. However, because there is no easy way for the user to access either bee cam, 5 or 8, (not shown in FIG. 13) when a cylinder 9*a* is installed within the camshell 2, use of a hex head bolt 8*a* (not shown in FIG. 13 but described above in FIG. 10 in relation to the right bee cam 8) that is inserted in each bee cam 8 (not shown in FIG. 13 but described above in FIG. 10 in relation to the right bee cam 8) and through to the cam knob 31 enables the user to fully tighten or loosen the connector band 29 and bee cams, 5 and 8, to the camshell 2 using only the cam knobs 31.

In FIG. 13, the mounting bolts for the torsion springs 32 can be viewed, which are used to provide tension to each side flipper cam, 4 and 7, (not shown in FIG. 13) pulling each into its lowered positions (not shown in FIG. 13), as described in FIG. 10 above.

Many components of the yarn carrier 12 are visible in this view, including the yarn carrier vertical adjuster 14 located in the rear middle section of the yarn carrier 12 which allows the height of the yarn carrier 12 to be vertically adjustable up or down relative to the rim 2*d* of the camshell 2.

Figure 14:
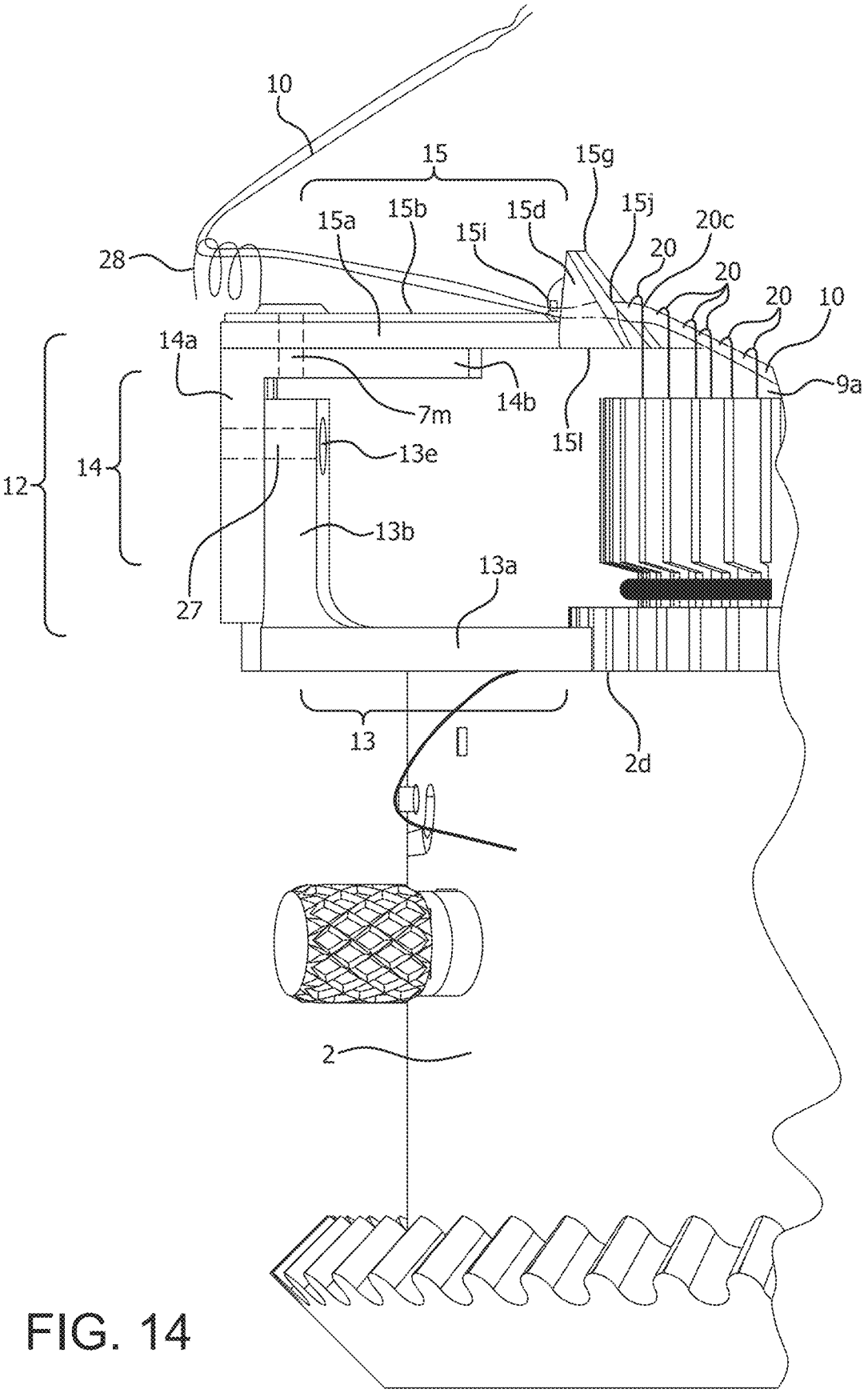
FIG. 14 is a side perspective view of a partial section of a CSM assembly comprising a camshell and a cylinder, wherein a yarn carrier is connected to the camshell, according to an embodiment.

FIG. 14 is a side perspective view of a partial section of a CSM assembly 100 comprising a yarn carrier 12 indicating the location of each of its parts and the yarn carrier's 12 connection to the camshell 2, according to an embodiment. This view also shows how working yarn 10 can be directed through the yarn carrier apparatus 12 to feed the CSM needles 20 held within the cylinder 9*a* in this embodiment.

In an embodiment, according to an embodiment, the yarn carrier 12 can be mounted to the rim 2*d* of the camshell 2 by an L-shaped yarn carrier base 13, comprising a horizontal flat section 13*a*, which can connect to the rim 2*d* of the camshell 2 and comprise a pillar section 13*b* that rises vertically in a plane parallel to the outer surface 2*t* of the camshell 2, and perpendicular to the horizontal flat section 13*a* and can be the same height as the rim 9*h* of the cylinder 9*a* as shown in FIG. 14.

According to an embodiment, a yarn carrier top 15 can be adjusted vertically up and down by the yarn carrier vertical adjuster 14, and yarn carrier top 15 can be removed to facilitate certain knitting techniques wherein the user manually places the yarn around each CSM needle 20. Such manipulation must happen as the CSM needles 20 are traveling through the cam system 3, so the user benefits from not having the yarn carrier 12 obstructing access to the CSM needles 20.

Figure 15:
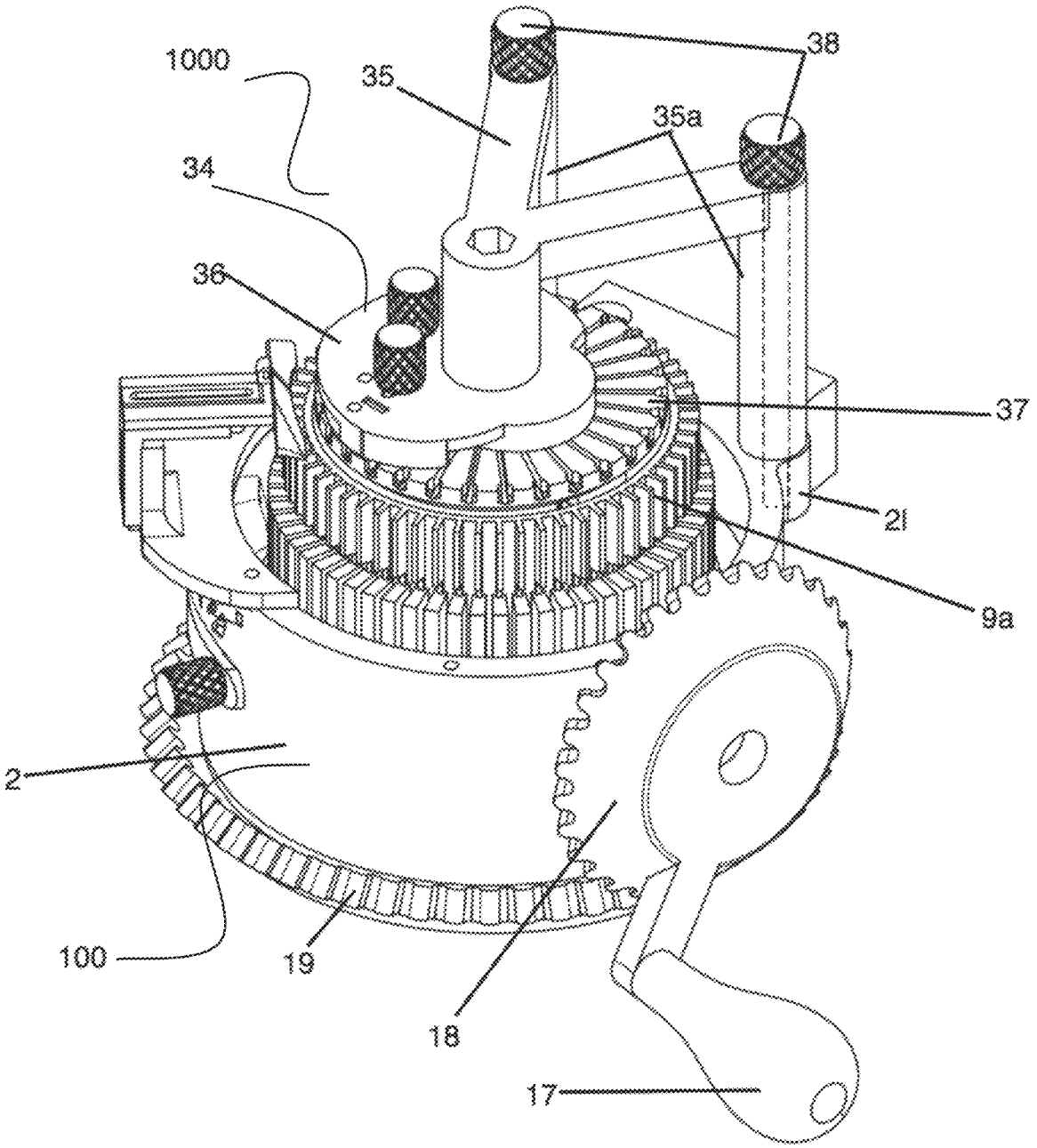
FIG. 15 is a top, front and side view of a CSM comprising a CSM assembly and a ribber assembly, wherein the ribber assembly comprises a ribber frame attached to the camshell, a tappet plate, and a ribber dial, according to an embodiment.

FIG. 15 is a top, front and side perspective view of a CSM 1000 comprising a CSM assembly 100 connected to a ribber assembly 34, which comprises a ribber frame 35, a tappet plate 36, and a ribber dial 37, wherein the ribber assembly 34 is connected to the camshell 2 with ribber frame bolts 38, shown in a partially transparent view, according to an embodiment. In an embodiment, the ribber assembly 34 can be attached to the camshell 2 with two ribber frame bolts 38 which connect two ribber frame legs 35*a* and into two camshell connection nodes 21 (one of which is hidden behind the cylinder 9*a* in FIG. 15) such that the ribber dial 37, which can be a circular disc located in a plane perpendicular to and centered on the central vertical axis 55 and also centered above the cylindrical inner opening 60. According to an embodiment, the ribber needles 44 (not shown in FIG. 15) can each be movably secured within ribber dial 37 and travel through a ribber cam system (not shown in FIG. 15), within the tappet plate 36, which comprises a ribber cam 46 (not shown in FIG. 15), an in/out cam (not shown in FIG. 15) wherein the ribber needles 44 (not shown in FIG. 15) can grab working yarn 10 (not shown in FIG. 15) to create ribber stitches 75 (not shown in FIG. 15.)

According to an embodiment, a ribber fin 39 (not shown in FIG. 15) can be connected to the bottom of the ribber dial 37 which can be pushed by a ribber stop 40 (not shown in FIG. 15) which can be connected to inner surface of the cylinder 9*a* that extends straight up along the inner surface 9*t* of the cylinder 9*a* to rotate the ribber dial 37 when the cylinder 9*a* is rotated. Specifically, as the handle 17 turns side gear 18 and floor gear 19, the cylinder 9*a* can rotate, either clockwise or counterclockwise, and the ribber stop mounted to the inner surface 9*t* of the cylinder 9*a* (not shown in FIG. 15) can maintain a connection with, and rotate the ribber fin 39 (not shown in FIG. 15) so that the ribber dial 37 can be rotated at the same rate as the cylinder 9*a*, according to an embodiment. In an embodiment, columns of stitches 25 (not shown in FIG. 15) that have been formed by the CSM needles 20 (not shown in FIG. 15) can alternate with columns of rib stitches 75 (not shown in FIG. 15) formed by the ribber needles 44 (not shown in FIG. 15) resulting in a fabric called ribbing (not shown in FIG. 15.)

Figure 16:
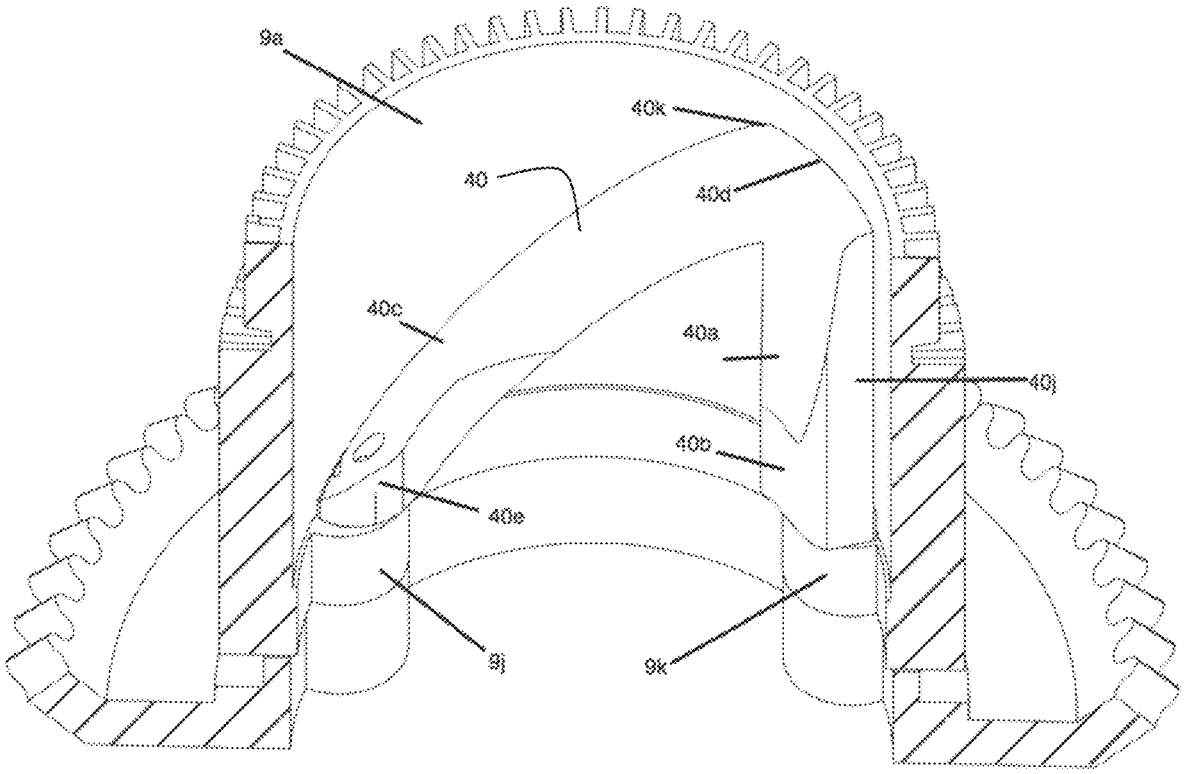
FIG. 16 is a partial top and front perspective view of a cross-section of a cylinder wherein a ribber stop is connected to inner surface of the cylinder at two cylinder connection nodes, according to an embodiment.

FIG. 16 is a top and front perspective view of a cross-section of a cylinder 9*a* showing a ribber stop 40 connected to the inner surface 9*t* of the cylinder 9*a*. In the embodiment shown, the ribber stop 40 can connect to the inner surface 9*t* of the cylinder 9*a* using connection nodes 9*j* and 9*k* and bolts or other fastening means (not shown in FIG. 16). In an embodiment, the ribber stop 40 can work in conjunction with the ribber fin 39 (not shown in FIG. 16) to turn the ribber dial 37 (not shown in FIG. 16) at the same rate as the cylinder 9*a*. In an embodiment, the ribber stop 40 can be mounted to or adjacent to the inner surface 9*t* of the cylinder 9*a* and can be easily removable by the user so as not to obstruct the space within the cylinder 9*a* when (not shown in FIG. 16) the ribber assembly 34 (not shown in FIG. 16) is not being used.

According to an embodiment, the ribber stop 40 can consist of a vertical post 40*a* parallel to the inner surface 9*t* of the cylinder 9*a*, the base 40*b* of which can connect to the cylinder connection node 9*k*. In this embodiment, the vertical post 40*a* of the ribber stop 40 can extend as much as 90% of the height of the inner surface 9*t* of the cylinder wall 9*a* and can comprise an angled post 40*c*, the base 40*e* of which can connect to the cylinder 9*a* at the cylinder connection node 9*j* and the opposite end 40*k* whereby the angled post 40*c* can connect to and provide support to the vertical post 40*a*.

According to an embodiment, the ribber stop 40 can be curved to conform to the curve of the inner surface 9*t* of the cylinder 9*a* in order to keep the cylindrical inner opening 60 of the cylinder 9*a* unobstructed, which is necessary so there is room for certain tools (not shown in FIG. 17) that are commonly used in the center of the cylinder when knitting as well as the knitted fabric created by the CSM 1000 which typically passes through the cylindrical inner opening 60 of the cylinder 9*a*.

According to an embodiment, the right-side of the vertical post 40*a* in the current perspective can comprise a flat surface 40*j*, parallel to the central vertical axis 55 and perpendicular to the rim 9*h* of the cylinder 9*a* When the ribber assembly 34 is in use (not fully shown in FIG. 16), the flat surface 40*j* can be configured to contact a flat side of the ribber fin (not shown in FIG. 16) to rotate the ribber fin 39 and actuate the ribber dial 37 (not shown in FIG. 16.) In an embodiment, the angled post of the ribber stop 40*c* can provide necessary strength and stability to the vertical post 40*a* of the ribber stop 40.

In some embodiments, there can be two sizes of ribber stops: one compatible with narrow-diameter cylinders 9*a* for use with long-butt CSM needles 20 and a slightly larger ribber stop compatible with a wide-diameter cylinder 99*a* for short-butt CSM needles 22 (not shown in FIG. 16.) In each case, the relative shape and composition of the two ribber stops can be the same, with each varying only in size.

Figure 17:
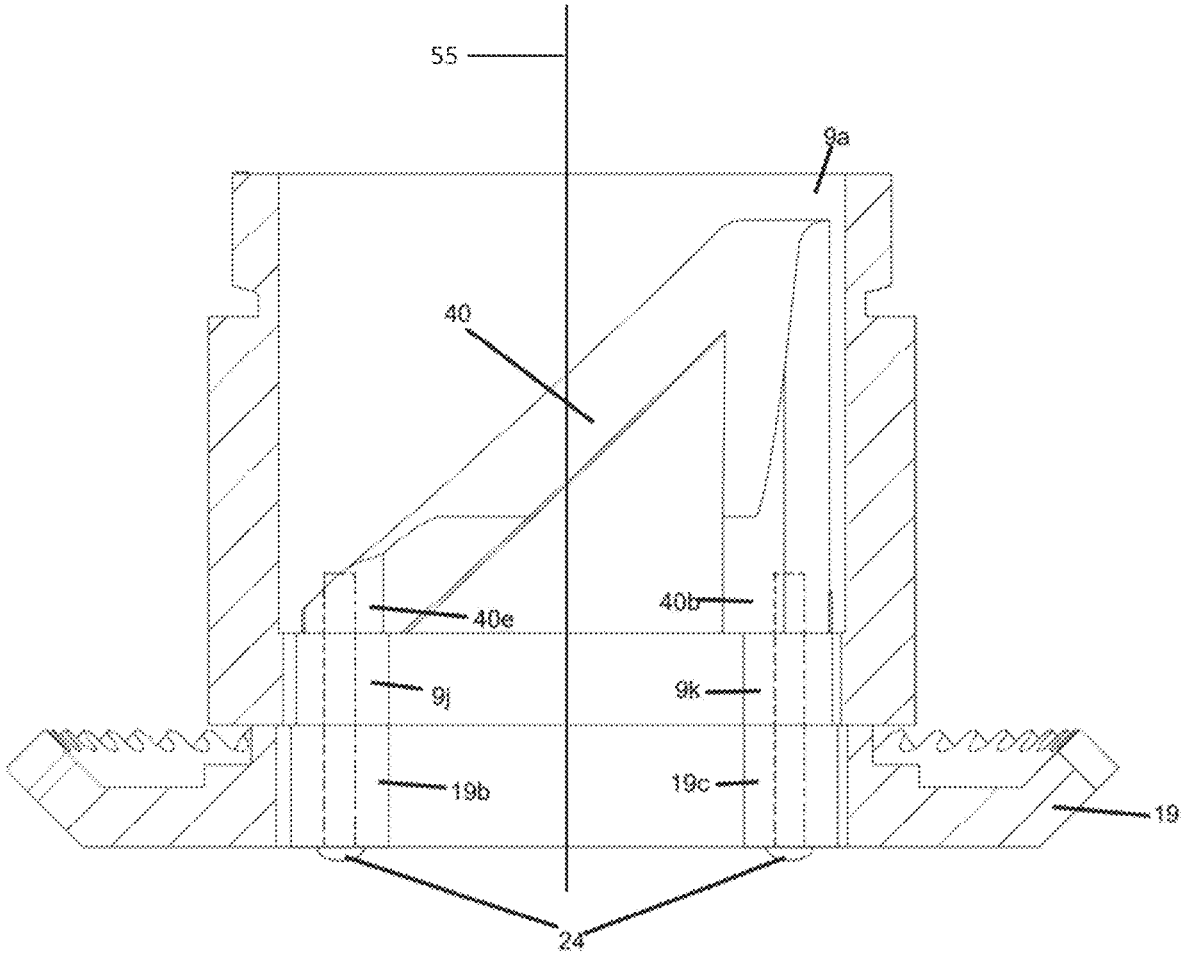
FIG. 17 is a front perspective view of a cross-section of the floor gear, cylinder, and ribber stop showing how each connecting bolt, shown in a partially transparent view, can be inserted through all three components to connect each together, according to an embodiment.

FIG. 17 is a front perspective view of a cross-section of a floor gear 19 and a cylinder 9*a*, wherein a ribber stop 40 has been mounted, as well as two connecting bolts 24, shown in a partially transparent view, inserted through the floor gear 19, cylinder 9*a* and ribber stop 40 to connect all three together, according to an embodiment. In an embodiment, the connecting bolts 24 can be inserted through each floor gear connection node 19*b* and 19*c*, through each cylinder connection node 9*j* and 9*k*, and through each ribber stop post 40*b* and 40*e*. In this figure a vertical line has been drawn to indicate where the central vertical axis 55 would be located.

Figure 18:
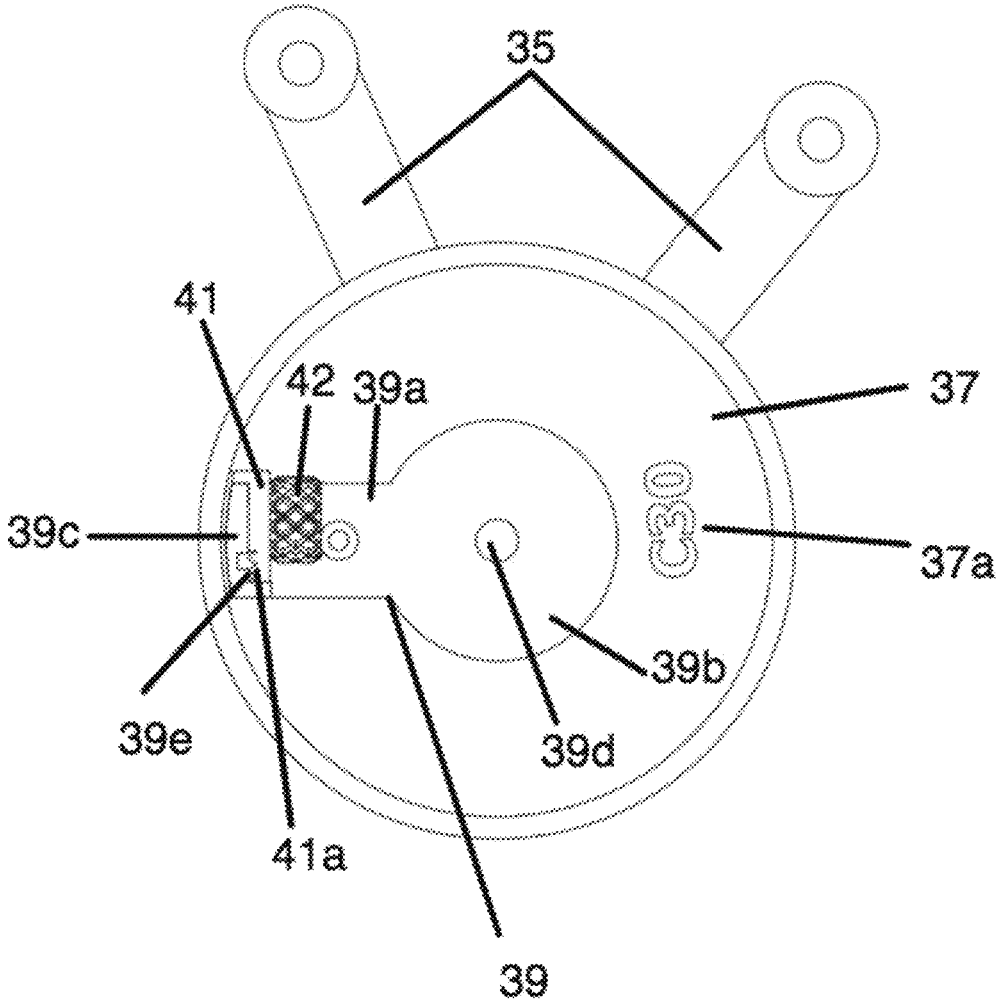
FIG. 18 is a bottom view of a ribber assembly comprising a ribber frame, a ribber dial, and a ribber fin, according to an embodiment.

FIG. 18 is a bottom view of the ribber assembly 34 comprising a ribber frame 35, a ribber dial 37, and a ribber fin assembly 39, according to an embodiment. In an embodiment, the ribber fin assembly 39 can comprise a disc section 39*b* further comprising an arm section 39*a*, wherein a ribber fin section 39*c* can be located at the end of the arm section 39*a*. In an embodiment, the ribber fin section 39*c* can be a ribber fin section 39*c* comprising a position adjuster 41, which can be removably connected to the ribber fin section 39*c* with an adjuster knob 42. The ribber fin section 39*c* and position adjuster 41 can be pressed together wherein the position adjuster 41 can have a first sawtooth array of extrusions 41*a* aligned with and configured to fit into a second sawtooth array of extrusions 39*e* in the ribber fin section 39*c* The position adjuster 41, adjuster knob 42, and the bolt or other connecting means removably connecting them (not shown in FIG. 8), allow the width of the ribber fin section 39*c* to be adjustable, which is discussed further below in FIG. 27. In FIG. 18, the ribber fin section 39*c* and position adjuster 41 are adjusted so they are pushed all the way together.

In an embodiment, the disc portion 39*b* can be flat and rest against and connect to a bottom 37*a* of the ribber dial 37 and can comprise a hole 39*d* in its center, which can be located at the center vertical axis 55 of the cylinder 9*a* (not shown in FIG. 18). According to an embodiment, a connector bolt (not shown in FIG. 18) can pass through the center hole 39*d* in the disc 39*b* and through a center hole of the same size (not shown in FIG. 18) in the ribber dial 37 connecting the disc 39*b* to the ribber dial 37.

According to an embodiment, the ribber fin assembly 39 can, in its most basic form, comprise an arm extending from the central axis of the CSM 1000 parallel to the ribber dial 37 with a protrusion connected at 90 degrees to the end of this arm wherein the protrusion extends downward from the arm and it parallel to the inner wall 9*t* of the cylinder 9*a* such that the ribber fin assembly 39, through this protrusion can come into contact with the ribber stop 40 (not shown in FIG. 18). In an embodiment, the ribber fin assembly 39 can have the same radius as—and be aligned with—the outer circumference of the ribber dial 37 such that the outer edge of the arm 39*a* can be located just inside the bottom edge of the ribber dial 37. A configuration such as this allows space for knitted fabric (not shown in FIG. 18) to pass between the outer edge of the projection 39*a* and the rim 9*h* of the cylinder 9*a* (not shown in FIG. 18.)

When the ribber fin assembly 39 is secured to the ribber dial 37 with a bolt (not shown in FIG. 18) through the hole 39*d* in the ribber fin arm 39*a*, and the connector bolt (not shown in FIG. 18) is inserted through the center hole 39*d* that goes through both the disc 39*b* and ribber dial 37, the ribber fin assembly 39 and ribber dial 37 can rotate as one assembly. According to an embodiment, the bottom of each ribber dial 37 can be engraved with a label identifying the number of ribber needles it can hold and the type of cylinder to which it corresponds, such as "C30" in this view.

Figure 19:
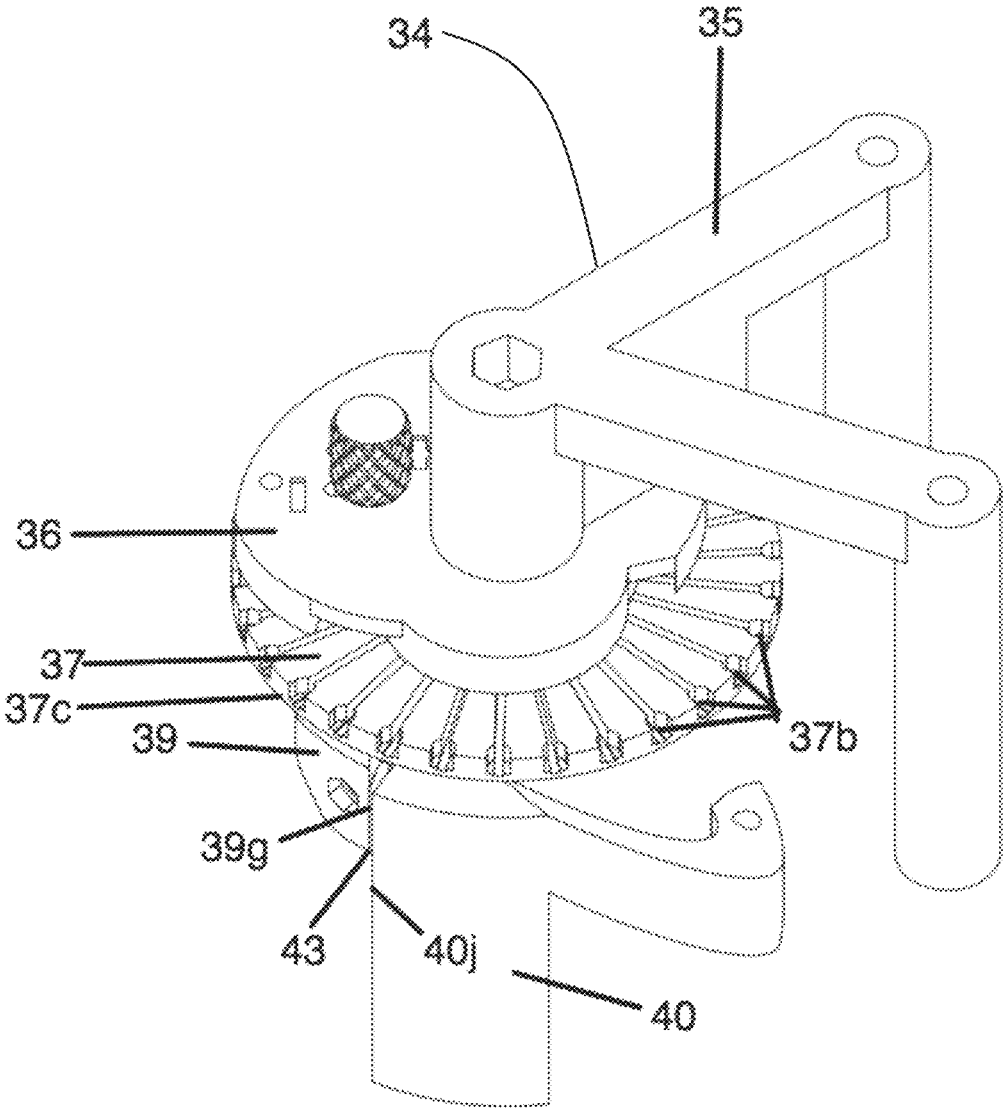
FIG. 19 is a partial top and side perspective view of a ribber assembly comprising a ribber frame, a tappet plate, a ribber dial, and a ribber fin, as well as a ribber stop, according to an embodiment.

FIG. 19 is a top and side perspective view of the ribber assembly 34, comprising a ribber frame 35, a tappet plate 36, a ribber dial 37, and a ribber fin assembly 39, as well as a ribber stop 40 according to an embodiment. When the ribber stop 40 is installed in the cylinder 9*a* (not shown in FIG. 19), and the ribber frame 35 is secured to the camshell 2 (not shown in FIG. 19,) the ribber stop 40 can push against the ribber fin assembly 39, which can be secured to the bottom of the ribber dial 37. Thus, as the cylinder 9*a* (not shown in FIG. 19) is turned, the ribber stop 40 pushes the ribber fin assembly 39, which turns the ribber dial 37 at the same rate as the cylinder so the ribber dial needle slots 37*b* can remain aligned with the cylinder needle slots 9*c* (not shown in FIG. 19.)

According to an embodiment, the position adjuster 41 comprising the ribber fin section 39*c* of the ribber fin assembly 39 can be aligned with the straight side 40*j* (shown in FIG. 19) of the ribber stop 40, and the ribber fin section 39*c* can extend low enough so that the lower three quarters of a straight edge 39*g* section of the position adjuster 41 can abut against a straight side 40*j* at the top of the ribber stop 40 at a connection point 43. As mentioned above, there can be sufficient space between the ribber fin assembly 39 and the ribber stop 40 to allow the ribber dial 37 to rotate with the cylinder 9*a* (not shown in FIG. 19) while also allowing knitted fabric (not shown in FIG. 19) to pass between the ribber fin assembly 39 and ribber stop 40. In an embodiment, the knitted fabric (not shown in FIG. 19) comes off the rim 9*h* of the cylinder 9*a* (not shown in FIG. 19) and off edge of the ribber dial 37, down the outside of the ribber fin assembly 39, and in between the ribber fin assembly 39 and the ribber stop 40 where they connect 43, and over the top 40*d* of the ribber stop 40 into the center of the cylinder 60 (not shown in FIG. 19) below the ribber dial 37. When the ribber is in use, the fabric (not shown in FIG. 19) is sandwiched between the ribber fin assembly 39 and ribber stop 40 and constantly flowing down between them. The force of the ribber stop 40 pushing against the ribber fin assembly 39 can retain enough tension to keep the ribber dial 37 aligned relative to the cylinder (not shown) while also allowing the fabric (not shown in FIG. 19) to pass through. In the current perspective, the left edge of the ribber fin section 39*c* of the ribber fin assembly 39 can be curved so as to not catch on the ribbed fabric, as described further in FIG. 27 below.

According to an embodiment, the needle slots 37*b* in the ribber dial 37 must remain aligned with the needle slots 9*c* in the cylinder 9*a* (not shown in FIG. 19), as described further in FIG. 28 below. The bolt hole (not shown in FIG. 19) in the bottom of the ribber dial 37 that secures the ribber fin assembly 39 to the ribber dial 37 can be positioned to align the ribber dial needle slots 37*b* with the cylinder needle slots 9*c* (not shown in FIG. 19), taking into account the thickness of the fabric (not shown in FIG. 19) to create a consistent horizontal distance between the ribber fin assembly 39 and ribber stop 40 at the connection point 43.

Figure 20:
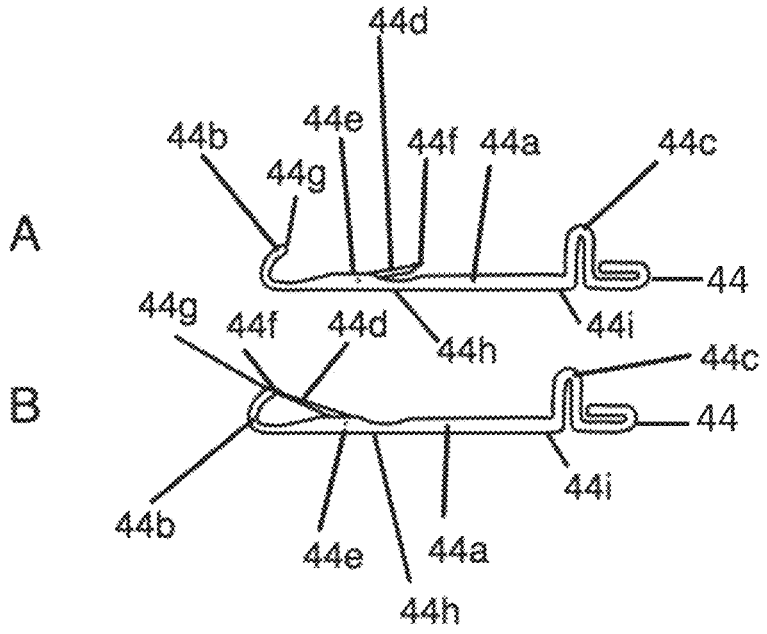
FIG. 20 is a side view of two prior art short-butt ribber needles: one with an open latch and one with a closed latch.

FIG. 20 is a side view of two prior art ribber needles 44, wherein in view "A" the ribber needle 44 is shown with a ribber needle latch 44*d* in an open position and in view "B" the ribber needle 44 is shown with a ribber needle latch 44*d* in a closed position. Both ribber needles 44 comprise the same parts, including a shaft 44*a* having a first end 44*h* and a second end 44*i*, wherein with a curved hook 44*b* comprising a tip 44*b* is connected to the first end 4*h* and the ribber needle butt 44*c* can be connected to the second end 44*i* and the ribber needle latch 44*d* latch can be pivotably connected to the shaft 44*a* by a hinge 44*e* at a point on the shaft 44*e* wherein when ribber needle latch 44*d* is in the closed position, and the latch tip 44*f* is in connection with the tip 44*g* of the hook 44*b*, as shown in view "b." Note that both the curved hook 44*b* and the ribber needle butt 44*c* can extend outward from the shaft 44*a* and both are located in the same vertical plane, perpendicular to the ribber dial 37.

Figure 21:
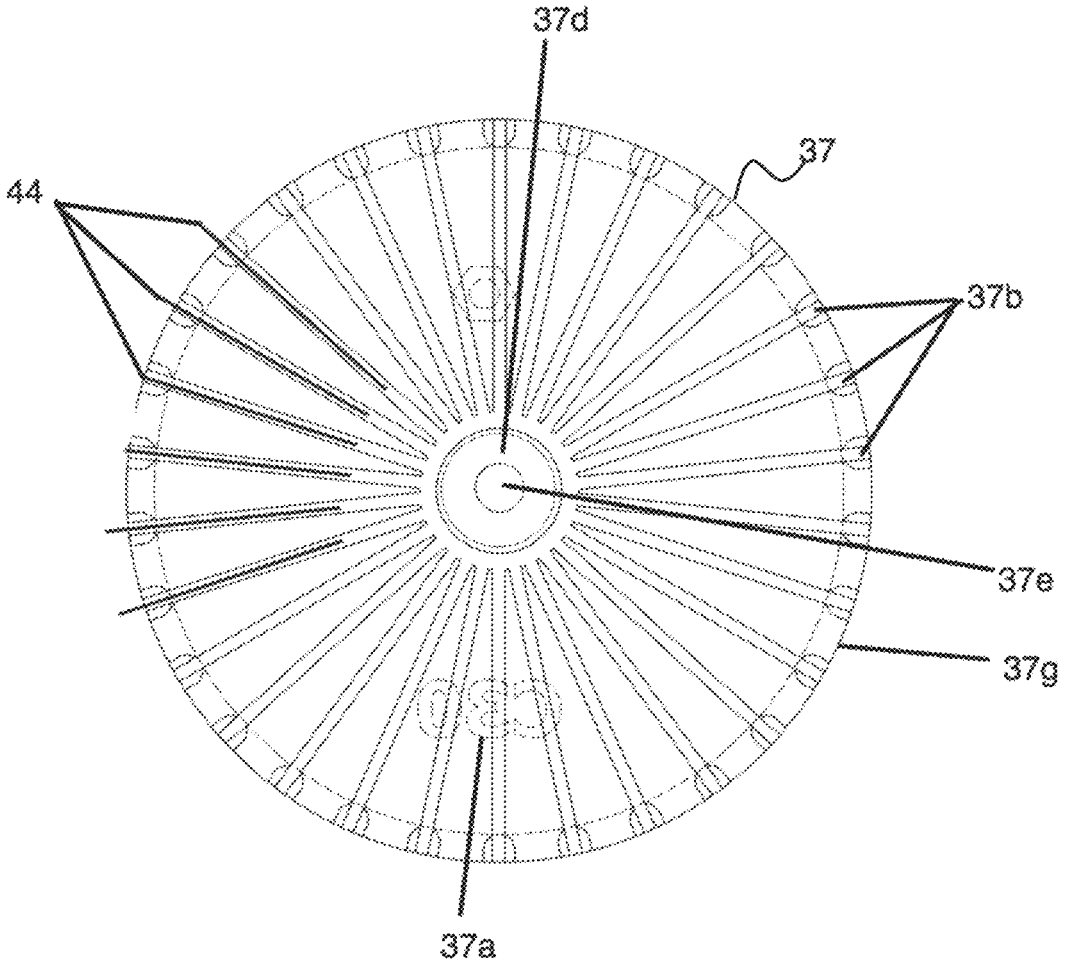
FIG. 21 a top view of a ribber dial comprising six short-butt ribber needles to illustrate how each short-butt ribber needle rests in a ribber needle slot, according to an embodiment.

FIG. 21 is a top view of a ribber dial 37 holding six ribber needles 44, each resting in a ribber needle slot 37*b*, according to an embodiment. The ribber dial 37 can comprise a circular disc that includes a number of needle slots 37*b* each evenly spaced and extending radially from at or near the center point 37*e* to the outer circumference 37*g* of the ribber dial 37. In an embodiment, each needle slot 37*b* can be slightly wider than the width of each ribber needle 44 so that each ribber needle 44 can slide back and forth within the needle slot 37*b* from near the center point 37*e* to the, and slightly past the outer circumference 37*g* of the ribber dial 37 and each opening 370 of each needle slot 37 without creating excess friction between each ribber needle 44 and the needle slot 37*b* holding it. According to an embodiment, each needle slot 37 can hold a ribber needle 44 such that the ribber needle butt (not shown in FIG. 21) faces up and away from the ribber dial 37, and thus, each ribber needle butt 44*c* (not shown in FIG. 21) can be in a plane perpendicular to the plane of the ribber dial 37. The number of ribber needle slots 37*b* in a ribber dial 37 can vary, but a ribber dial 37 cannot have so many needle slots 37*b* that the ridges between the slots 37*b* become too thin to be structurally sound.

According to an embodiment, the ribber dial 37 can comprise a hole at or near the center point 37*e* in which a bearing 37*d* can be inserted; the bearing 37*d* can allow the ribber dial 37 to spin freely when rotating around a connector bolt (not shown in FIG. 21) that can be inserted through the center of the bearing 37*d*.

In an embodiment, the radius of the ribber dial 37 must be long enough to allow each ribber needle 44 to pull back far enough under the tappet plate 36 (not shown in FIG. 21) to form a stitch (not shown in FIG. 21) without the end of each ribber needle 44 hitting the connector bolt (not shown in FIG. 21) running through the hole at the center point 37*e*. In an embodiment, the radius of the ribber dial 37 can be slightly shorter than the radius of the cylinder 9*a* (not shown in FIG. 21) that will be used with the ribber dial 37 so as to have room for the knitted fabric (not shown in FIG. 21) to flow down between the rim 9*h* of the cylinder 9*a* (not shown in FIG. 21) and the outer circumference 37*g* of the ribber dial 37 into the cylindrical inner opening 60 of the cylinder 9*a* (not shown in FIG. 21.)

Figure 22:
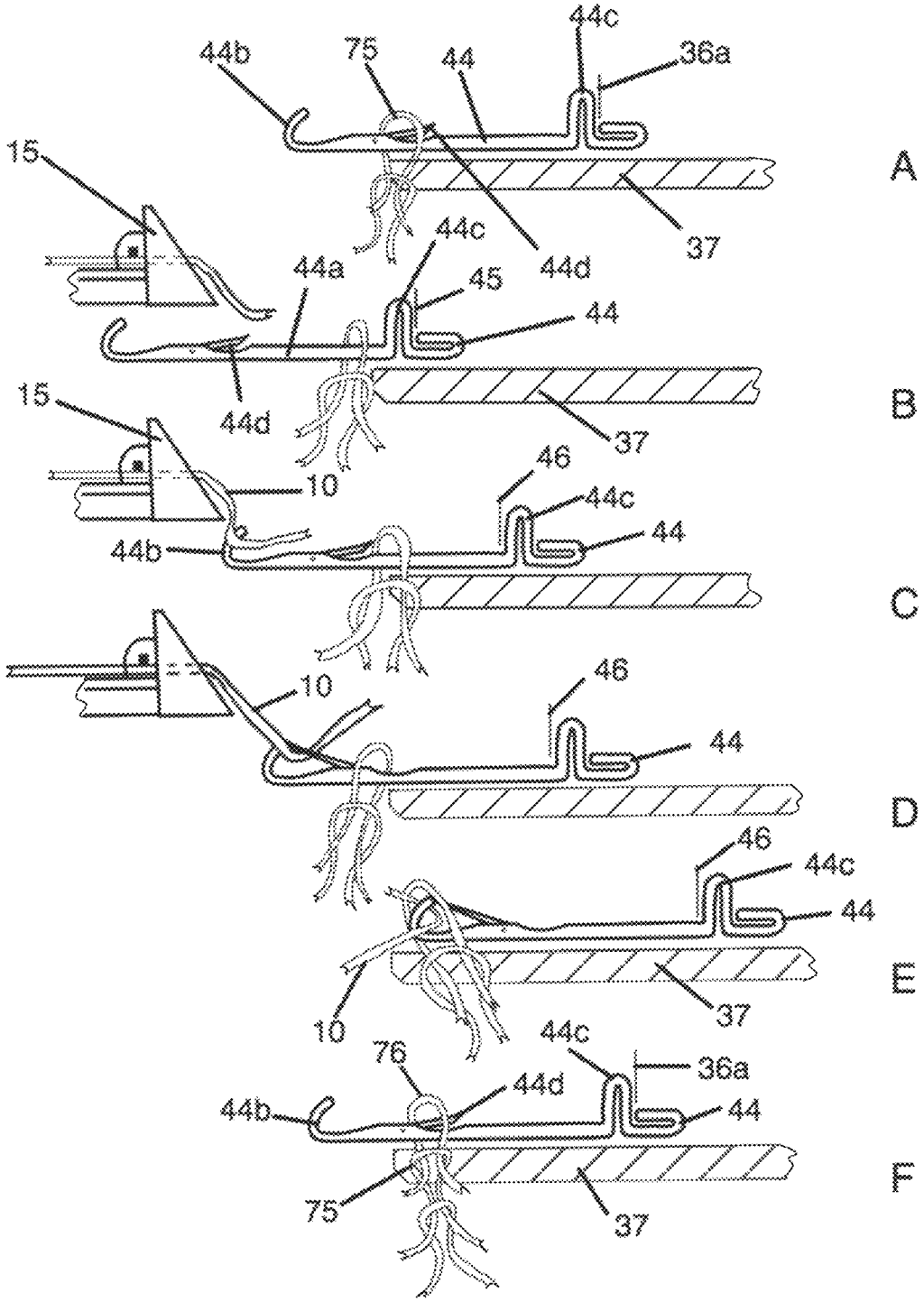
FIG. 22 comprises six views, A thru F, which are each side views of a short-butt ribber needle, resting on a ribber dial, shown as a cutaway, comprising a ribber assembly showing how a ribber stitch can be created in six steps using the short-butt ribber needle in the ribber assembly, according to an embodiment.

FIG. 22 comprises six side views of a ribber needle 44 mounted on a ribber dial 37, shown as a cross-section creating a ribber stitch 76 in six steps, beginning with view "A" and ending with view "F", according to an embodiment.

In view "A", a ribber needle 44 is shown with a first stitch 75 hanging around the open latch 44*d*. This is the position of the needle 44, latch 44*d*, and stitch 75 when the ribber needle butt 44*c* is against the resting area 36*a* of the tappet plate 36, the position of which is represented by a line in view "A" and will be described more fully in FIG. 23 below. In an embodiment the hook 44*b* of the ribber needle 44 can extend beyond the outer circumference 37*g* of the ribber dial 37 (partially shown as a cutaway in view "A".)

In view "B" the ribber needle butt 44*c* has traveled forward, and the stitch 75 is on the shaft 44*a* between the open needle latch 44*d* and the needle butt 44*c*. In this view, the ribber needle 44 is partially under the tappet plate (not shown in FIG. 22*b*) and the needle tip 44*b* has been pushed out beyond the edge of the ribber dial 37 (partially shown in FIG. 22*b*) by the in/out cam 45, the position of which is represented by a line in view "B" and will be described more fully in FIG. 23 below, until the front of the ribber needle 44, including the hook 44*b* is located under the yarn carrier top 15.

In view "C" the ribber needle 44 has reached the midpoint of the yarn carrier top 15 and working yarn 10 has been caught by the top hook 44*b* of the ribber needle 44. In this embodiment, the needle butt 44*c* has started to be pulled back toward the center point 37*e* by the ribber cam 46, the position of which is represented by a line in view "C" and will be described more fully in FIG. 23.

In view "D" the ribber needle 44 continues to be moved back toward the center point 37*e* and the stitch 75 that is around the ribber needle 44 has moved the ribber needle latch into its closed position wherein the needle latch 44*d* has closed around the working yarn 10. In this embodiment, the ribber needle 44 has been pulled back even farther by the ribber cam 46, the position of which is represented by a line in view "D" and will be described more fully in FIG. 23.

In view "E" the ribber needle 44 has pulled the working yarn 10 completely through the first stitch 75 that was previously around the needle 44 in FIG. 22 in views "A" through "E". In view "E" the ribber needle 44 can be located completely under the tappet plate (not shown in view "E") and the ribber needle butt 44*c* has traveled to the point closest to the central vertical axis 55 and the furthest point from the edge of the ribber dial 37 (partially down in FIG. 22*e*) by the ribber cam 46.

In view "F" the ribber needle 44 has traveled back to the same position as shown in view "A", which is against the resting area 36*a* of the tappet plate 36, which is represented by a line in view "F" and will be described more fully in FIG. 23 below but now a second stitch 76 is resting around the needle's open latch 44*d* and the first stitch 75 has fallen off the tip of the needle 44*b* and is hanging below the second stitch 76.

Figure 23:
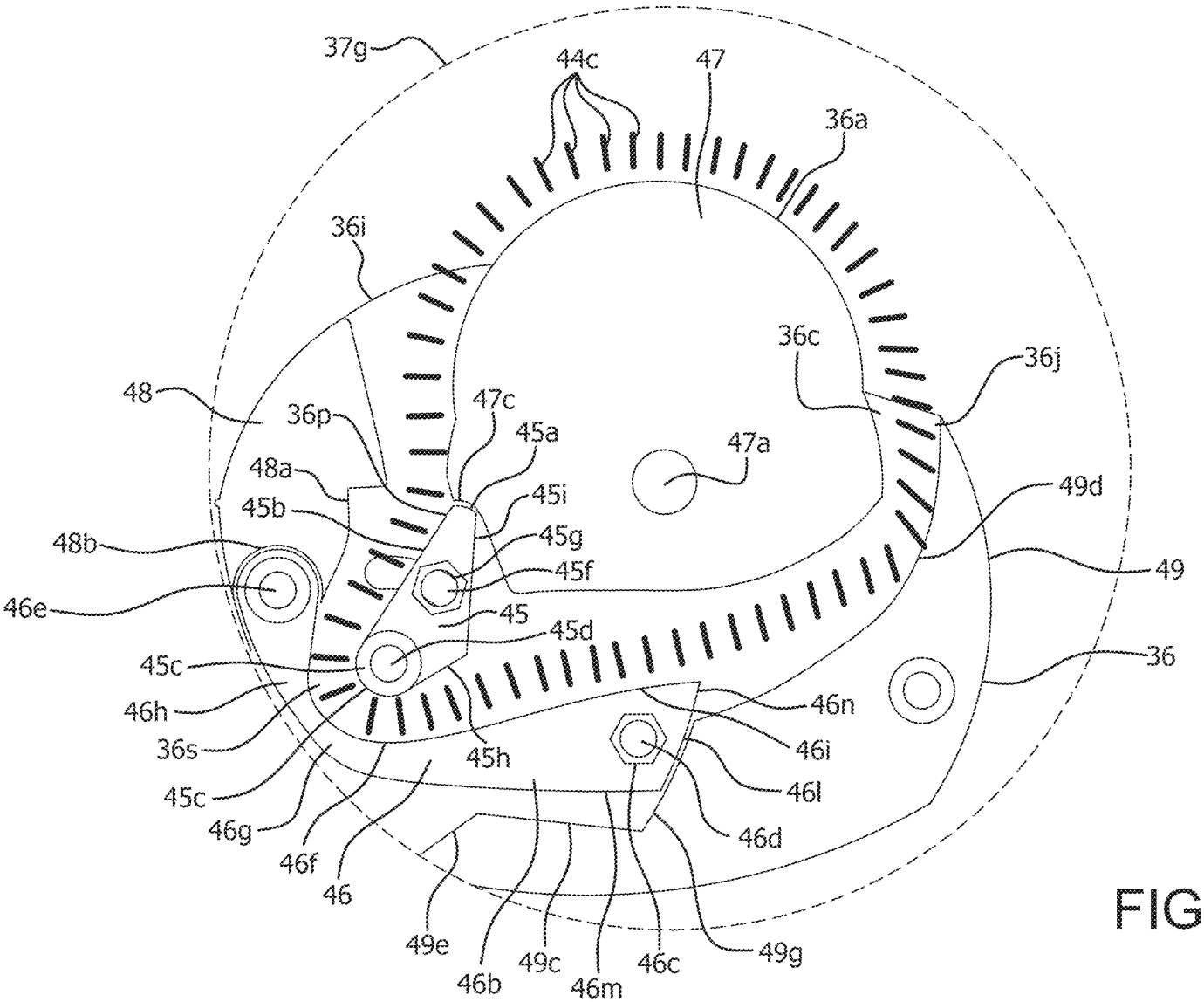
FIG. 23 is a bottom view of a tappet plate loaded with short-butt needles, wherein the needle butts are represented by short, thick lines traveling through a ribber cam track wherein the in/out cam is in an in-work position, and the butt of each short-butt needle is allowed to travel through a ribber cam system, according to an embodiment.

FIG. 23 is a bottom view of a track and cam system as part of a ribber assembly 34, wherein the track and cam system comprises a tappet plate 36, a ribber cam 46, an in/out cam 45 rotated toward a center hole 47*a* in this view, and ribber needle butts 44*c* traveling through the track and cam system, which are each represented by short thick lines, according to an embodiment.

In this embodiment, the bottom side of the tappet plate 36 (not shown in FIG. 23) can comprise a track 36*c* through which each ribber needle butt 44*c* can travel when the ribber dial 37 (shown in a transparent view in FIG. 23) is rotated in a clockwise direction when viewed from the top but which is shown in a counterclockwise direction in FIG. 23 as the movement is viewed from the bottom in FIG. 23. In an embodiment, a ribber assembly (not fully shown in FIG. 23) can comprise a tappet plate 36 in contact or close proximity to the top of the ribber dial 37 (shown in transparent view in FIG. 23.) When ribber needles 44 (not fully shown in FIG. 23) are mounted in the ribber dial slots 37*b* (not shown in FIG. 23), the ribber needle butts 44*c* can extend up and into the tappet plate track 36*c*. In an embodiment, the tappet plate track 36*c* can be framed by a combination of raised sections in the tappet plate 36 itself (including the center raised section 47, the left raised section 48, and the right raised section 49) and two moveable cams (the ribber cam 46 and in/out cam 45), all of which can be the same or similar height, as described in FIG. 25 below so long as the height of each allows the ribber needle butts 44*c* (not shown in FIG. 23*a*) that protrude above the top of the ribber dial (not shown in FIG. 23*a*) to pass through the tappet plate track 36*c*.

According to an embodiment, the center raised section 47 of the tappet plate 36 can contain a hole 47*a*, through which a connector bolt (not shown in FIG. 23) can be inserted.

According to an embodiment, the ribber assembly 34 (not shown in FIG. 23) can be actuated when both the cylinder 9*a* (not shown in FIG. 23*a*) and the ribber dial 37 (not shown in FIG. 23*a*) are rotated clockwise. In the current view, the ribber needle butts 44*c* can move through the tappet plate 36 in a counterclockwise direction around the center raised section 47. In an embodiment, the resting edge 36*a* of the tappet plate 36*a* can be the area between the entry point 36*i* of the tappet plate track 36*c* to the and exit point 36*j* of the tappet plate track 36*c* and when the ribber needle butts 44*c* travel against the resting edge 36*a*, they are not located under the tappet plate 36, according to an embodiment.

According to an embodiment, the ribber needle butts 44*c* can travel from an entry point 36*i*, between the center raised section 47 and the left raised section 48 and then to a tip 45*a* of the in/out cam 45 and along the long base side 45*b* of the in/out cam 45. In the embodiment shown in FIG. 23, the shape of the in/out cam can be somewhat triangular in shape, in which there can be a long base side 45*b* and short back side 45*h* and middle side 45*i*. In the current perspective, an anchor corner 45*c* can be a rounded corner 45*c* where the long base side 45*b* meets the short back side 45*h*. In an embodiment, an anchor bolt hole 45*d* can be located near the anchor corner 45*c* where the in/out cam 45 can be pivotably attached to the tappet plate 36.

According to an embodiment, a small tip 45*a* can be located where long base side 45*b* meets the middle side 45*i* of the in/out cam 45, which is also rounded can be rotated to allow the tip 45*a* to press against an indented curve 47*c* in the center raised section 47 of the tappet plate 36 in an "in-work position." Alternatively, the in/out cam 45 can be rotated to the left in the current perspective (but not shown as rotated in FIG. 23) to allow the tip 45*a* to press against an indented corner 48*a* in the right-side of the left raised section of the tappet plate 48 in an "out-of-work position."

With the tip of the in/out cam 45*a* resting against the center raised section 47 of the tappet plate 36 in the in-work position, as shown in FIG. 23, the ribber needle butts 44*c* can travel along the long base side 45*b* of the in/out cam 45 toward the anchor corner 45*c*, according to an embodiment. In an embodiment, the tip 47*c* of the curved indentation in the left-side of the center section of the tappet plate can protrudes slightly more to the left in the current perspective than the left corner of the in/out tip 45*a*, allowing needle butts 44*c* to continue along the track 36*c* without getting caught in the small gap 36*p* between the center section 47 and the in/out cam tip 45*a*. Opposite that small gap 36*p*, on the left-side of the track 36*c*, the right edge of the small raised section 48 can be shaped to direct each ribber needle butt 44*c* toward the long base side 45*b* of the in/out cam, according to an embodiment.

In an embodiment, when each ribber needle butt 44*c* travels to the end of the anchor corner 45*c*, which is the farthest point away from the center point 47*a* of the tappet plate 36, the tip of each ribber needle 44 (not shown in FIG. 23) can be moved forward to create a rib stitch 75 (not shown in FIG. 23) to slide down the shaft 44*a* of each ribber needle 44 (not shown in FIG. 23) and off the end of the closed latch 44*b* (not shown in FIG. 23), but as described in view "B" of FIG. 22 above.

According to an embodiment, after each ribber needle butt 44*c* passes the anchor corner 45*c* it then contacts the inner curve 46*f* of the center bend 46*g* of the ribber cam 46. In an embodiment, the shape of the ribber cam 46 can be similar to a J with a center bend 46*g*, a short leg 46*h* extending up and toward the left in the current perspective, and a long leg 46*b* extending to the right, according to an embodiment. At the center bend 46*g* the track 36*c* can be very narrow, leaving just enough room between the anchor corner 45*c* of the in/out cam 45 and the inner curve 46*f* of the ribber cam's center bend 46*g* for each ribber needle butt 44*c* to fit through the track 36*c* without getting stuck, according to an embodiment.

Figure 25:
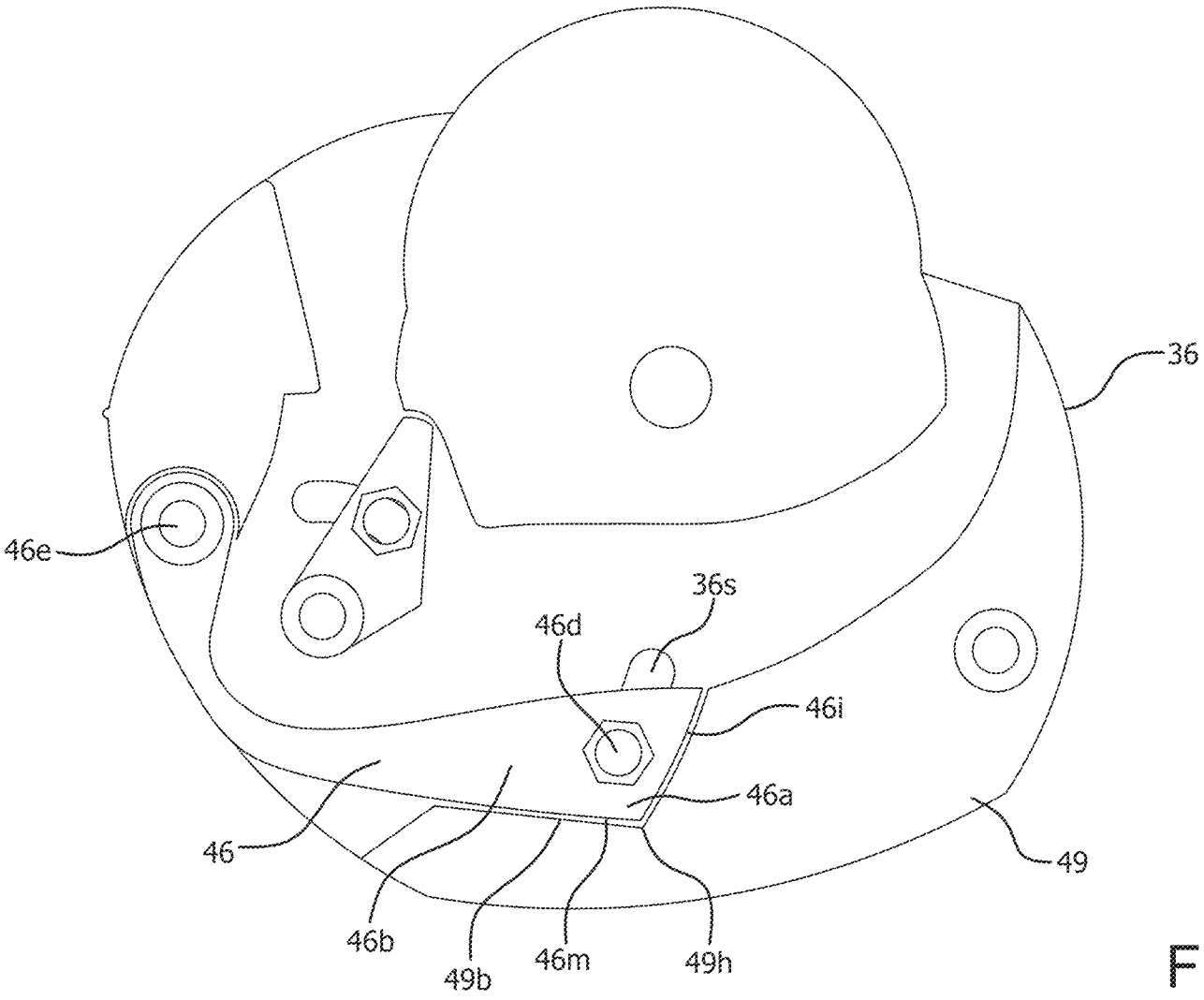
FIG. 25 is a bottom view of a tappet plate comprising a ribber assembly wherein a ribber cam is rotated to its lowest position, according to an embodiment.

According to an embodiment, the ribber cam 46 can be pivotably connected to the tappet plate 36 at or near the anchor bolt hole 46*e* and the position of the ribber cam 46 can be rotated between an up position, as shown in FIG. 23 to a down position as shown in FIG. 25 to at any point in between the up position and the down position. This adjustment allows the user to control how far back each needle butt 44*c* travels toward the center point 47*a* of the tappet plate 36, which determines the length of each rib stitch 75 (not shown in FIG. 23), as described below.

According to an embodiment, the bottom of the left raised section 48 of the tappet plate 36 can comprise a curved cutout 48*b* that fits around the end of the ribber cam's short leg 46*h* with minimal clearance such that the cutout 48*b* can allow the ribber cam 46 to rotate around an anchor bolt 46*e* without interference. The short leg side 46*h* of the in/out cam 45 can be of a sufficient length to allow each ribber needle butt 44*c* to travel through the track 36*c* transitioning from along the side of the in/out cam 45 to the ribber cam 46 after the junction between the ribber cam end 461 and the cutout 48*b* in the small raised section, so as to prevent needle butts 44*c* from getting caught in the gap at the junction 36*p*. Similarly, the inner curve 46*f* of the ribber cam can be smooth and without interruption so each ribber needle butt 44*c* can be pushed effectively around the track 36*c*.

Figure 29:
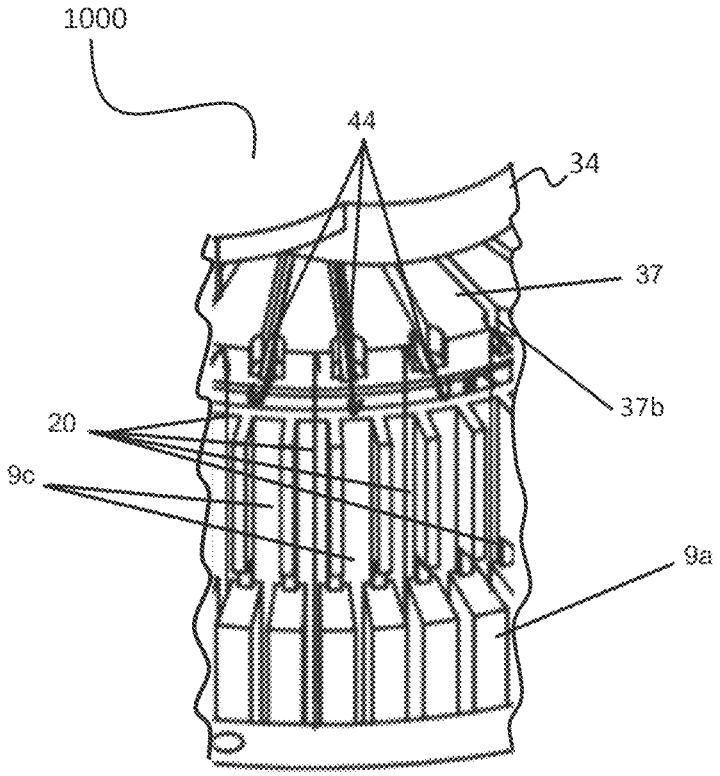
FIG. 29 is a top and side perspective view of a partial section of a cylinder comprising CSM needles and a ribber assembly comprising ribber needles, illustrating how the CSM needles and the ribber needles align, according to an embodiment.

According to an embodiment, an inner curve of the center bend 46*g* can be angled so that each ribber needle butt 44*c* can travel back toward the center point 47*a* of the tappet plate 36 at precisely the right time for each ribber needle hook 44*b* (not shown in FIG. 23) to intersect with the path of the working yarn 10 (not shown in FIG. 23) and grab the working yarn 10 (not shown in FIG. 23) before each ribber needle butt 44*c* travels to a point along the track 36*c* closest to the center point 47*a* of the tappet plate 36 as described further in the description of FIG. 29 below.

According to an embodiment, a lower left edge 49*e* of the right raised section 49 of the tappet plate 36 can comprise a point after which ribber needles 44 (not shown in FIG. 23) have been pulled back sufficiently to allow the needle latches 44*b* of each ribber needle 44 (not shown in FIG. 23) to close. In order to close, the needle latches 44*f* of each ribber needle 44 (not shown in FIG. 23) must rotate until they are straight up, and perpendicular to the needles' shafts (not shown in FIG. 23*b*.) The length of the latch (not shown in FIG. 23*b*) is longer than the length of the ribber needle butt (not shown in FIG. 23*b*.) Therefore, when the ribber (not shown in FIG. 23*b*) is fully assembled, the section of the tappet plate 36 that is over the area where the needle latch (not shown in FIG. 23*b*) is straight up, is high enough to allow the needle latch (not shown in FIG. 23*b*) to freely pass under it. In the current perspective, that means the lower left edge 49*e* of the right raised section 49 cannot be any farther to the left.

The inner edge 46*i* of the ribber cam's 46 long leg side 46, the edge closest to the center point 47*a* of the tappet plate 36, and at the top in the current perspective, increases in width from the center bend 46*g* of the ribber cam 46 to the outer edge of the long leg 46*m*. The long leg side 46*b* can be three to four times as wide at the end 461 as the ribber cam 46 is through the center bend 46*g*. In an embodiment, the end of the long leg 46*b* is almost a straight line; it has a long arc giving it a slight curve. The end 461 is not perpendicular to the long leg 46*b* but rather the top corner 46*n* is angled to the right in the current perspective.

The inner edge of the ribber cam 46 near the end 461, just above the hex bolt hole 46*d*, in the current perspective, determines the length of each rib stitch 75 (not shown in FIG. 23) because it determines how far each ribber needle butt 44*c* travels inward toward the center point 47*a* the needle (not shown in FIG. 23), and therefore how much working yarn 10 (not shown in FIG. 23) is pulled out to make each rib stitch 75 (not shown in FIG. 23.) In an embodiment, as the ribber cam 46 is rotated, the end 461 of the ribber cam 46 can be moved up or down in the current perspective, either closer to the center point 47*a* or farther away from it. The current perspective shows the ribber cam 46 approximately in the middle of its range of rotation.

According to an embodiment, immediately to the right of the long leg end 46*b* of the ribber cam 46, the wall 49*g* of the right raised section 49 can be parallel to the long leg end 461, and there can be just enough space between those two pieces to prevent excess friction between them. Along the lower edge of the tappet plate 36, the right raised section 49*c* continues to the left in this perspective. The ledge 49*c*, which is shaped to fit around the bottom right corner of the ribber cam 46, stops the ribber cam 46 in its lowest position that can still form rib stitches 75 (not shown in FIG. 23.) FIG. 25 below, shows the ribber cam 46 adjusted to its lowest position with the outer edge of the long leg 46*m* resting fully against the ledge 49*c* in the right raised section 49 of the tappet plate 36.

In the long leg of the ribber cam 46*b* near the end 461 there can be a second hole 46*d* perpendicular to the face of the ribber cam 46 that includes a hexagonal cutout 46*c* to place a hex head bolt (not shown in FIG. 23*b*.) There is an oval-shaped cutout (not shown in FIG. 23*b* but discussed below in FIG. 25). The length and placement of the cutout allow the hex head bolt (not shown in FIG. 23*b*) inserted into the second bolt hole 46*d* to fit through the cutout when the ribber cam 46 is rotated either all the way up or down (neither position is shown in FIG. 23.) The hex bolt (not shown in FIG. 23*b*) that goes through the second hole 46*d* in the ribber cam is attached through a knob (not shown in FIG. 23) at the top of the tappet plate (not shown in FIG. 23*b*) that allows the user to secure the ribber cam 46 in position to achieve the desired stitch length (not shown in FIG. 23*b*.)

After the needle butts 44*c* travel along the inner curve 46*f* of the ribber cam 46, the needle butts 44*c* continue through the track 36*c* until they intersect with the left curved wall 49*d* of the right raised section 49 of the tappet plate 36. The left curved wall 49*d* can be angled to create a gentle path for the ribber needle butts 44*c* to travel through the ribber track 36*c* with minimal friction as they pass the exit point 36*j*. The resting edge 36*a* of the tappet plate 36 can be a sufficient distance away from the ribber center 47*a* such that each ribber needle 44 (not shown in FIG. 23) can be pushed forward until the hook 44*b* (not shown in FIG. 23) extends beyond the outer circumference 37*g* of the ribber dial 37 (shown in a transparent view in FIG. 23) and the rib stitch 75 (not shown in FIG. 23) can hang around the needle shaft 44*a* and open latch 44*d* (not shown in FIG. 23) and down over the outer circumference 37*g* of the ribber dial 37 (shown in a transparent view in FIG. 23) as described in view "F" of FIG. 22 above. In an embodiment, the distance from any point along the outer edge of the tappet plate 36 to the center point 47*a* is never longer than the radius of the ribber dial 37 (shown in transparent view in FIG. 23).

In sum, the movement of the ribber needle butts 44*c*, and their respective ribber needles 44, when the in/out cam 45 is in the in-work position, as shown in FIG. 23, begins with each needle butt 44*c* passing through the entry point 36*i* of the ribber track 36*c* between the left raised ribber section 48 and the center raised ribber section 47 then traveling along the long base side 45*b* of the in/out cam 45 and around the anchor corner 45*c*, according to an embodiment. As each needle butt 44*c* travels around the anchor corner 45*c* it also travels between the ribber cam 46 and the anchor corner 45*c*, according to an embodiment. In an embodiment, the ribber cam 46 determines how close the each needle butt 44*c* can move toward the ribber center 47*a*, by which the length of each rib stitch 75 (not shown in FIG. 23) can be controlled.

Each ribber needle butt 44*c* then passes between the center raised ribber section 47 and the right raised section 49 before passing the exit point 36*j*, where each needle butt 44*c* can travel to the resting area 36*a* of the tappet plate 36, before passing back through the entry point 36*i*, and repeating its travel around the ribber track 36*c*, according to an embodiment.

Figure 24:
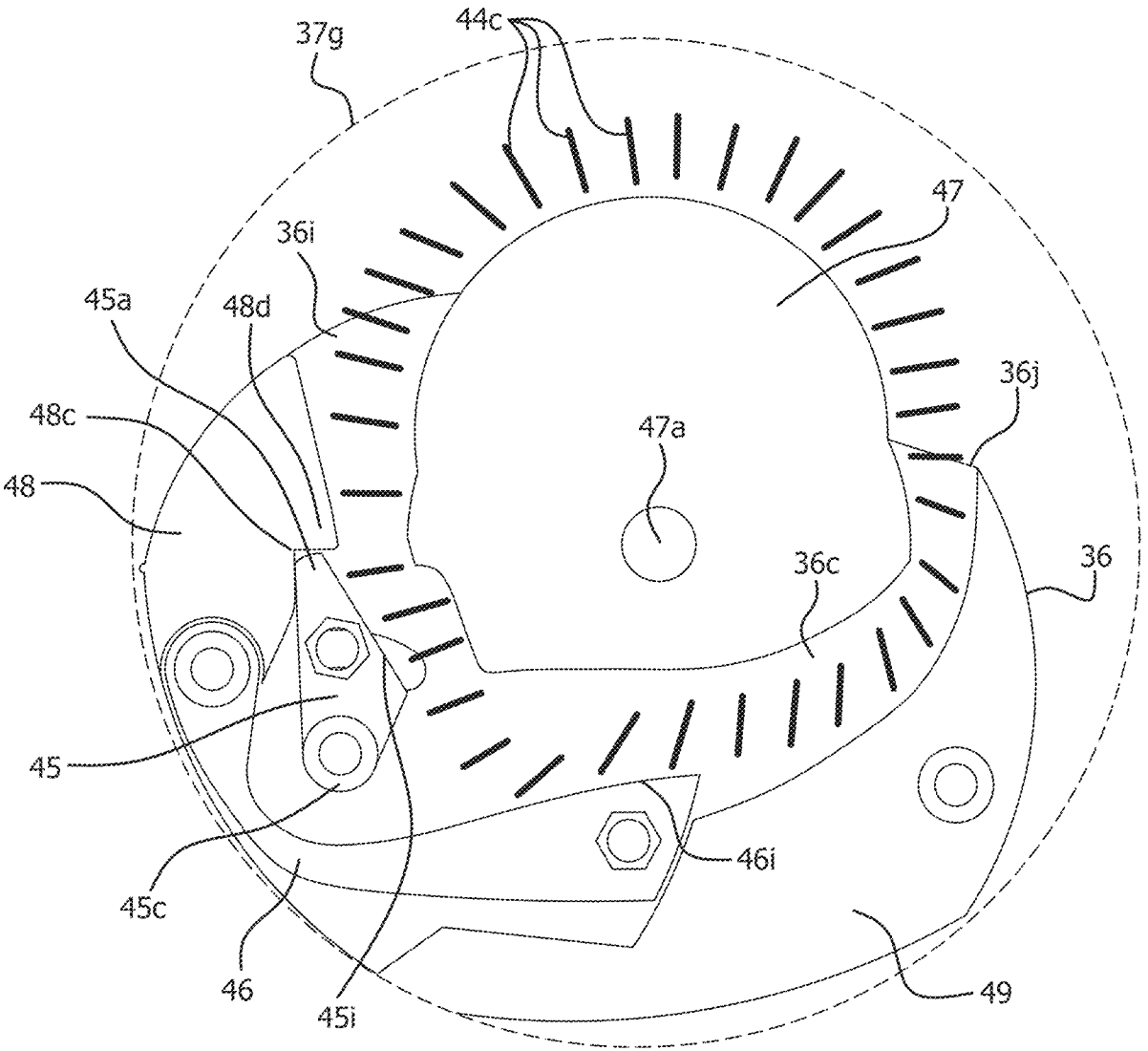
FIG. 24 is a bottom view of a tappet plate loaded with short-butt needles wherein the needle butts are represented by short, thick lines, wherein the tip of the in/out cam is in an out-of-work position, and the butt of each short-butt needle travels around the center raised section of the tappet plate bypassing the left raised section and the in/out cam, according to an embodiment.

FIG. 24 is a bottom view of a tappet plate 36 wherein the tip 45*a* of an in/out cam 45 is rotated away from the ribber center 47*a*, allowing each ribber needle butt 44*c* to travel around the center raised ribber section 47 of the tappet plate 36 bypassing the part of the ribber track 36*c* passing between the left raised ribber section 48 and the right-side 45*i* of the in/out cam 45, placing the ribber assembly 34 in an out-of-work position, according to an embodiment. In this embodiment, the in/out cam 45 can be rotated to the left in the current perspective allowing its tip 45*a* to press against an indent 48*c* in the corner 48*d* of the left raised ribber section 48 (the "out-of-work position"). According to an embodiment, the indent 48*c* in the corner 48*d* of the left raised ribber section 48 can comprise a recess configured to contain the point 45*a* of the in/out cam 45 allowing each ribber needle butt 44*c* to travel to the right edge 45*i* of the in/out cam 45 without getting caught in the gap between the tip 45*a* and the indented corner 48*c*.

After the needle butts 44*c* pass through the entry point 36*i*, they continue along the ribber track 36*c* until directed down the right-side 45*i* of the in/out cam 45 and then the needle butts 44*c* intersect with the inner curve 46*i* of the ribber cam 46 and complete their path between the center raised section 47 and right raised section 49 to the exit point 36*j*. Because the needle butts 44*c* are diverted by the in/out cam 45 and do not travel around the long base side 45*b* of the in/out cam 45 and around the anchor corner 45*c*, the ribber dial 37 (not shown in FIG. 24) can continue to rotate but the needles (not fully shown in FIG. 24) do not extend toward, the yarn carrier 12 (not shown in FIG. 24), nor grab working yarn 10 (not shown in FIG. 24) while in the out-of-work position.

FIG. 25 is a bottom view of a tappet plate 36 wherein a ribber cam 46 has been rotated to its lowest position such that the ribber cam's inner curve 46*f* is flush with the left curved wall 49*d* of the raised section of the tappet plate 49, according to an embodiment. In this embodiment, the outer edge 46*m* and end 461 of the long leg 46*b* of the ribber cam 46 can rest against a bottom left ledge 49*b* of the right raised section of the tappet plate 49 and the shape of the inner corner 49*h* of right raised section 49 can be configured to receive the bottom right corner 46*a* of the long leg 46*b* of the ribber cam 46.

According to an embodiment, the ribber cam 46 can be adjustable from a down position, as shown in FIG. 25, to an up position (not shown in FIG. 25) or any other point between the up position and the down position by pivoting about the anchor bolt 46*e*. The position of the ribber cam 46 can then be fixed in place by use of a bolt 46*d*, or other connecting means, which can extend through the tappet plate 36, an oval-shaped cutout 36*s* in the tappet plate 36 and a bolt hole 46*d* located near bottom right corner 46*a* of the long leg 46*b* of the ribber cam 46. The bolt 46 can move through the oval-shaped cutout 36*s* allowing the ribber cam 46 to move from an up position (not shown in FIG. 25) to a down position or any other point between the up position and the down position, in order to adjust the length of each rib stitch 75 (not shown in FIG. 25) being created.

Figure 26:
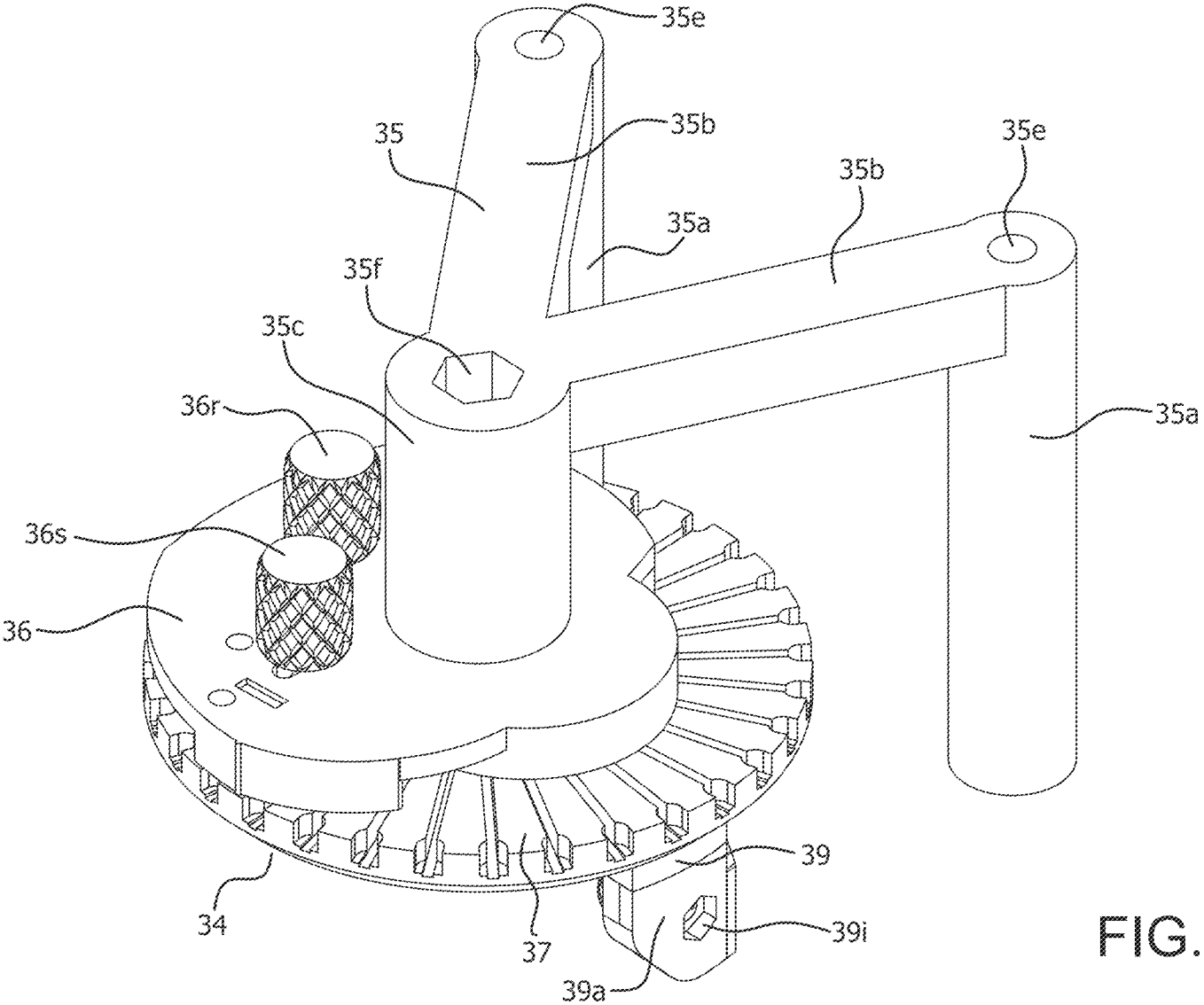
FIG. 26 is a side and top perspective view of a ribber assembly comprising a ribber frame and a tappet plate, two cam knobs, a ribber dial, and a ribber fin, according to an embodiment.

FIG. 26 is a partial side and top perspective view of a ribber assembly 34 comprising a ribber frame 35, a tappet plate 36, an in/out cam knob 36*r*, a ribber cam knob 36*s*, a ribber dial 37, and a partial view of a ribber fin assembly 39, according to an embodiment. In this embodiment, the ribber frame 35 can attach to the camshell 2 (not shown in FIG. 26) securing the ribber assembly 34 to a CSM assembly 100 (not shown in FIG. 26) while also securing the ribber dial 37 and tappet plate 36 in the proper positions and alignments for use. According to an embodiment, a connector bolt (not show in FIG. 26) can be inserted through the ribber dial 37, tappet plate 36, and a center chamber 35*c* of the ribber frame 35. In this embodiment, the center chamber 35*c* of the frame is a flat top cylinder with a sunken hex cutout 35*f* centered in the top for a nut (not shown in FIG. 26) and vertical bolt hole (not shown in FIG. 26) down through the center along the central vertical axis 55 (not shown in FIG. 26) and two arms 35*b* can extend from the top of the center chamber 35*c* and connect to the two cylindrical back posts 35*a*, which can be connected to a camshell 2 through bolt holes 35*e*. According to an embodiment, the ribber frame 35 can work with the ribber assembly shown in FIG. 26 for the narrow-diameter cylinder 9*a* and for a ribber assembly compatible with a wide-diameter cylinder 99*a* neither of which are shown in FIG. 26.

According to an embodiment, the two textured knobs, 36*r* and 36*s*, located on top of the tappet plate 36 can each house embedded bolts (not shown in FIG. 26) to connect to nuts (not shown in FIG. 26) embedded within the in/out cam 45 and ribber cam 46 respectively, neither of which are shown in FIG. 26, wherein knob 36*r* can be used to adjust the position of the in/out cam 45 and the knob 36*s* can be used to adjust the position of the ribber cam 46.

In this view the relative shapes and positions of various parts of the ribber fin assembly 39 can be appreciated, including ribber fin arm 39*a* comprising a sunken hex-shaped opening 39*i* configured to hold a bolt head (not shown in FIG. 26) for a ribber fin adjuster knob 42 (not shown in FIG. 26) located opposite the sunken hex-shaped opening 39*i* on the ribber fin arm 39*a*.

Figure 27:
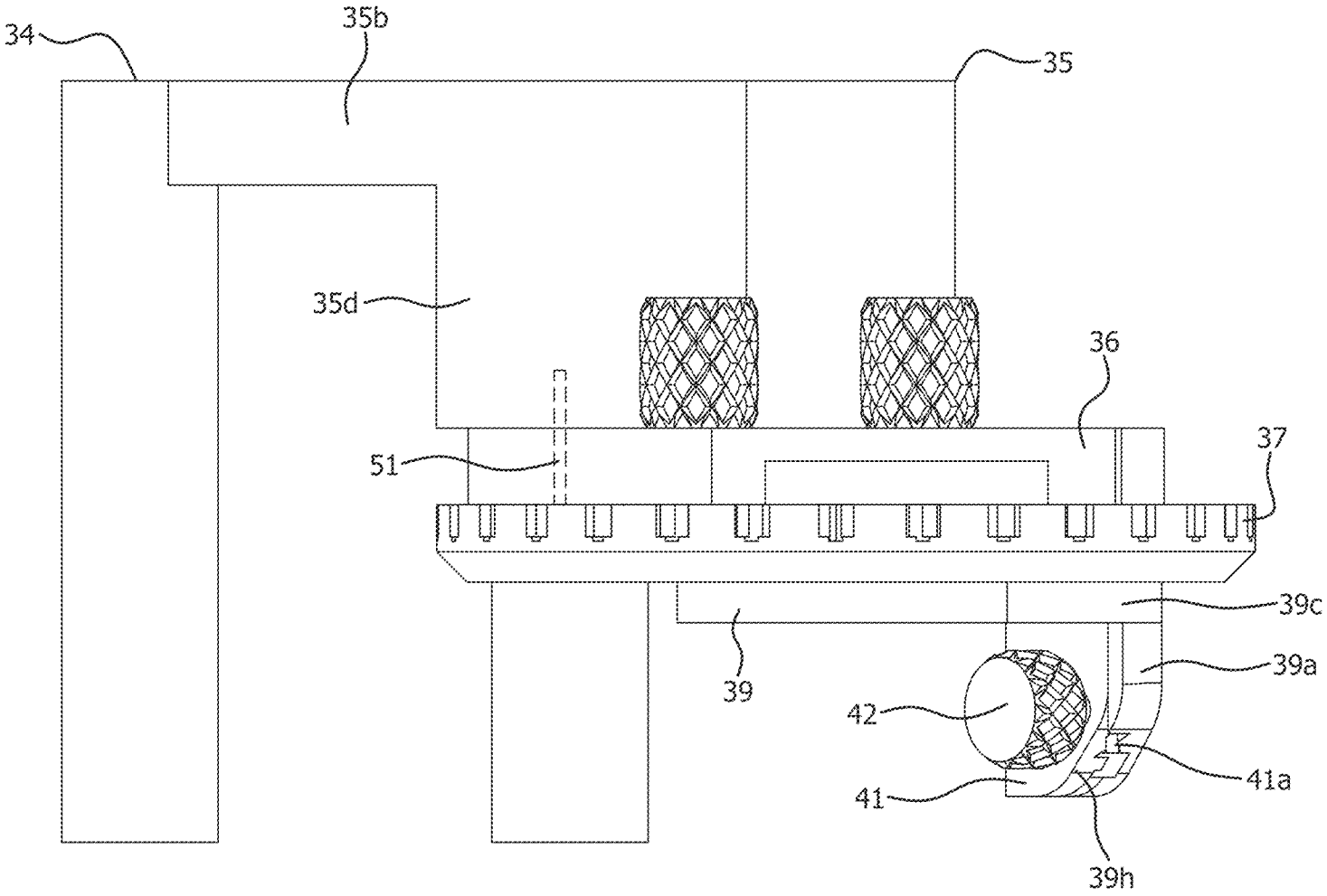
FIG. 27 is a side perspective view of a ribber assembly comprising a ribber frame, a tappet plate, two cam knobs, a ribber dial, a ribber fin, and a ribber fin adjustment knob, according to an embodiment.

FIG. 27 is a side perspective view of a ribber assembly 34 comprising a ribber frame 35, a tappet plate 36, a ribber dial 37, and a ribber fin assembly 39. According to an embodiment, a small bolt 51, shown in a transparent view, can be inserted through the bottom of the tappet plate 36 and up into a nut (not shown in FIG. 27) in the bottom of a box-like projection 35*d* from a ribber arm 35*b* such that the ribber dial 37 can spin freely below the tappet plate 36 while not shifting position in any way.

According to an embodiment, the ribber fin arm 39*a* can extend downward from the arm of ribber fin base 39*c* and comprise a front, bottom corner 39*h* having a curved edge to prevent it from catching on fabric (not shown in FIG. 27) as it flows past the the ribber fin arm 39*a*. In this view, the sawtooth array of extrusions 41*a* for better connection to the adjuster piece 41 can be seen along with their connection and size relative to the ribber fin arm 39*a*, according to an embodiment. In the center of the sawtooth array of extrusions 41*a* running in a plane perpendicular to the central vertical axis 55 (not shown in FIG. 27), there can be an oval channel (not shown in FIG. 27) which allows a bolt (not shown in FIG. 27) and ribber fin adjustment knob 42 to loosen or tighten the connection so to the adjuster piece 41 allowing it to be extended or retracted horizontally be extended. In FIG. 27, the adjuster piece 41 is not extended.

Figure 28:
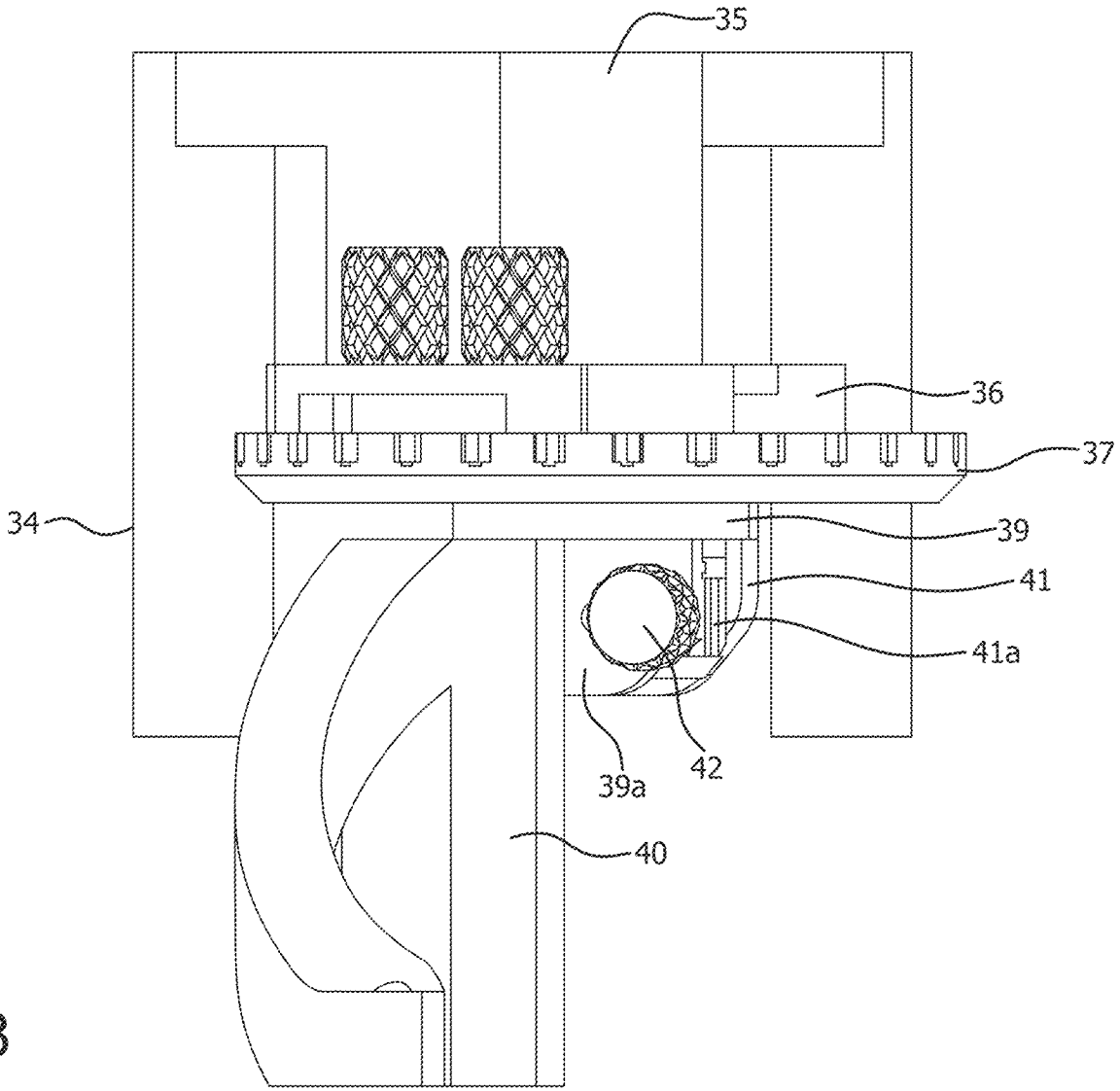
FIG. 28 is a side perspective view of a ribber assembly comprising a ribber frame, a tappet plate, two cam knobs, a ribber dial, a ribber fin, and a ribber stop as it would be mounted to the inner surface of a cylinder (not shown in FIG. 28), according to an embodiment.

FIG. 28 is a partial bottom and side perspective view of a ribber assembly 34 comprising a ribber frame 35, a tappet plate 36, a ribber dial 37, and a ribber fin assembly 39 as well as the ribber stop 40 shown as it would if mounted to the inner surface 9*t* of a cylinder 9*a* (not shown in FIG. 28) with the ribber fin adjuster 39*a* fully extended, according to an embodiment.

In this embodiment, loosening of the ribber fin adjuster knob 42 can allow the user to place the ribber fin arm 39*a* in closer proximity or connection to the ribber stop 40, which can then be secured in place by tightening the ribber fin adjuster knob 42. In an embodiment, a sawtooth array 41*a* can be used to lock the ribber fin arm 39*a* and adjuster piece 41 into position against each other and prevent them from sliding out of position. This capacity to adjust the position of the ribber fin assembly 39 relative to the ribber stop is very important as it allows the user to change the alignment of the ribber needles (not shown in FIG. 28) relative to the CSM needles 20 (not shown in FIG. 28) which prevents the ribber needles 44 (not shown in FIG. 28) from contacting or otherwise interfering with the CSM needles 20 (not shown in FIG. 28) and vice versa.

FIG. 29 is a top and side perspective view of a partial section of a CSM 1000 comprising a cylinder 9*a* loaded with CSM needles 20 and a ribber assembly 34 comprising a ribber dial 37 loaded with ribber needles 44, according to an embodiment. This view illustrates how the CSM needles 20 and ribber needles 44 can be aligned, to function together in a CSM 1000 comprising a ribber assembly 34, according to an embodiment. Specifically, each ribber needle 44 can be centered over a cylinder needle slot 9*c* located directly below it, which does not contain a CSM needle 20, according to an embodiment. In an embodiment, the ribber dial 37 can comprise half as many needle slots 37*b* as the number of needle slots 9*c* in the corresponding cylinder 9*a* allowing for spacing of ribber needles 44 and CSM needles 20 as that shown in FIG. 29, however it is also possible for the ribber dial 37 to comprise the same number of needle slots 37*b* as the number of needle slots 9*c*.

Figure 30:
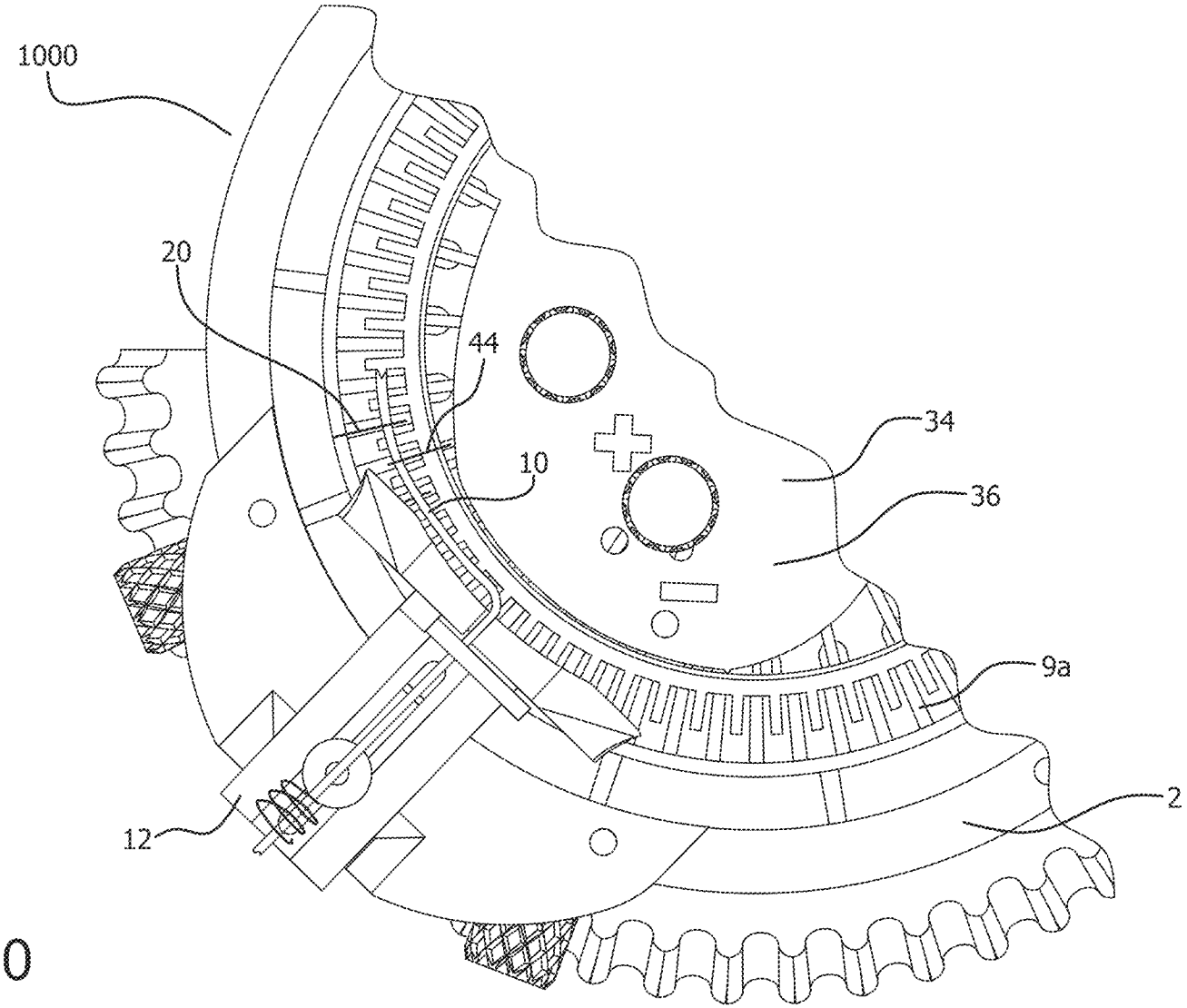
FIG. 30 is a top perspective view of a section of a CSM assembly comprising a camshell, a cylinder holding CSM needles, a yarn carrier with yarn, and a ribber assembly holding ribber needles, all the foregoing illustrating how the CSM needles and the ribber needles grab working yarn from the yarn carrier, according to an embodiment.

FIG. 30 is a top perspective view of a section of the CSM 1000 with the ribber assembly 34 mounted on the camshell 2, which shows how a cylinder needle 20 and a ribber needle 44 can grab working yarn 10 from a yarn carrier 12, according to an embodiment. The center bend 46*g* of a ribber cam 46 (not shown in FIG. 30) can be angled so each ribber needle 44 can travel back toward the ribber center 47*a* (not shown in FIG. 30) at the precise time necessary for the tip 44*g* of the ribber needle hook 44*f* comprising each ribber needle 44 to intersect with the path of the working yarn 10 being fed by the yarn carrier 12 and grab the working yarn 10 before the ribber needle 44 begins its travel back toward the ribber center 47*a*. The placement of the tappet plate 36 in relation yarn carrier 12 and shape of the ribber cam (not shown in FIG. 30 but described above in FIG. 23) can ensure that each ribber needle 44 and each cylinder needle 20 are correctly aligned with the working yarn 10.

Figure 31:
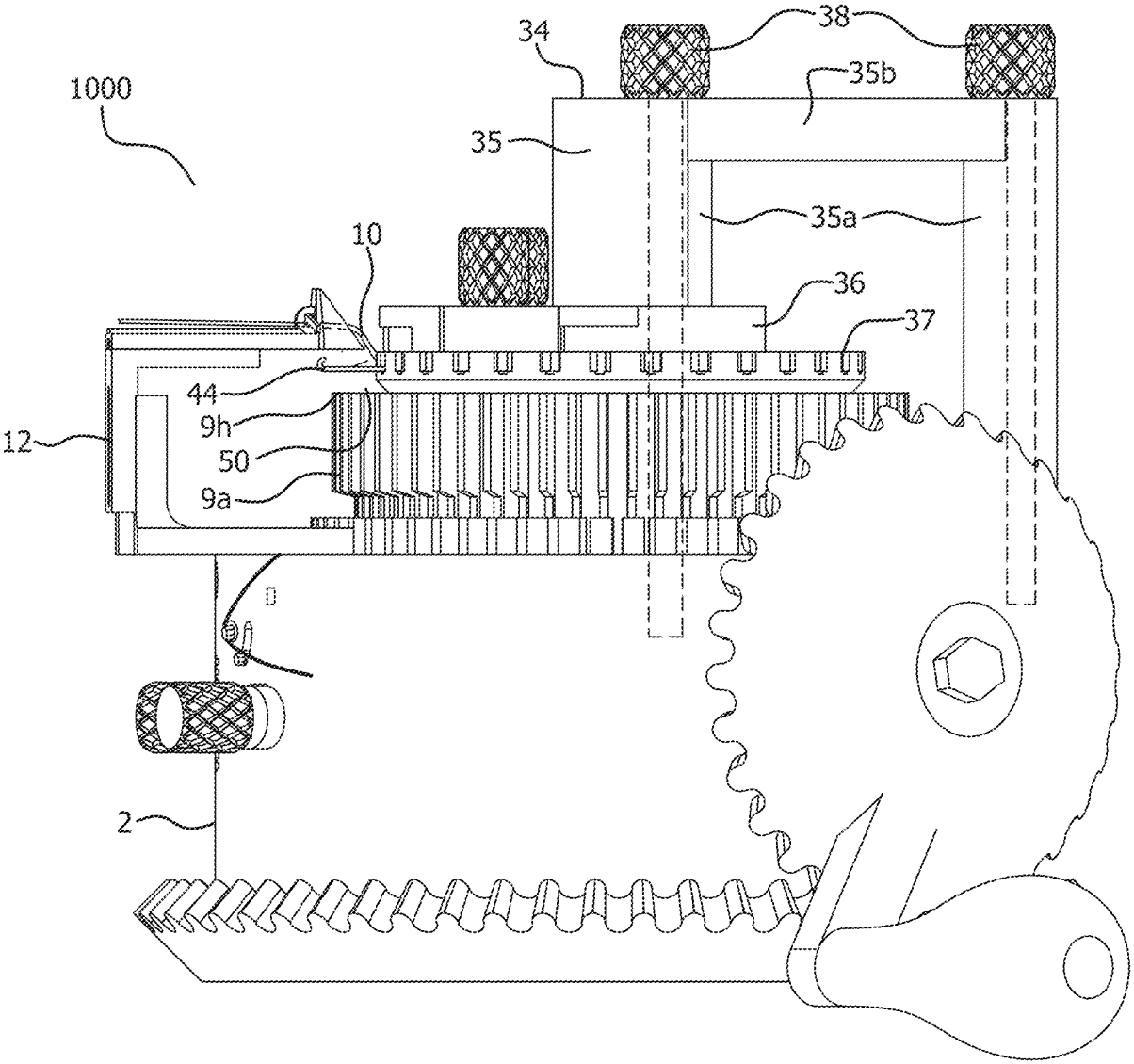
FIG. 31 is a side perspective view of a CSM assembly comprising a camshell, a yarn carrier, and a cylinder, wherein a ribber assembly is mounted to the CSM assembly and the ribber assembly comprises a ribber dial, a tappet plate, and partially transparent view of ribber bolts connecting a ribber frame to the camshell, according to an embodiment.

FIG. 31 is a perspective side view of a CSM 1000 having a ribber assembly 34 mounted onto it, the CSM 1000 comprising a camshell 2, a yarn carrier 12, a cylinder 9*a*, a ribber dial 37, a tappet plate 36, and a ribber frame 35, wherein the ribber assembly mounting bolts 38 are shown in a partially transparent view, according to an embodiment. In this embodiment, ribber frame bolts 38 with textured knobs can be inserted into the legs 35*a* of the ribber frame 35 to connect it to the camshell 2 and ribber frame arm 35*b* can be of a sufficient height so as to allow CSM needles 20 that have been lifted up out-of-work (not shown in FIG. 31) to pass below them without interference. According to an embodiment, the ribber frame 35 can support the ribber assembly above the cylinder 9*a* such that the ribber dial 37 can be held parallel to the top of the cylinder 9*a* and perpendicular to the central vertical axis 55 of the CSM 1000.

According to an embodiment, the radius of the ribber dial 37 can be slightly shorter than the radius of the cylinder 9*a* such that the ribber dial 37 can be located just above and within the circumference of the rim 9*h* of the cylinder 9*a*. In this embodiment, each ribber needle 44 can extend under the bottom of the yarn carrier 12, wherein the bottom of the yarn carrier 12 can allow the working yarn 10 to be held just above each fully extended ribber needle 44, and ensuring each ribber needle 44 can grab working yarn 10. In this embodiment, the newly created ribbed fabric (not shown in FIG. 31) can flow down through a gap 50 between the rim 9*h* of the cylinder 9*a* and the edge of the ribber dial 37 into the cylindrical inner opening 60 of the cylinder 9*a* beneath the ribber dial 37.

Although the present apparatus has been described in terms of exemplary embodiments, it is not limited thereto. Rather, the appended claims should be construed broadly, to include other variants and embodiments, which may be made by those skilled in the art without departing from the scope and range of equivalents of the disclosed apparatus.

What is claimed is:

1. A circular knitting machine, comprising a circular sock machine (CSM) assembly, the CSM assembly comprising:

a cylinder having an inner surface and an outer surface wherein the outer surface comprises a plurality of longitudinal grooves arranged vertically and equally spaced around the outer surface of the cylinder, and wherein the cylinder is configured to be rotated around a vertical axis in either a clockwise direction or a counterclockwise direction;

a plurality of CSM needles, wherein each of the plurality of CSM needles is located within a longitudinal groove and each of the plurality of CSM needles comprises a top end, comprising a curved hook and a latch, and a bottom end comprising a CSM needle butt which at least partially extends beyond the longitudinal groove and the outer surface of the cylinder wherein a shaft connects the top end to the bottom end and the CSM needle butt comprises a surface at the bottom end of each of the plurality of CSM needles which is in a plane perpendicular to a plane of the shaft;

a camshell, comprising an outer surface and an inner surface, and having an inner opening configured to contain the cylinder, a flat bottom shelf upon which the cylinder rests, and a needle track, located above the flat bottom shelf, wherein the needle track is configured such that each CSM needle butt of each of the plurality of CSM needles rests on and slides over the needle track, the needle track also comprising a left needle track ramp and a right needle track ramp; and a cam system comprising a first left cam pivotably connected to the inner surface of the camshell and located above the left needle track ramp, a second left cam located below the first left cam and above the left needle track ramp, a first right cam pivotably connected to the inner surface of the camshell and located above the right needle track ramp, a second right cam located below the first right cam and above the right needle track ramp, and a middle cam pivotably connected to the inner surface of the camshell and located between the first left cam and the first right cam and also between the second left cam and the second right cam.

2. The circular knitting machine as described in claim 1, further comprising a ribber assembly, the ribber assembly comprising:

a ribber frame configured to mount the ribber assembly to the CSM assembly;

a ribber dial having a center located on the vertical axis and mounted in a plane perpendicular to the plane of the vertical axis and centered above the cylinder opening, such that the center of the ribber dial aligns with the center of the cylinder, wherein the vertical axis passes through both the center of the ribber dial and the center of the cylinder, and wherein the ribber dial comprises a top surface, the top surface further comprising a plurality of grooves extending radially from its center to an outer circumference of the ribber dial;

a plurality of ribber needles, wherein each of the ribber needles is located within a respective radial groove and each of the ribber needles comprises a top end, comprising a curved hook and a latch, and a bottom end comprising a ribber butt which at least partially extends beyond each of the ribber needle's respective radial groove and the top surface of the ribber dial, wherein a shaft connects the top end to the bottom end and the butt comprises a surface at the bottom end of the ribber needle, which is in a plane perpendicular to the plane of the shaft;

a tappet plate mounted above the ribber dial, and connected to the ribber frame, such that the ribber dial rotates freely below the tappet plate, and wherein the tappet plate comprises a track, comprising an entry point and an exit point wherein the butt of each of the ribber needles may pass into the track through the entry point wherein each of the ribber needles extends horizontally away from the center of the ribber dial and then retracts horizontally toward the center of the ribber dial before passing the exit point as the butt of each of the ribber needles passes through the track;

at least one ribber stop connected to the inner surface of the of the cylinder; and at least one ribber fin assembly connected to the bottom of the ribber dial configured such that when the cylinder is rotated, the ribber stop also rotates the ribber dial at the same rate as the cylinder by its connection to the ribber fin.

3. The circular knitting machine as described in claim 1, wherein the cylinder is rotatable around the vertical axis in either a clockwise direction or counterclockwise direction within the camshell by a gear system comprising a floor gear and a side gear.

4. The circular knitting machine as described in claim 3, wherein, when the butts of the plurality of CSM needles placed into contact with the needle track, each butt slides over the needle track as the cylinder is turned within the camshell in either a clockwise direction or counterclockwise direction by the gear system.

5. The circular knitting machine as described in claim 4, wherein, when the cylinder is rotated in a clockwise direction, the butt of each of the plurality of CSM needles travels up a sloped ramp comprising the first left cam configured to direct the butt of each of the plurality of CSM needles upward, from left to right, and prevent the butt of each of the plurality of CSM needles from traveling down the left needle track ramp and under the second left cam when the first left cam is in a down position, and wherein the middle cam has an elongated triangular shape comprising a left-side angled surface and a right-side angled surface, wherein the left-side angled surface is configured to direct the butt of each of the plurality of CSM needles that has traveled upward, from left to right, along the left-side top edge of the first left cam, downward, from left to right, toward the second right cam when the middle cam is in a right-pointing direction, and wherein the butt of each of the plurality of CSM needles that has traveled downward, from left to right, along the left-side angled surface of the middle cam, is then further directed below the second right cam, to the right needle track ramp.

6. The circular knitting machine as described in claim 4, wherein, when the cylinder is rotated in a counterclockwise direction, the butt of each of the plurality of CSM needles travels up a sloped ramp comprising the first right cam configured to direct the butt of each of the plurality of CSM needles upward, from right to left, and prevent the butt of each of the plurality of CSM needles from traveling down the right needle track ramp and under the second right cam when the first right cam is in a down position, and wherein the middle cam has an elongated triangular shape comprising a left-side angled surface and a right-side angled surface, wherein the right-side angled surface directs the butt of each of the plurality of CSM needles that has traveled upward, from right to left, along the sloped ramp of the first right cam, downward, from right to left, toward the second left cam when the middle cam is in a left-pointing direction, and wherein the butt of each of the plurality of CSM needles that has traveled downward, from right to left, along the right-side angled surface of the middle cam, is then further directed downward, from right to left, below the second left cam and to the left needle track ramp.

7. The circular knitting machine as described in claim 3, wherein the side gear is configured to be turned by a hand crank.

8. The circular knitting machine as described in claim 3, wherein the floor gear is connected to the cylinder so that the floor gear and the cylinder rotate, either clockwise or counterclockwise, as the camshell remains stationary.

9. The circular knitting machine as described in claim 5, wherein the second right cam and second left cam are raised to decrease a length of each stitch or lowered to increase the length of each stitch.

10. The circular knitting machine as described in claim 9, wherein the height of the second left cam and second right cam are configured to be measured using a second cam gauge.

11. The circular knitting machine as described in claim 9, wherein the second right cam and second left cam are configured to be raised or lowered by loosening a cam knob, moving the cam knob and then tightening the cam knob.

12. The circular knitting machine as described in claim 11, wherein the second left cam and the second right cam are linked by a cam connector band so that the second left cam and the second right cam can be kept at the same height relative to a rim of the camshell.

13. The circular knitting machine as described in claim 1, wherein a torsion spring is configured to hold the first left cam in a lowered position.

14. The circular knitting machine as described in claim 1, wherein a torsion spring is configured to hold the first right cam in a lowered position.

15. The circular knitting machine as described in claim 2 wherein the tappet plate comprises a ribber cam wherein the ribber cam is configured to be moved toward the center of the tappet plate to increase the length of each rib stitch or moved away from the center of the tappet plate to decrease the length of each rib stitch.

16. The circular knitting machine as described in claim 2, wherein the ribber fin assembly comprises an adjuster piece, which can be moved horizontally to align the ribber needles with the CSM needles.

17. The circular knitting machine as described in claim 1, wherein the CSM assembly comprises a yarn carrier which can be adjusted up and down relative to a rim of the cylinder.

18. The circular knitting machine as described in claim 17, wherein the yarn carrier can be adjusted horizontally relative to the rim of the cylinder.

* * * * *